US010661129B2

(12) United States Patent
Seagram et al.

(10) Patent No.: US 10,661,129 B2
(45) Date of Patent: May 26, 2020

(54) METHOD OF FINISHING EXTERIOR SURFACE OF GOLF CLUB HEAD

(71) Applicant: DUNLOP SPORTS CO. LTD., Kobe-shi, Hyogo (JP)

(72) Inventors: Phillip C. Seagram, Long Beach, CA (US); Mika Becktor, New York, NY (US); Keith Dolezel, Franklin, NY (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 64 days.

(21) Appl. No.: 15/952,954

(22) Filed: Apr. 13, 2018

(65) Prior Publication Data

US 2019/0168084 A1 Jun. 6, 2019

Related U.S. Application Data

(60) Provisional application No. 62/595,058, filed on Dec. 5, 2017.

(51) Int. Cl.

| | |
|---|---|
| ***B24C 1/08*** | (2006.01) |
| ***C23C 24/04*** | (2006.01) |
| ***A63B 53/04*** | (2015.01) |
| ***B24B 19/26*** | (2006.01) |
| *A63B 102/32* | (2015.01) |
| *A63B 60/50* | (2015.01) |
| *A63B 60/48* | (2015.01) |

(52) U.S. Cl.

CPC ..... *A63B 53/047* (2013.01); *B24B 19/26* (2013.01); *B24C 1/08* (2013.01); *C23C 24/04* (2013.01); *A63B 53/0475* (2013.01); *A63B 60/48* (2015.10); *A63B 60/50* (2015.10); *A63B 2053/0412* (2013.01); *A63B 2053/0445* (2013.01); *A63B 2053/0479* (2013.01); *A63B 2053/0491* (2013.01); *A63B 2102/32* (2015.10)

(58) Field of Classification Search

CPC ..... A63B 53/047; A63B 2053/0491; A63B 60/50; A63B 60/48; A63B 53/0475; A63B 2053/0445; A63B 2053/0479; A63B 2053/0412; A63B 2102/32; B24B 19/26; C23C 24/04; B24C 1/08

See application file for complete search history.

(56) References Cited

U.S. PATENT DOCUMENTS

| | | | | |
|---|---|---|---|---|
| 6,203,405 | B1 * | 3/2001 | Hansen | B24C 11/00 451/38 |
| 2014/0000050 | A1 * | 1/2014 | Bardzilowski | A46B 13/001 15/161 |
| 2016/0067558 | A1 * | 3/2016 | Trahan | A63B 53/04 473/349 |

* cited by examiner

*Primary Examiner* — Rick K Chang
(74) *Attorney, Agent, or Firm* — Oliff PLC

(57) ABSTRACT

A method of finishing an exterior surface of a golf club head includes providing a golf club head having an exterior surface that includes a first surface region, a second surface region, and a third surface region. The method further includes steps of applying a first surface finish to at least the third surface region, applying a first masking to at least the first and third surface regions, applying a second surface finish to the second surface region, removing the first masking, applying a second masking to at least the second and third surface regions, applying a third surface finish to the first surface region, and removing the second masking.

20 Claims, 47 Drawing Sheets

METHOD OF FINISHING EXTERIOR SURFACE OF GOLF CLUB HEAD

This application claims the benefit of Provisional Application No. 62/595,058, filed Dec. 5, 2017. The entire disclosure of that application is incorporated herein by reference in its entirety.

BACKGROUND

Golf club performance is an amalgam of many elements including a golf club's ability to efficiently transfer energy to a hit golf ball, ability to impart desirable spin characteristics to a ball, ability to generate feedback to a golfer responsive to a particular manner of impact, e.g. to impart "feel," and ability to enable a golfer to exercise a wide array of shot types. In addition to this, what constitutes effective performance varies with the role of each club. An often overlooked aspect of performance, but considered of increased significance with higher-lofted clubs, is shot dispersion, i.e. the degree to which a set of golf shots (impacted with a particular club) fall within a desired distance from a target location. As the golfer nears the green, carry distance wanes in importance as precision increases in importance.

This principle particularly holds true in the case of wedge-type golf club heads. However, attempts at designing wedge-type golf club heads have generally been inadequate as steps taken to reduce dispersion often adversely affect other attributes expected of or desirable of wedge-type golf club heads. For example, traditional feel and design attributes necessary for instilling confidence in the golfer and for compliance with rules promulgated by one or more professional golf regulatory bodies (e.g. the United States Golf Association (USGA)) may be sacrificed. Also, attempts at decreasing dispersion often result in the relocation of club head mass in locations that adversely affect spin, trajectory shape, effective bounce, and/or ability to successfully carry out a full range of shot types typically associated with wedge-type club heads.

SUMMARY

A need exists for reducing shot dispersion in high-lofted club heads (e.g. wedge-type club heads), while maintaining other performance attributes typically expected and/or desired of such club heads.

In an example of the present disclosure, a golf club head includes a striking face, a sole portion, a top portion, a hosel, a rear surface, a loft no less than 40°, a virtual vertical plane, and a center of gravity. The striking face has a face center, a leading edge, and a virtual striking face plane. The hosel includes an internal bore configured to receive a golf shaft and includes a peripheral side wall and a shaft abutment surface configured to abut a tip end of the golf shaft. The rear surface is opposite the striking face and has an upper portion and a lower portion, the lower portion including a forward-extending recess. The insert covers the recess forming a hollow portion. The virtual vertical plane is perpendicular to the striking face plane and passes through the face center. The center of gravity is spaced a distance from the virtual vertical plane in the heel-to-toe direction. The distance D1 may be no more than 4.5 mm.

In another example of the present disclosure, a correlated set of golf club heads may include a first club head that, when oriented in a reference position, comprises: a first loft angle L1 between 40° and 50°; a first striking face having a first face center, a first leading edge, a first virtual striking face plane generally parallel to the first striking face, and a first striking face surface area SA1 no greater than 4.35 $in^2$; a first sole portion; a first top portion; a first rear surface opposite the first striking face; a first hosel; a first virtual vertical plane perpendicular to the first striking face plane and passing through the first face center; and a first club head center of gravity spaced from the first virtual vertical plane in the heel-to-toe direction by a first distance D1A that is no greater than 6 mm. The correlated set of golf club heads may also include a second club head that, when oriented in a reference position, comprises: a second loft angle L2 greater than 50°; a second striking face having a second face center, a second leading edge, a second virtual striking face plane generally parallel to the second striking face, and a second striking face surface area SA2 no less than 4.45 $in^2$; a second sole portion; a second top portion; a second rear surface opposite the second striking face; a second hosel; a second virtual vertical plane perpendicular to the second striking face plane and passing through the second face center; and a second club head center of gravity spaced from the second virtual vertical plane in the heel-to-toe direction by a second distance D1B that is no greater than 6 mm.

In another example of the present disclosure, a correlated set of golf club heads may include a first club head that, when oriented in a reference position, may include a first loft angle L1 between 400 and 50°; a first striking face having a first face center, a first leading edge, and a first virtual striking face plane generally parallel to the first striking face; a first sole portion; a first top portion; a first rear surface opposite the first striking face; a first hosel; a first virtual vertical plane perpendicular to the first striking face plane and passing through the first face center; a first club head center of gravity spaced from the first virtual vertical plane in the heel-to-toe direction by a first distance D1A that is no greater than 6 mm; and a first heel blade height BH1 no greater than 38 mm. The correlated set of golf club heads may also include a second club head that, when oriented in a reference position, may include a second loft angle L2 greater than 50°; a second striking face having a second face center, a second leading edge, and a second virtual striking face plane generally parallel to the second striking face; a second sole portion; a second top portion; a second rear surface opposite the second striking face; a second hosel; a second virtual vertical plane perpendicular to the second striking face plane and passing through the second face center; a second club head center of gravity spaced from the second virtual vertical plane in the heel-to-toe direction by a second distance D1B that is no greater than 6 mm; and a second heel blade height BH2 no less than 39 mm.

In another example of the present disclosure, a golf club head, when oriented in a reference position relative to a ground plane, may include a striking face having a face center, a leading edge, and a virtual striking face plane generally parallel to the striking face. The golf club head further includes a sole portion, a top portion, a rear portion, and a loft L no less than 40°. A virtual vertical plane perpendicular to the striking face plane passes through the face center. A club head center of gravity is spaced from the virtual vertical plane in the heel-to-toe direction by a distance D1 that is no greater than 6.0 mm. The golf club head further includes a hosel including a virtual hosel axis and an internal bore configured to receive a golf shaft. The internal bore includes a peripheral side wall and a shaft abutment surface configured to abut a tip end of the golf club shaft. The hosel further comprises an auxiliary recess extending sole-ward from the abutment surface of the internal bore.

In another example of the present disclosure, a golf club head may include a golf club head that, when oriented in a reference position, includes a sole portion, a top portion, a heel portion, and a toe portion. The club head further includes a striking face having a face center, a leading edge, a virtual striking face plane generally parallel to the striking face, and a plurality of scorelines having a heel-most extent and a toe-most extent. The club head further includes a hosel portion having an internal bore configured to receive a golf shaft, a first virtual vertical plane perpendicular to the striking face plane and passing through the heel-most extent of the plurality of scorelines, a heel-most region defined as the entire portion of the club head located heelward of the first virtual vertical plane, a recessed region delimiting a volume such that the majority of the volume is located in the heel-most region. The club head has a loft L no less than 40°. A second virtual vertical plane perpendicular to the striking face plane passes through the face center. A club head center of gravity is spaced from the second virtual vertical plane in the heel-to-toe direction by a distance D1 that is no greater than 6.0 mm.

In another example of the present disclosure, a golf club head may include a golf club head that, when oriented in a reference position relative to a virtual ground plane, includes a striking face having a face center, a leading edge, and a virtual striking face plane generally parallel to the striking face. The club head further includes a sole portion, a top portion, a rear portion, and a loft L no less than 40°. A virtual vertical plane perpendicular to the striking face plane passes through the face center. A point P1 is located at the intersection of the leading edge and the virtual vertical plane. A center of gravity is spaced from the virtual vertical plane in the heel-to-toe direction by a distance D1 that is no greater than 5.5 mm, spaced from the striking face plane by a minimum distance D2 such that: $D2 \leq 3.58\ mm-(0.053\ mm/°)\times L$, and vertically spaced from the point P1 by a distance D3 such that: $D3 \geq 29.5\ mm-(0.3\ mm/°)\times L$.

In another example of the present disclosure, a golf club head may include a golf club head that, when oriented in a reference position relative to a virtual ground plane, includes a striking face having a face center, a leading edge, and a virtual striking face plane generally parallel to the striking face. The club head further includes a sole portion, a top portion, a rear portion, and a loft L no less than 40°. A virtual vertical plane perpendicular to the striking face plane passes through the face center. A point P1 is located at the intersection of the leading edge and the virtual vertical plane. A center of gravity is spaced from the virtual vertical plane in the heel-to-toe direction by a distance D1 that is no greater than 5.0 mm, spaced from the striking face plane by a minimum distance D2 no greater than 0.50 mm, and vertically spaced from the point P1 by a distance D3 such that: $D3 \geq 29.5\ mm-(0.3\ mm/°)\times L$.

The various exemplary aspects described above may be implemented individually or in various combinations.

These and other features and advantages of the golf club heads and methods according to the invention in its various aspects and demonstrated by one or more of the various examples will become apparent after consideration of the ensuing description, the accompanying drawings, and the appended claims.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein.

For purposes of illustration, these figures are not necessarily drawn to scale. In all figures, same or similar elements are designated by the same reference numerals.

DESCRIPTION

Figure 1:
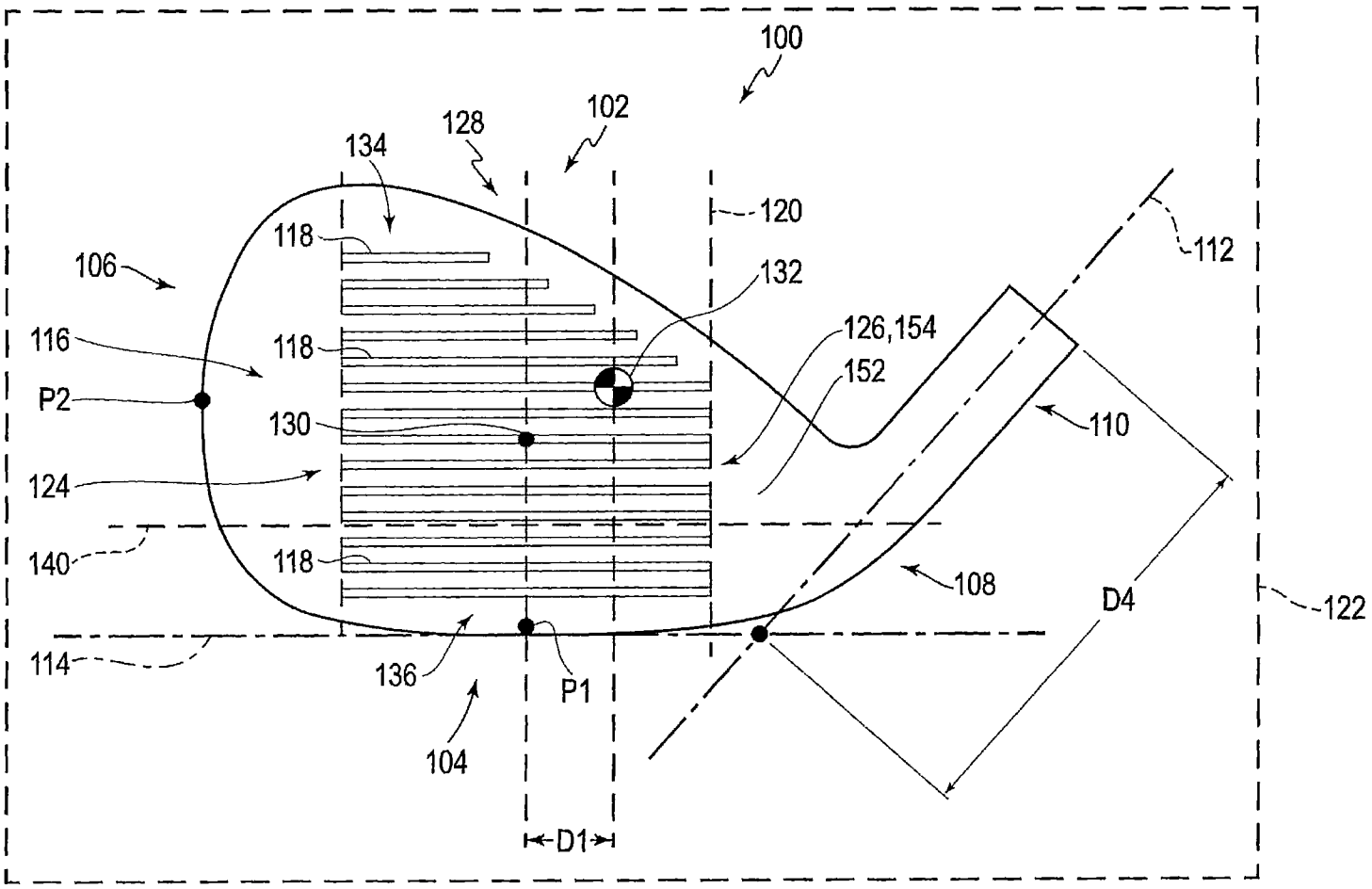
FIG. 1 is a front elevation view of an exemplary golf club head in accordance with one or more embodiments.
Figure 2:
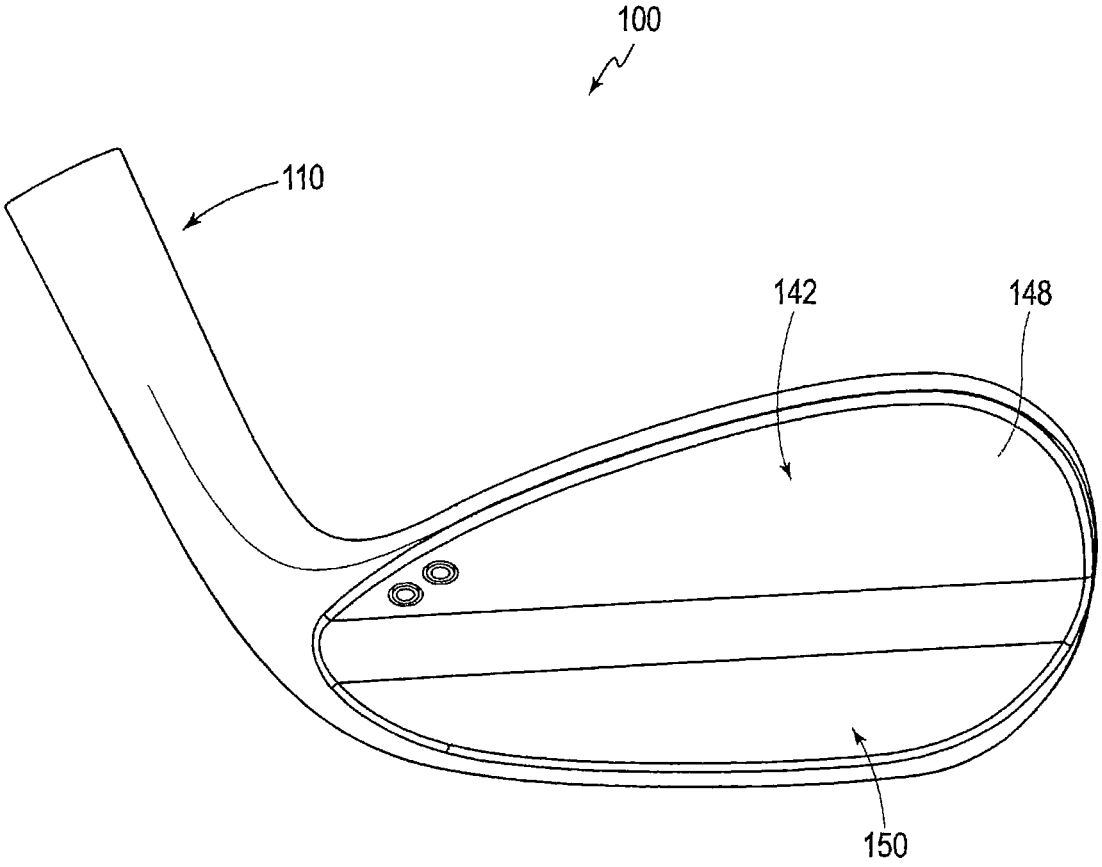
FIG. 2 is a rear elevation view of the exemplary golf club head of FIG. 1.
Figure 3:
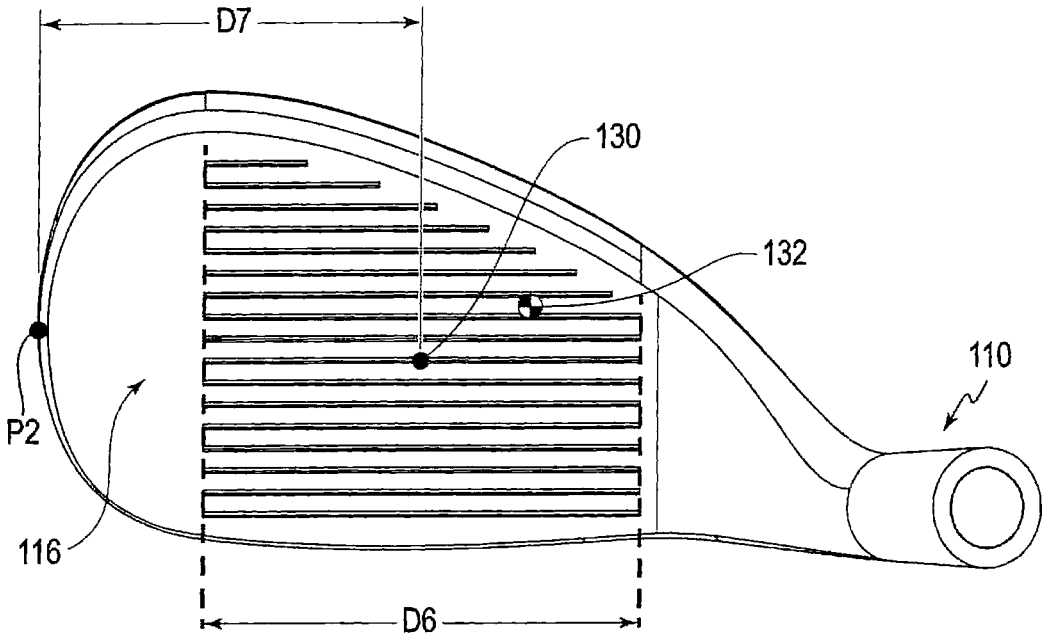
FIG. 3 is a top plan view of the exemplary golf club head of FIG. 1.
Figure 4:
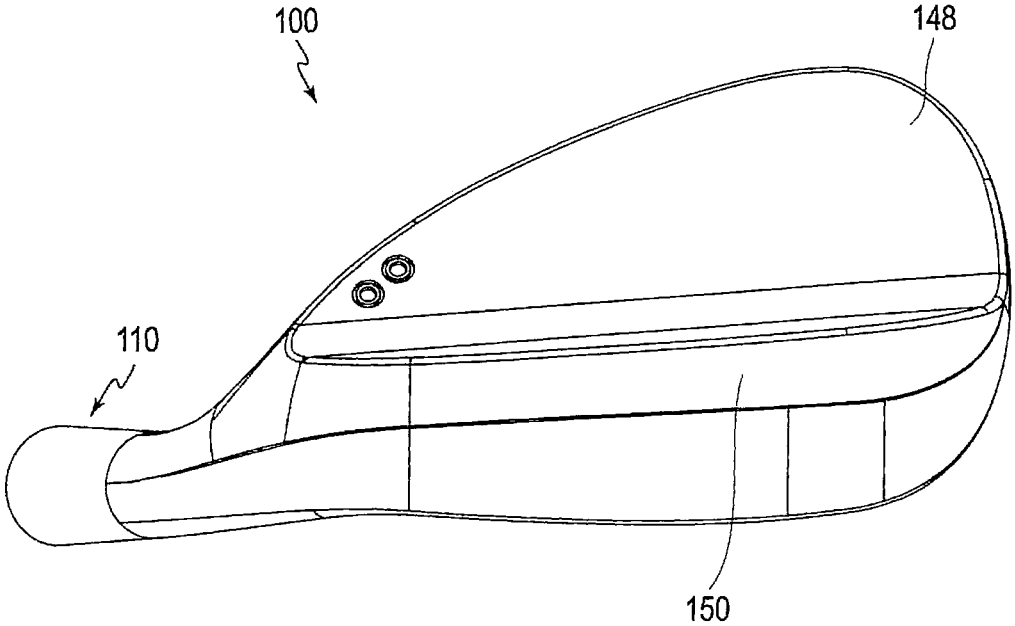
FIG. 4 is a bottom plan view of the exemplary golf club head of FIG. 1.

Representative examples of one or more novel and non-obvious aspects and features of a golf club head according to the present disclosure are not intended to be limiting in any manner. Furthermore, the various aspects and features of the present disclosure may be used alone or in a variety of novel and non-obvious combinations and sub-combinations with one another.

Referring to FIGS. 1-7, a golf club head 100 is shown. The golf club head include a top portion 102, a bottom portion (or sole portion) 104 opposite of the top portion 102, a heel portion 108 and a toe portion 106 opposite of the heel portion 108. The golf club head further includes a hosel 110 that defines a central longitudinal hosel axis 112. The club head further includes a striking face 116 and a rear portion (see FIG. 2) opposite of the striking face. The striking face is configured to impact a golf ball when the club head is in use.

The striking face comprises a generally planar surface. For example, the striking face generally conforms to a planar hitting surface suitable for striking a golf ball, but may deviate to a minor extent as it may preferably include formed therein a plurality of scorelines extending in the heel-to-toe direction. In some embodiments, the striking face may also possess bulge and/or roll of a constant or variable radius that are customary of a wood-type or hybrid-type club head (e.g. a radius no less than about 9 in). In some embodiments, the striking face may have formed therein one or more texture patterns. For example, the striking face may include a surface milled region (as described below), a media-blasted region, a chemical etched region, a laser-milled region. Such regions may be formed in a striking face in combination, either in discrete mutually exclusive regions or at least partially (or fully) overlapping. Preferably, textured striking face regions are located at least in a central region that includes the majority (and more preferably the entirety) of the plurality of scorelines. In such cases, interaction between the striking face and golf ball may be enhanced (e.g. by increasing friction), thereby better controlling and/or increasing spin. In some embodiments, in addition to the a central region that exhibits a media-blasted and/or surface milled texture, heel and toe regions peripheral to such central region exhibit high polish surface textures.

The striking face 116 further includes a face center 130. The face center 130, for all purposes herein, denotes the location on the striking face that is both equidistant between: (a) the heel-most extent 124 and the toe-most extent 126 of the plurality of scorelines 118; and (b) the top-most extent 134 and the bottom-most extent 136 of the plurality of scorelines 118. The striking face 116 corresponds to a virtual striking face plane (see e.g. FIG. 7) 138. Where the striking face 116 includes bulge and/or roll, the virtual striking face plane 138 is to be considered to be a virtual plane tangent to the striking face 116 at the face center 130. A virtual vertical plane 128, perpendicular to the striking face plane 138 and passing through the face center 130, is also shown.

The plurality of scorelines 118 further comprise an overall lateral width D6, measured from the heel-most extent 124 to the toe-most extent, of preferably between 49 mm and 55 mm, more preferably between 50 mm and 52 mm.

The striking face 116 further include a leading edge 144 corresponding to the nexus of forwardmost points on the striking face corresponding to the nexus of incremental front-to-rear vertical profiles taken through the striking face 116. For example, as particularly shown in FIG. 7, the leading edge 144 intersects with vertical plane 128 at a point P1.

The club head 100 further includes a toe-wardmost extent P2. As particularly illustrated in FIG. 3, a distance D7 is measured laterally from the face center 130 to the toe-wardmost point P2. Preferably, D7 is no less than 40 mm, more preferably between 42 mm and 50 mm, even more preferably between 44 mm and 46 mm. These attributes may be indicative of both a sufficiently large impact surface to offer the full range of wedge-type golf shots and to instill confidence in the golfer resulting in improved performance.

As shown in FIG. 1, the club head 100 is in a reference position. "Reference position," as used herein, refers to an orientation of a club head (e.g. golf club head 100) relative to a virtual ground plane (e.g. virtual ground plane 114) in which the sole portion 104 of the golf club head 100 contacts the virtual ground plane 114 and the hosel axis 112 of the hosel 110 lies in a virtual vertical hosel plane 122, which intersects the virtual striking face plane 138 to form a virtual horizontal line 140. Unless otherwise specified, all attributes of the embodiments described herein are assumed to be with respect to a club head oriented in a reference position. The club head 100 further includes a rear portion 142 (see FIG. 2) opposite the striking face 116.

The golf club head 100 preferably comprises an iron-type club head, and more preferably a wedge-type club head. Additionally, the club head 100 is preferably a "blade"-type club head. In such embodiments, the club head 100 comprises a upper blade portion 148 and a lower muscle portion 150. The upper blade portion is preferably of substantially uniform thickness. Preferably, the club head, as a "blade"-type club head lacks any perimeter-weighting features. However, in some embodiments, the club head may embody a perimeter-weighting feature, although such perimeter weighting element preferably has a maximum depth that is no greater than about 10 mm, and more preferably no greater than about 5 mm. "Blade"-type club heads provide for more disparity in feel resulting in a high degree of tactile feedback to the golfer upon impact. Minimizing perimeter-weighting also increases workability of the club head, providing for a wider array of potential shot types and resulting trajectories. These features are sought after, particularly in the case of high-lofted club heads (e.g. club heads having a loft greater than 30°), and more particularly in the case of wedge-type club heads.

Figure 7:
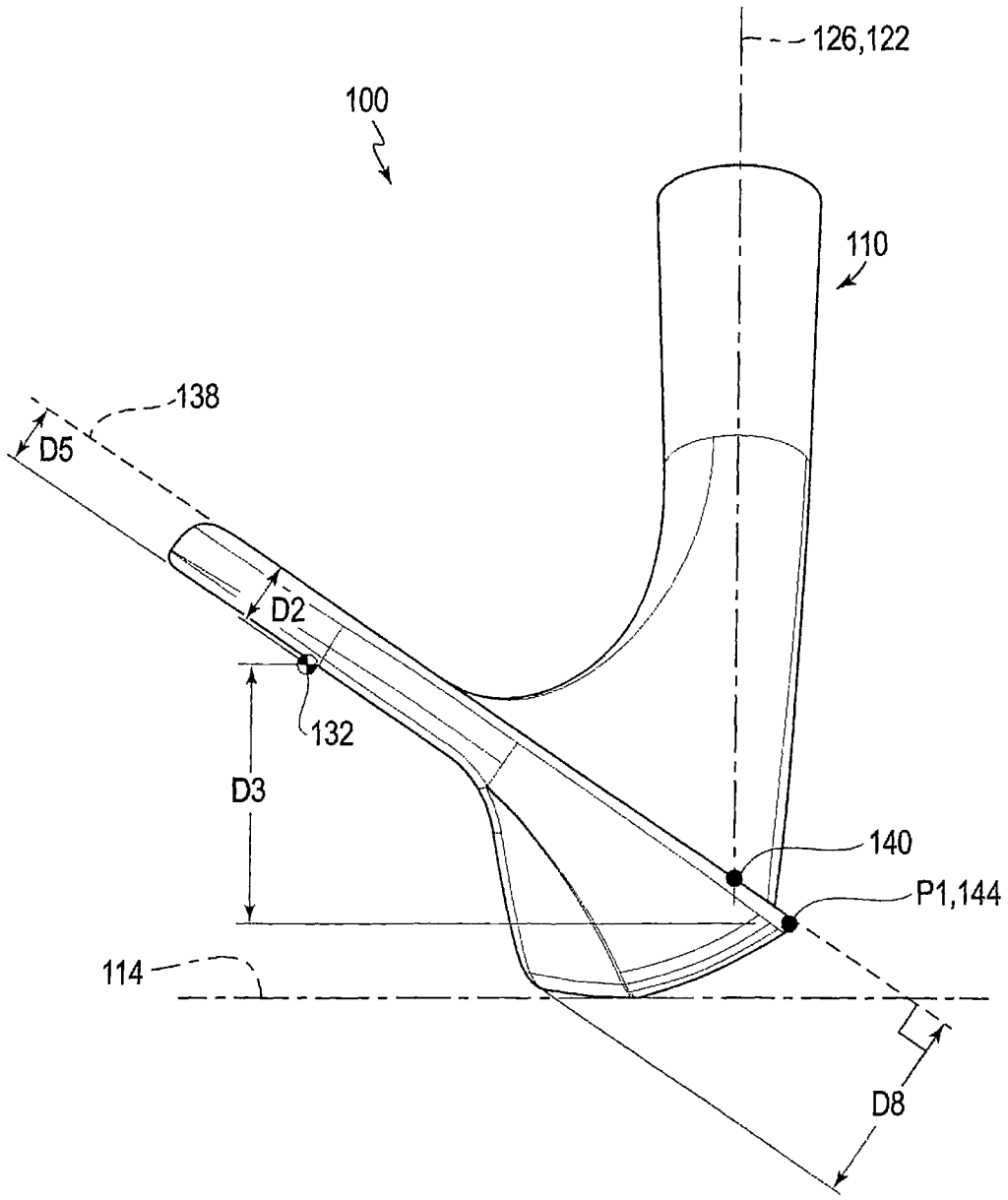
FIG. 7 is a toe side elevation view of the exemplary golf club head of FIG. 1.

In effort to achieve these and other benefits, and in part as a result of constituting a "blade"-type club head, the center of gravity 132 of the club head 100 is preferably located relatively close to the striking face plane (see FIG. 7). Preferably, the center of gravity 132 is spaced from the striking face plane 138 by a distance D2 no greater than 2.0 mm, more preferably no greater than 1.0 mm, and even more preferably no greater than 0.5 mm. Providing a club head having such center of gravity location may promote high tactile feedback, playability, and solid feel. These attributes, as described above, are particularly advantageous in a wedge-type club head. Thus, preferably, the club head 100 include a loft L of no less than 40°, more preferably between 40° and 67°.

Additionally, or alternatively, the center of gravity 132 is located sole-ward of the striking face plane 138. However, in alternative embodiments, the center of gravity 132 is locate above the striking face plane 138.

Additionally, or alternatively, the relative location of center of gravity is loft-dependent. Thus, in a set of iron-type or wedge-type golf club heads, the center of gravity location varies from club head to club head with loft angle. Preferably, the club head 100 is configured such that the distance D2 is related to club head loft angle in accordance with the following equation:

$$D2 \leq 3.58\ \text{mm} - (0.053\ \text{mm}/^\circ) \times L$$

Such attributes ensure the advantages associated with blade-type construction are achieved, while accounting for natural variations in club head design properties that may be associated with club head loft angle, thus more precisely providing a high performance club head.

The club head further comprises a center of gravity 132. The inventors have recognized that center of gravity location plays a critical role in reducing shot dispersion for a particular club head. Preferably, in part to minimize shot dispersion, the center of gravity is located central of the striking face. Preferably, the center of gravity 132 is spaced from the face center 130 by a heel-to-toe distance D1 of no greater than 6.0 mm, more preferably no greater than 5.5 mm, and even more preferably no greater than 5.0 mm. Most preferably, the center of gravity 132 is aligned with the face center 130 in the heel-to-toe direction (i.e. coplanar with a vertical plane passing through the face center and perpendicular to the striking face plane). However, pure alignment is difficult to achieve at least for presence of typical manufacturing tolerances.

As shown below in Table 1, short dispersion is substantially reduced in comparison to a similarly structured wedge of the same loft, but with significantly greater lateral center of gravity spacing from the face center 130 of the striking face 116.

| Model | Loft (°) | D1 | Average Distance from Intended Target (ft) |
|---|---|---|---|
| Cleveland Golf RTX 2.0 MB | 52 | 8 mm | 7.8 |
| Embodiment #1 | 52 | 5 mm | 11.1 |

In addition, or alternatively, the center of gravity 132 is preferably heelward of the face center 130, albeit by the degree of spacing (D1) as described above. Positioning the center of gravity 132 toe-ward of the face center 130, although an option, is likely to require a significant degree of relocation of discretionary mass, given the natural heel-ward bias of club head mass distribution given the presence of the hosel 110. Although possible, such a degree of mass shift may have a deleterious effect on other key attributes correlated with performance expected or desired in a wedge-type club head. For example, the structural integrity of the club head may be affected.

Also, particularly for a blade-type club head, e.g. the club head 100, mass is concentrated in the muscle portion 150. Because mass is not an independently adjustable club head attribute (i.e. corresponds with the location of actual material), a lateral center of gravity shift may naturally disproportionately affect the design of the sole portion. This natural design tendency, in some cases, may be considered deleterious. For example, mass added to the muscle portion 150 may affect the effective bounce of the club head 100 (i.e. the manner in which the club head 100 interacts with turf), desired dynamic loft, and spin-generating attributes. Thus, preferably, the center of gravity is positioned, laterally, as described above—but in a manner so as to not adversely affect other key club head attributes. The difficulty inherent in this trade-off may be exacerbated by the fact that wedge-type club heads are necessarily compact in shape thereby provide little discretionary weight that may be positioned or repositioned solely for purposes of mass property manipulation.

In one manner of the above design aspects, in some embodiments, the center of gravity height is desirably maintained provided the lateral center of gravity location attributes described above. For example, as shown in FIG. 7, the center of gravity 132 of club head 100 is vertically spaced from the point P1 by a distance D3. Preferably, D3 is no greater than 17 mm and more preferably between 17 mm and 10 mm. However, this distance D3 is influenced by club head loft and thus, more precisely expressed as a function of loft. Thus, in addition, or alternatively, D3 corresponds with the loft L of the club head 100 in accordance with the following equation:

$$D3 \geq 29.5 \text{ mm} - (0.3 \text{ mm}/^\circ) \times L$$

More preferably, D3 corresponds with the loft L of the club head 100 in accordance with the following equation:

$$D3 \geq 29.8 \text{ mm} - (0.3 \text{ mm}/^\circ) \times L$$

Measuring center of gravity height relative to P1 (i.e. leading edge location) may be advantageous in that sole contour features, e.g. those related to various effective bounce options, are removed from consideration. In this manner, a more pure relationship between center of gravity height measurement and actual effect on performance emerges.

In another manner of the above design aspects, in some embodiments, the shape of the bottom (sole) portion 104 is desirably maintained provided the lateral center of gravity location attributes described above. As an exemplary indicator of maintaining desirable sole shape, the club head 100 includes a sole width D8 (see FIG. 7). For all purposes herein, "sole width" denotes the distance between the striking face plane 138 and the rearwardmost extent of the club head 100 measured in the front-to-rear direction and perpendicularly to the striking face plane 138. Preferably, D8 is no greater than 20 mm, more preferably between 14 mm and 20 mm, and even more preferably between 16 mm and 18 mm.

In yet another manner of the above design aspects, in some embodiments, the golf club head 100 maintains a desirable upper blade portion maximum thickness D5 (see FIG. 7). For all purposes herein, the distance D5 refers to the maximum thickness of the upper blade portion measured in the front-to-rear direction and perpendicularly to the striking face plane 138. Preferably, the distance D7 is no greater than 7 mm, more preferably no greater than 6 mm, and even more preferably no greater than 5.70 mm, and most preferably between 4.75 mm and 5.75 mm.

The club head preferably has a head mass of between 250 g and 350 g, more preferably between 270 g and 310 g, even more preferably between 285 g and 300 g. Additionally, or alternatively, the club head 100 include a moment of inertia (Izz) measured about a virtual vertical axis passing through the center of gravity 132. The moment of inertia Izz is preferably no less than 2500 kg*cm$^2$, more preferably between 2650 kg*cm$^2$ and 3100 kg*cm$^2$.

As variously described above, in some embodiments, it is desirable to position the center of gravity 132, laterally, in close proximity to the face center 130 in a manner that does not deleteriously affect other key wedge-type club attributes. Accordingly, in some embodiments, mass is removed from a generally heel-ward location and relocated to other portions of the club head or distributed uniformly about remaining regions of the club head.

In some embodiments, the golf club head 100 include a virtual heel-most region 152, which refers to the entirety of the club head 100 located heel-ward of a virtual vertical plane 154 perpendicular to the striking face plane 138 and including the heel-wardmost extent 126 of the plurality of scorelines 118. Preferably, a recessed region 156 is located at least partially in the heel-wardmost region 152. More preferably, at least a majority of the recessed region 156 (measured by displaced volume) is located within the heel-wardmost region 152. Most preferably, the recessed region 156 in its entirety is located within the heel-wardmost region 152 of the club head 100.

Figure 5:
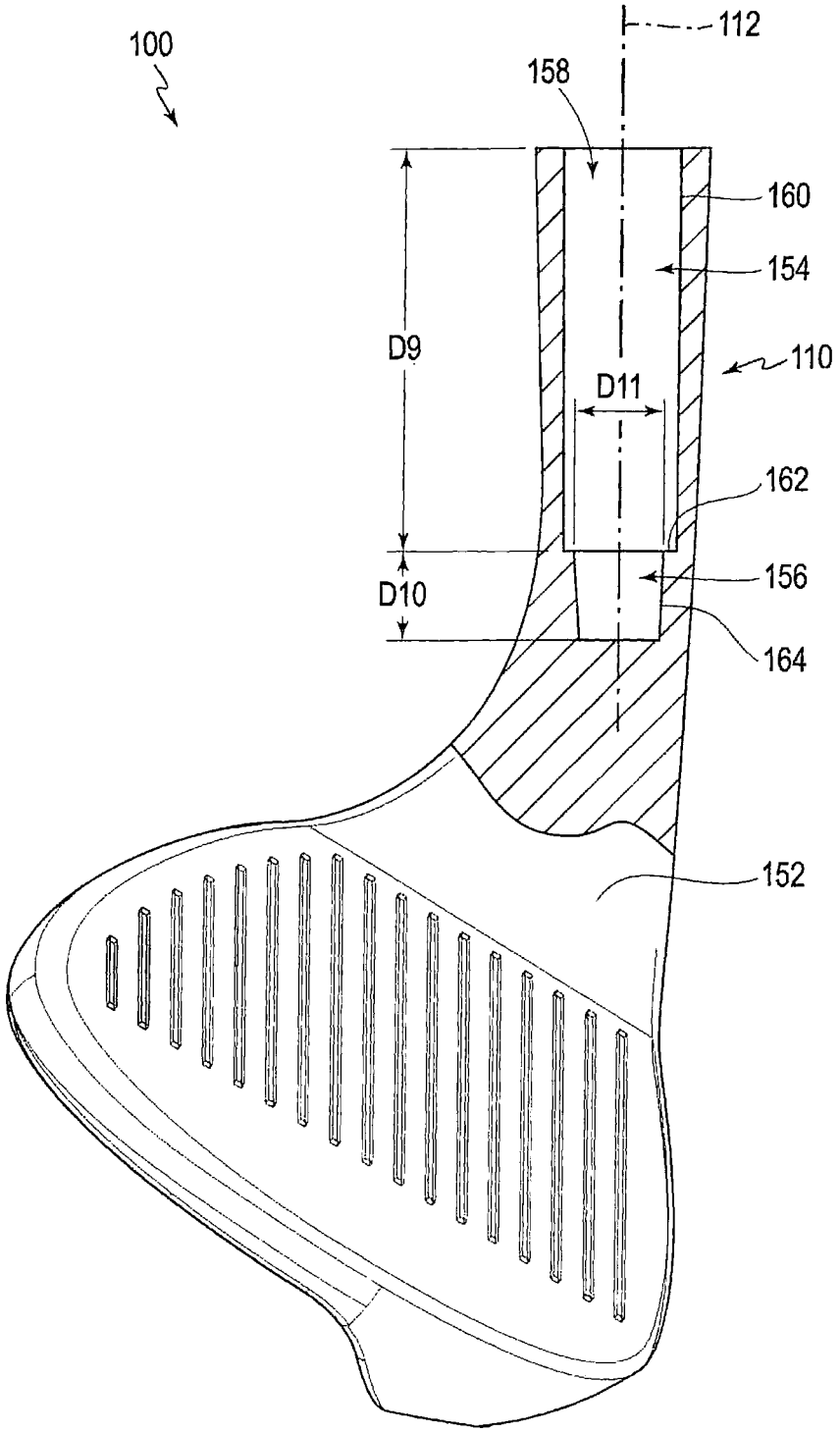
FIG. 5 is a toe-side perspective view of the exemplary golf club head of FIG. 1, with the club head oriented such that a virtual hosel axis extends parallel to the plane of the paper.
Figure 6:
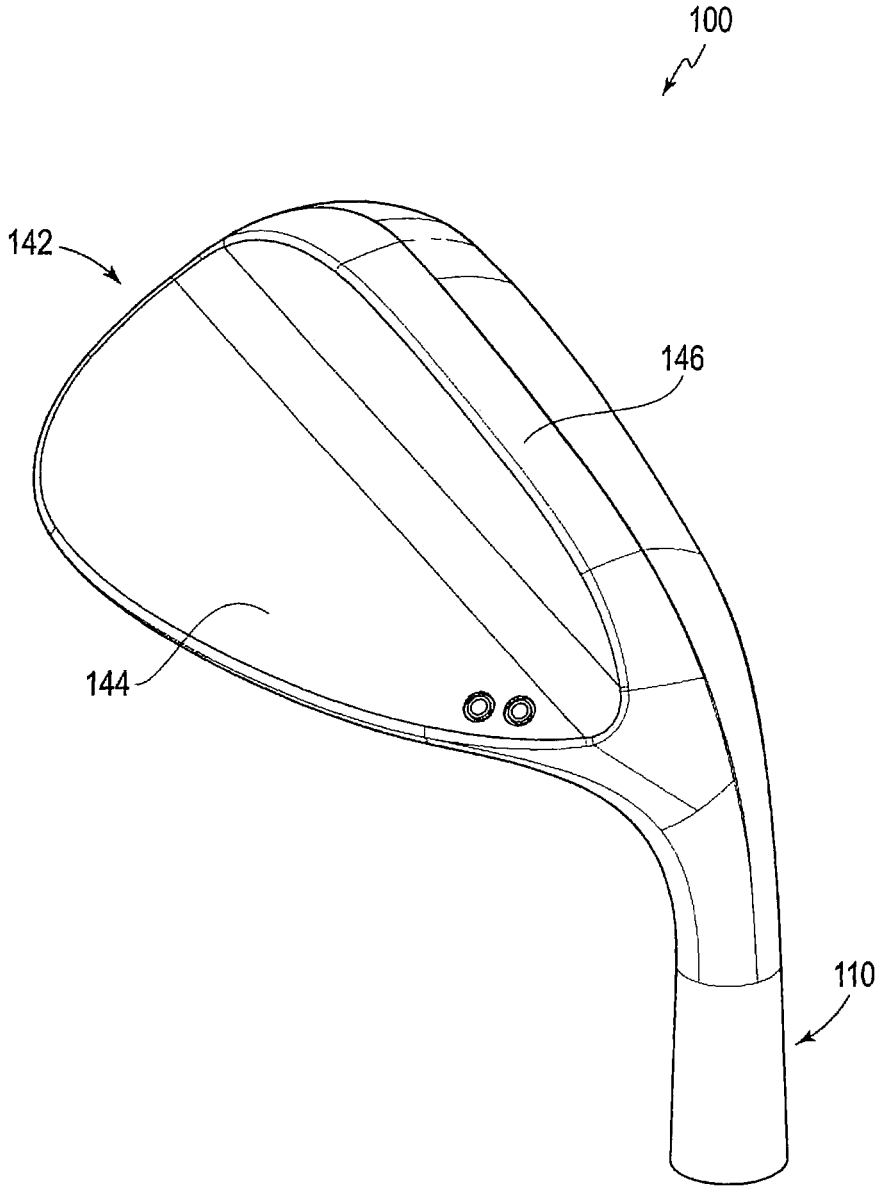
FIG. 6 is a rear perspective view of the exemplary golf club head of FIG. 1.

As shown particularly in FIG. 5, the hosel 110 of the club head 100 includes an internal bore 158. The internal bore 158 is preferable dimensioned to receive and secure a conventional golf club shaft to the club head 100, thereby forming a golf club. The internal bore 158, specifically, includes a peripheral side wall 160 and a bottom surface being a surface configured to abut and support a tip end of a conventional golf shaft. In some embodiments, the abutment surface takes the form of a peripheral ledge.

The internal bore 158 preferably includes a diameter that ranges from a maximum diameter of about 10.5 mm, proximate an upper end of the internal bore 158, to a minimum diameter of about 8.5 mm. The diameter of the internal bore 158, in some embodiments, gradually decreases in the sole-ward direction. Additionally, or alternatively, at least one stepped region is located in the side wall 160 of the internal bore, e.g. for housing epoxy and/or ferrule component when the club head 100 is secured to a shaft assembly.

The abutment surface 162 (or peripheral ledge 162 in the particular embodiment shown in FIG. 5) preferably has a width, measured radially relative to the virtual hosel axis, no less than 1.0 mm, and more preferably between 1.0 mm and 3.0 mm. Such attributes ensure sufficient surface area and counter force applied to the shaft in consideration of typical loads applied at the shaft-hosel junction during use.

The recessed region 156 (in the particular embodiment of FIG. 5, an auxiliary recess 156) extends sole-ward from the abutment surface 162 of the internal bore 158 of the hosel 110, thereby forming a "blind cavity." The auxiliary recess 156 preferable has a depth D10, measured along the hosel axis 112 no less than 4 mm, more preferably no less than 6 mm and most preferably between 6 mm and 10 mm. The auxiliary recess 156, in addition, preferably includes a width D11 (in the particular embodiment of FIG. 5, a maximum diameter D11) of between 4 mm and 10 mm, more preferably between 5 mm and 8 mm. The auxiliary recess 156 further include a sidewall 164, which is preferably inclined such that the width D10 (or diameter D10 as the case may be) of the auxiliary recess 156 tapers in the sole-ward direction. Such facilitates manufacture, e.g. by enabling insertion of e.g. a ceramic pin to form (and be subsequently removed from) the auxiliary recess 156 in an investment casting process.

As an alternative to cast-in formation, the auxiliary recess, in some embodiments, is machined into the club head 100 subsequent to formation of the club head main body (e.g. by investment casting). In such embodiments, preferably the auxiliary recess 156 is milled by applying a tapered bit configured to rotate about, and penetrate along, the virtual hosel axis 112.

Additionally, or alternatively, as another means of reducing lateral spacing between the face center 130 of the striking face 116 and the center of gravity 132, the hosel length is preferably reduced. Specifically, the distance D4 from the uppermost extent of the hosel 110 to the ground plane 114, measured along the virtual hosel axis 112, is preferably no greater than 75 mm and more preferably between 70 mm and 75 mm. By shortening the hosel length, discretionary mass may be removed from points distal the face center 130 and redistributed throughout the club head 100, thereby relocating the center of gravity 132 of the club head 100 closer to the face center 130, while minimizing any deleterious adverse effects on performance.

In some embodiments, the auxiliary recess is at least partially filled. In some such embodiments, the auxiliary recess is entirely filled with a filler material. Such may be advantages for dampening of vibrations emanating from impact with a golf ball. In such embodiments, the filler material is preferably a material having a density less than that of the main body of the club head. Alternatively, or additionally, the density of the auxiliary recess filler material is no greater than 7 g/cm$^3$ and more preferably no greater than 4 g/cm$^3$. Additionally, or alternatively, the filler material has a hardness less than that of the main body and optionally comprises a resilient material such as a polymeric material, natural or synthetic rubber, polyurethane, thermoplastic polyurethane (TPU), an open- or closed-cell foam, a gel, a metallic foam, a visco-elastic material, or resin.

Further attributes, in conjunction with the mass-related attributed described above, are believed to further reduce shot dispersion. For example, in some embodiments, the striking face club head 100 preferably includes a texture pattern located at least in a central region, i.e. a region delimited by the heel-wardmost extent 126 and the toe-wardmost extent 124 of the plurality of scorelines 118. Preferably, the texture pattern comprises a surface milled pattern, e.g. any of the surface milled patterns described in U.S. patent application Ser. No. 15/219,850 (Ripp et al.), hereby incorporated by reference in its entirety. In particular, the surface milled pattern preferably includes a plurality of small-scale arced grooves superimposed on the plurality of scorelines 118. In some embodiments, the surface milled pattern includes a single plurality generally parallel arced grooves, optionally formed in a single pass at a constant or variable feed rate, at a constant or variable spin rate, and at a constant or variable cutting depth. However, in other embodiments, the surface milled pattern includes a first set of generally parallel arced grooves, formed optionally in a single, first pass, and a second set of generally parallel arced grooved, formed optionally in a singled second pass to be superimposed on the plurality of arced grooves formed in the first pass. Preferably, one the first or second pluralities of arced grooved defines upwardly concave paths, while the respective second or first pluralities of arced grooves defines upwardly convex paths. In any case, the striking face 118 preferably includes a surface roughness Ra, particularly in the central region, of between about 120 μin and 180 μin, more preferably between 140 μin and 180 μin, such surface roughness measured at standard ASME conditions.

Additionally, or alternatively, the plurality of scorelines 118 are formed by machining, e.g. milling, and not cast and thereby exhibit those structural feature associated with machined scorelines, e.g. higher precision, generally non-warped surface portions, and sharper corners formed between the scorelines 118 and the striking face 116.

Figure 8:
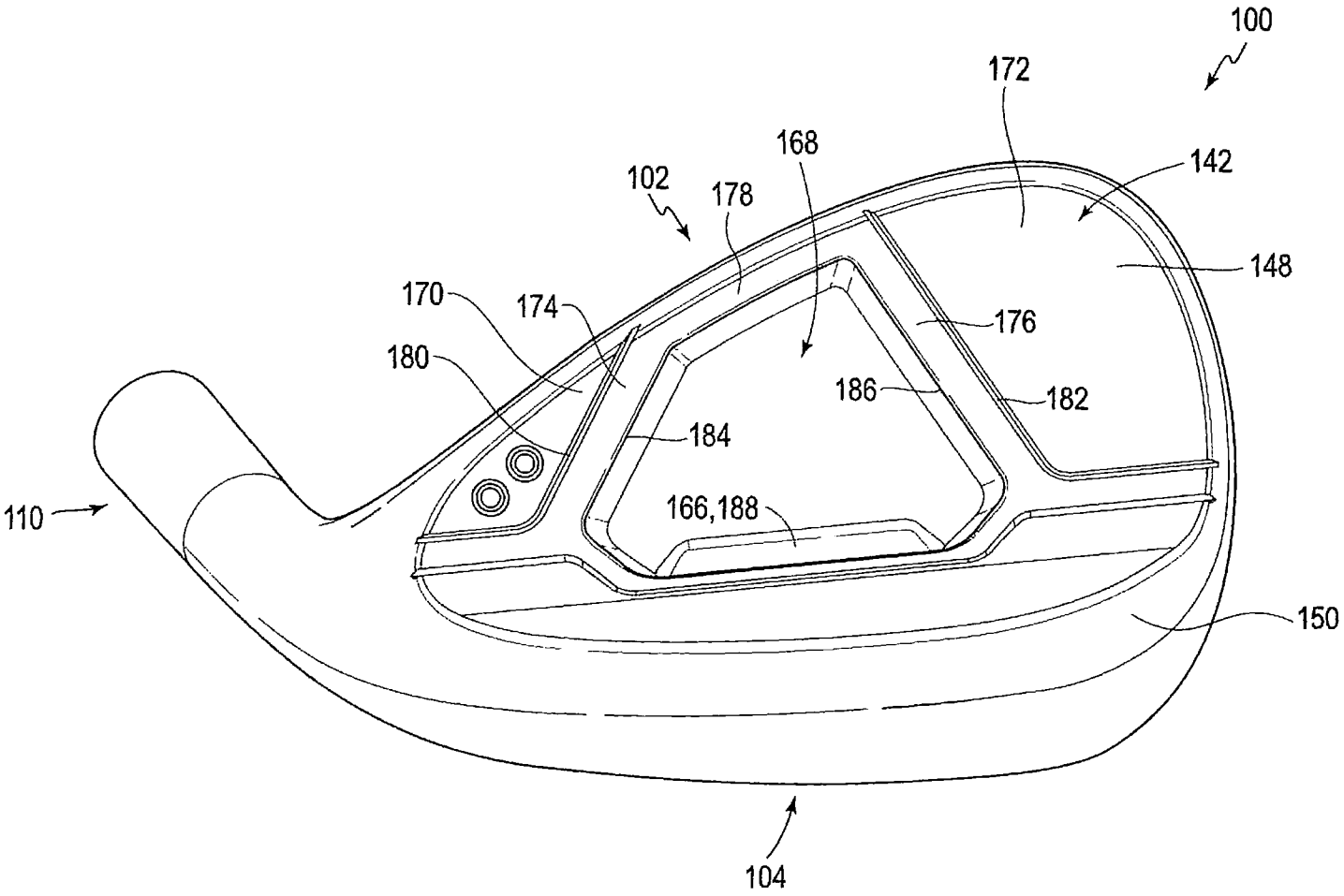
FIG. 8 is a rear perspective view of the exemplary golf club head of FIG. 1 having an alternative rear portion structure.
Figure 9:
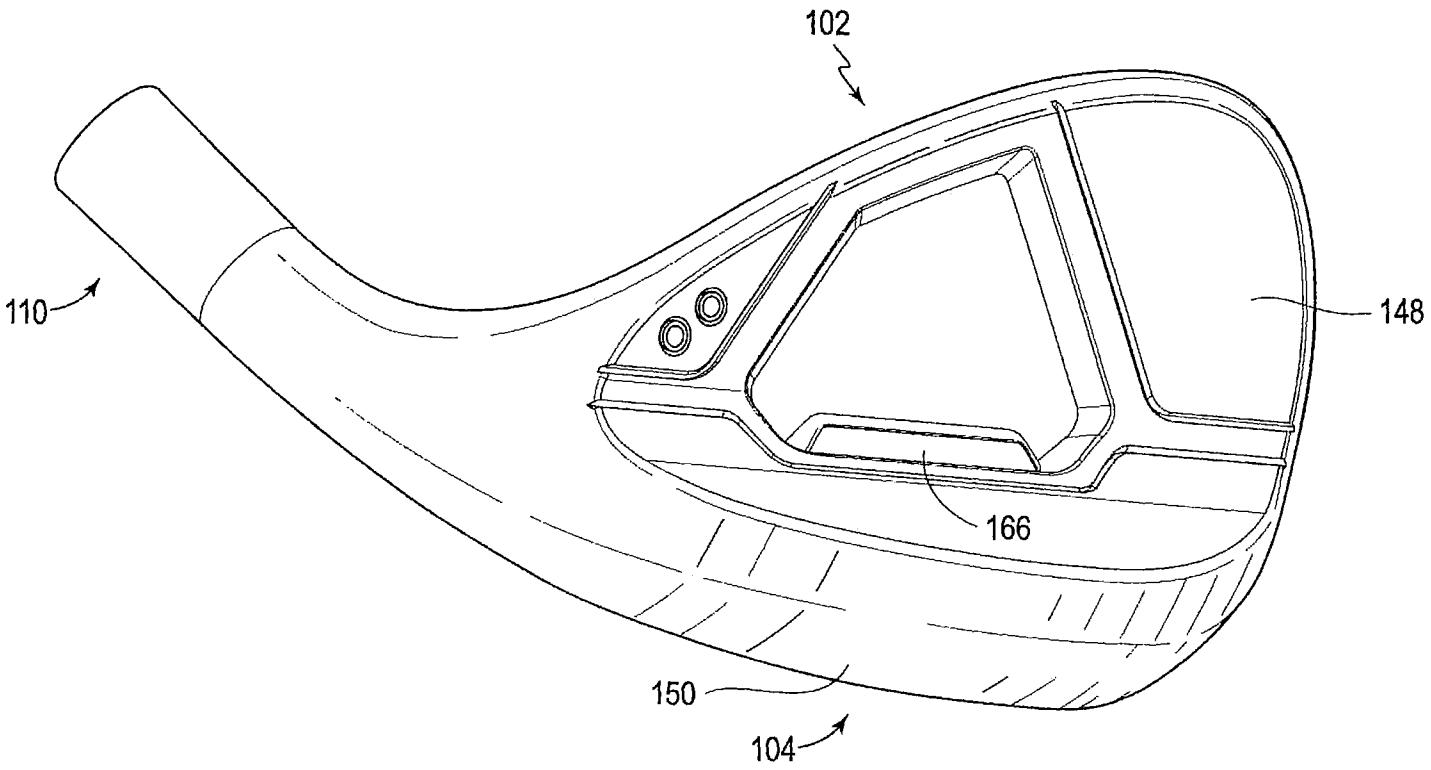
FIG. 9 is a rear heel perspective view of the exemplary golf club head of FIG. 8.

In one or more aspects of the present disclosure, a golf club head 100 is shown in FIGS. 8 and 9. Unless otherwise stated, the golf club head 100 is similar to the golf club head 100 of FIGS. 1-8 and embodies all attributes thereof including mass-related attributes and structural attributes. The golf club head 100 differs in it embodies a differently-contoured rear portion 142.

In particular, the club head 100, includes a rear portion 142 having a blade portion 148 and a muscle portion 150. The rear portion 142 further includes a recessed region located centrally and sandwiched between a raised heel region 170 and toe region 172. The heel region 170 and toe region 172 each preferably have a thickness greater than the centrally-located recessed region 168. Preferably the difference in thickness between either or both of: (a) the heel region 170 and the recessed region 168; and (b) the toe region 172 and the recessed region 168 is no less than 2 mm, and more preferably between 2 mm and 4 mm. By repositioning further weight from the center of the club head 100 to peripheral regions, the moment of inertia Izz about a virtual vertical axis passing through the center of gravity 132 may be increased to a degree. As a result, the club head 100 may provide greater forgiveness on off-centered golf shots, of particularly benefit to golfers with a higher handicap. However, as described above, increasing the forgiveness of the club head, particularly for a wedge-type club head, may deleteriously affect workability, e.g. the ability of the club head to effectively perform a wide array of golf shots and/or achieve a wide array of shot trajectories. Hence, the upper limit of 4 mm for a range of thickness variances between the central recessed portion and the heel region and/or toe region is preferable.

The golf club head 100 of FIG. 8 further comprises a heel truss 174 and a toe truss 176. The heel truss 174 and the toe truss 176 bound the central recessed region 168. The trusses 176 and 178, further, are preferably angled (relative to vertical) such that they converge in the bottom-to-top direction. The trusses 174 and 176 also communicate with an upper stiffening element 178, the upper stiffening element 178 thereby joining the toe truss 176 and the heel truss 174. The upper stiffening element 178 also forms at least a portion of the top line of the club head 100, and this a portion of the upper surface of the top portion 102 of the club head 100. Reveals 180 and 182 preferably form outer bounds of respective trusses 174 and 176. Edges 184 and 186 form inner bounds of respective trusses 174 and 176 and as well as bounds of the recessed region 168. The reveals 180 and 182 preferably constitute grooves having depths preferably no greater then 1 mm. In some embodiments, the reveals 180 and 182 are at least partially filled, e.g. with a paint. The presence of reveals 180 and 182 serve to communicate to the golfer latent attributes of the club head 100, e.g. that the club head 100 bears an increased moment of inertia and therefore increased forgiveness on off-centered shots. Such function may thus aid in club selection during play and/or increase the confidence of the golfer during use.

In some embodiments, referring again to the club head 100 of FIG. 8, the central recessed region 168 includes a sub-recess 188. Preferably, the sub-recess 188 extends toward the sole portion 104. However, in alternative embodiments, the sub-recess 188 may be positioned to extend toward the top portion 102, the heel portion 108, and/or the toe portion 106. Further, preferably, a resilient insert 166 is positioned within the sub-recess 188. In some embodiments, the resilient insert 166 is only partially positioned with the sub-recess 188. In other embodiments, the resilient insert 166 entirely fills the sub-recess 188. In alternatively or additional embodiments, and as shown in FIGS. 8 and 9, the resilient insert 166 extends beyond the bounds of the sub-recess 188 and into the main region of the central recessed region 168.

The resilient insert includes a polymeric material, a natural or synthetic rubber, a polyurethane, a thermoplastic polyurethane (TPU), an open- or closed-cell foam, a gel, a metallic foam, or a resin. In some embodiments, the resilient insert exhibits vibration dampening properties (e.g. visco-elastic properties), thereby controlling vibration-emanation characteristics of the club head, e.g. based on impact with a golf ball.

As described above, a generally laterally center of gravity 132 is desirable in part for reducing shot dispersion. However, such attribute preferably is achieved without deleterious effect on other desirable features of a club head, particularly a wedge-type club head. The club heads 100 of FIGS. 1-9 accomplish this by mass removal from the heel-most region, more particularly the hosel region. In this manner, sole contour, center of gravity height, center of gravity depth from striking face, and various other mass-related and spatial-related attributed remain largely intact. Nonetheless, other alternative embodiments may achieve a similar results regarding mass attributes without deleterious affecting desirable performance attributes of e.g. a wedge-type club head.

Referring to FIGS. 10A-10F, various club head embodiments are shown in accordance with the present disclosure. Unless otherwise stated, the golf club heads 200 in each of FIGS. 10A-10D are similar to the golf club head 100 of FIGS. 1-8 and embody all attributes thereof including mass-related attributes and structural attributes. The golf club heads 200 differs in that they embody differently-contoured rear portions 142. Particularly, in each case, mass is removed from the rear portion 242 proximate a junction between the striking wall portion and the hosel portion of the club head 100.

Figure 10A:
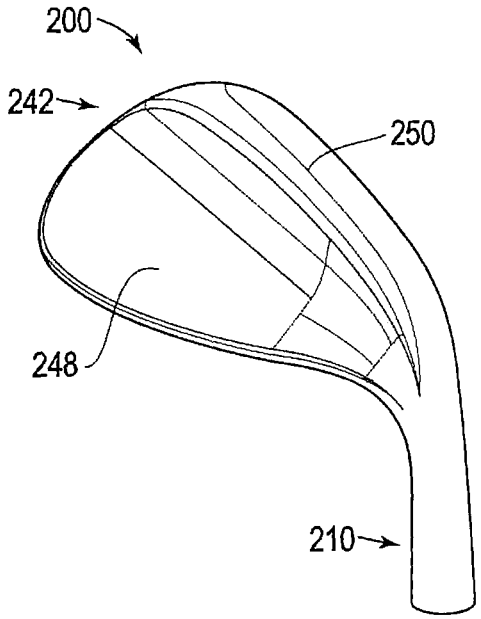
FIG. 10A is a rear perspective view of an exemplary golf club head in accordance with one or more embodiments.

In FIG. 10A, the golf club head 200 include a rear portion 242 having an upper blade portion 248 and a lower muscle portion 250. Notably, as opposed to a sharp junction, the blade portion 248 arcuately transitions to the hosel portion as a result of mass removal. In particular, in the club head embodiment of FIG. 10A, the blade portion 248 smoothly transitions into the hosel portion in a non-angular manner. Accordingly, mass is removed, thereby shifting the center of gravity 232 of the club head 200 toward the center, without adversely affecting other key attributes.

Figure 10B:
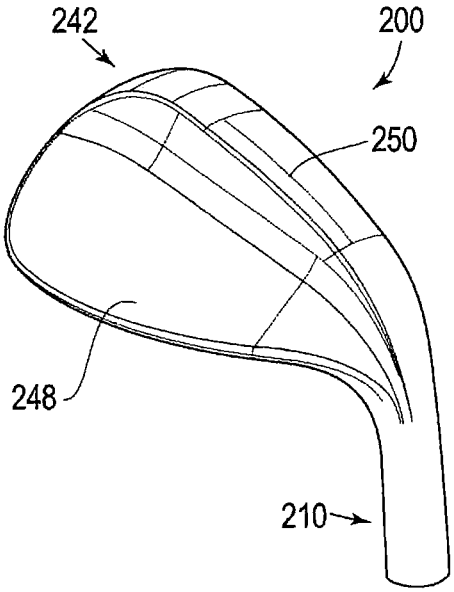
FIG. 10B is a rear perspective view of an exemplary golf club head in accordance with one or more embodiments.

In FIG. 10B, the golf club head 200 include a rear portion 242 having an upper blade portion 248 and a lower muscle portion 250. Notably, as opposed to a sharp junction, the blade portion 248 arcuately transitions to the hosel portion as a result of mass removal. In particular, in the club head embodiment of FIG. 10B, the blade portion 248 arcuately transitions into the hosel portion 210. In this particular embodiment, the blade portion 248 narrows in width as it approaches the hosel region 210, forming an angled vertex 288. Accordingly, mass is removed, thereby shifting the center of gravity 232 of the club head 200 toward the center, without adversely affecting other key attributes.

Figure 10C:
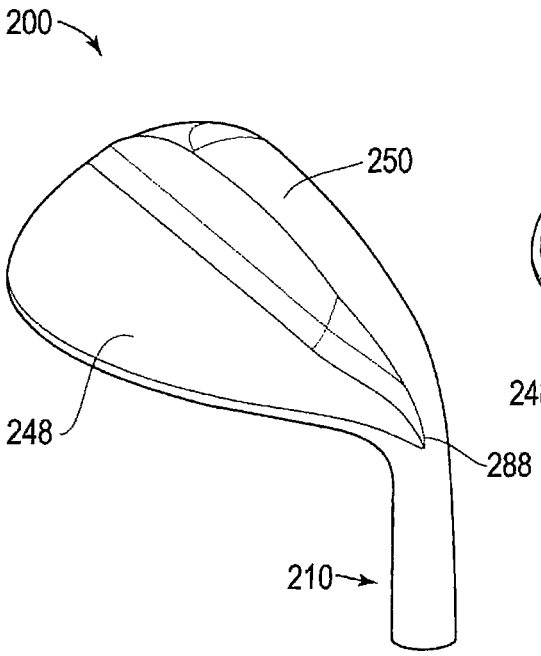
FIG. 10C is a rear perspective view of an exemplary golf club head in accordance with one or more embodiments.

In FIG. 10C, the golf club head 200 include a rear portion 242 having an upper blade portion 248 and a lower muscle portion 250. Notably, as opposed to a sharp junction, the blade portion 248 arcuately transitions to the hosel portion as a result of mass removal. In particular, in the club head embodiment of FIG. 10C, the blade portion 248 arcuately transitions into the hosel portion 210. In this particular embodiment, the blade portion 248 narrows in width as it approaches the hosel region 210, forming an angled vertex 288. The angled vertex 288 of the club head embodiment of FIG. 10C is of a larger angle than the angled vertex 288 of FIG. 10B. Accordingly, mass is removed, thereby shifting the center of gravity 232 of the club head 200 toward the center, without adversely affecting other key attributes.

Figure 10D:
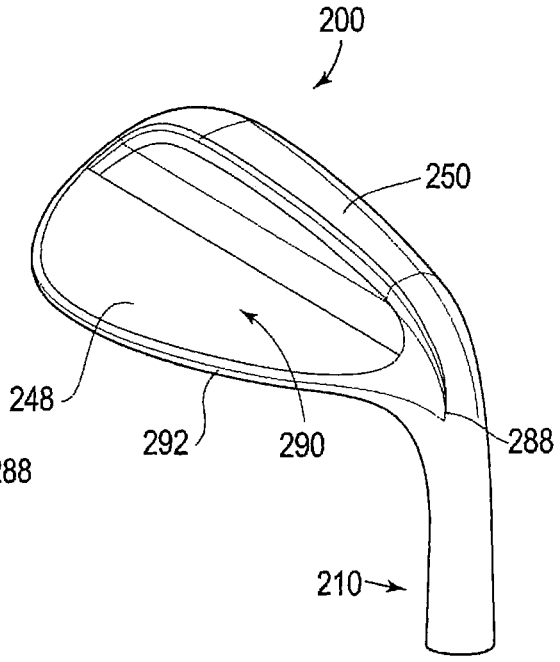
FIG. 10D is a rear perspective view of an exemplary golf club head in accordance with one or more embodiments.

In FIG. 10D, the golf club head 200 include a rear portion 242 having an upper blade portion 248 and a lower muscle portion 250. Notably, as opposed to a sharp junction, the blade portion 248 arcuately transitions to the hosel portion as a result of mass removal. In particular, in the club head embodiment of FIG. 10D, the blade portion 248 comprises a generally planar central region 290 and a beveled peripheral region 292 at least partially surrounding the generally planar central region 290. In this embodiment, the beveled region 292 arcuately transitions into the hosel portion 210. The blade portion 248 narrows in width as it approaches the hosel region 210, forming an angled vertex 288. The angled vertex 288 of the club head embodiment of FIG. 10D is of a larger angle than the angled vertex 288 of FIG. 10B. Accordingly, mass is removed, thereby shifting the center of gravity 232 of the club head 200 toward the center, without adversely affecting other key attributes.

Figure 10E:
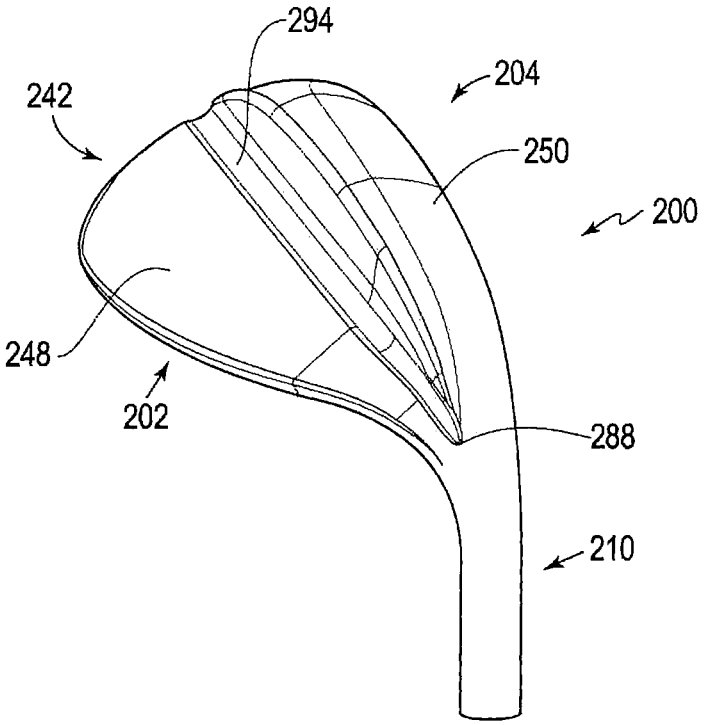
FIG. 10E is a rear perspective view of an exemplary golf club head in accordance with one or more embodiments.

In FIG. 10E, the golf club head 200 include a rear portion 242 having an upper blade portion 248 and a lower muscle portion 250. Notably, as opposed to a sharp junction, the blade portion 248 arcuately transitions to the hosel portion 210 as a result of mass removal. The blade portion 248 narrows in width as it approaches the hosel region 210, forming an angled vertex 288. Additionally, the club head 200 includes a channel 294 that preferably extends generally in a heel-to-toe direction. More preferably, the channel 294 is located at the junction between the upper blade portion 248 and the lower muscle portion 250. The channel 250 preferably includes a depth no less than 1 mm, more preferably between 1 mm and 5 mm. In some embodiments, the channel 294 comprises a uniform thickness. However, in alternative embodiments, the channel varies in thickness, e.g. to selectively remove discretionary mass from undesirable locations. Accordingly, mass is removed, thereby shifting the center of gravity 232 of the club head 200 toward the center, without adversely affecting other key attributes.

Figure 10F:
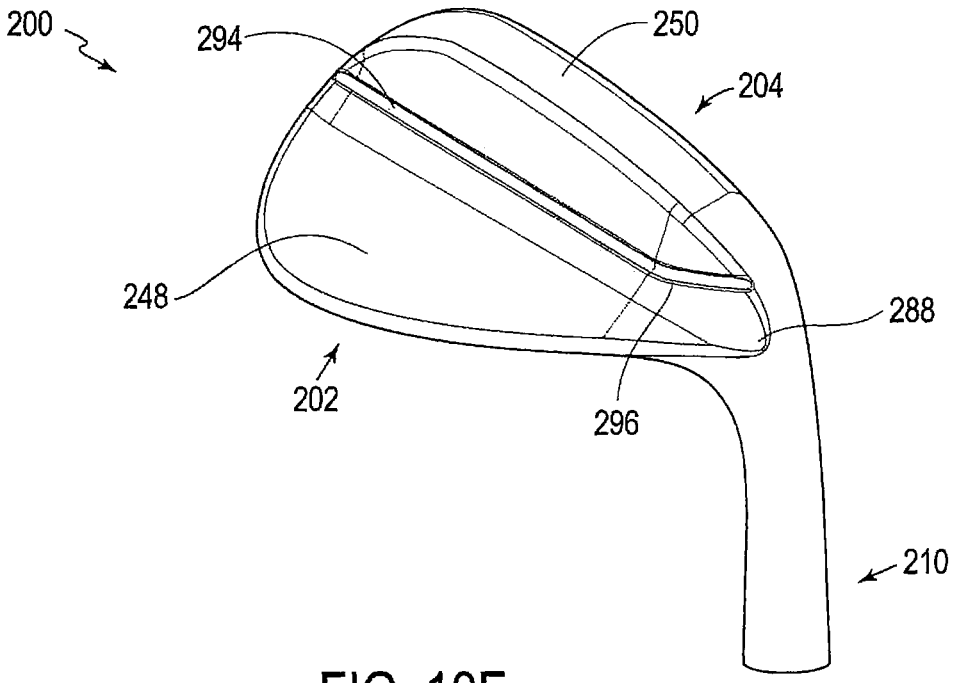
FIG. 10F is a rear perspective view of an exemplary golf club head in accordance with one or more embodiments.

In FIG. 10F, the golf club head 200 include a rear portion 242 having an upper blade portion 248 and a lower muscle portion 250. Notably, as opposed to a sharp junction, the blade portion 248 arcuately transitions to the hosel portion 210 as a result of mass removal. The blade portion 248 narrows in width as it approaches the hosel region 210, forming an angled vertex 288. Additionally, the club head 200 includes a channel 294 that preferably extends generally in a heel-to-toe direction. More preferably, the channel 294 is located at the junction between the upper blade portion 248 and the lower muscle portion 250. The channel 294 preferably includes a depth no less than 1 mm, more preferably between 1 mm and 5 mm. In this particular embodiment, the channel 294 includes a bend 296 thereby extending downward toward the sole portion 204 as it extends heel-ward. Having such bend 296 may further permit controlling the removable of discretionary mass and relocation thereof to more desirable locations. In some embodiments, the channel 294 comprises a uniform thickness. However, in alternative embodiments, the channel 294 varies in thickness, e.g. to selectively remove discretionary mass from undesirable locations. Accordingly, mass is removed, thereby shifting the center of gravity 232 of the club head 200 toward the center, without adversely affecting other key attributes.

Referring to FIGS. 11A-11D, various club head embodiments are shown in accordance with the present disclosure. Unless otherwise stated, the golf club heads 300 in each of FIGS. 10A-10D are similar to the golf club head 100 of FIGS. 1-8 and embody all attributes thereof including mass-related attributes and structural attributes. The golf club heads 300 differs in that they embody differently-contoured rear portions 342. Particularly, in each case, mass is redistributed from a heel-ward location to a toe-ward location for purposes of effecting the mass-related properties described with regard to the embodiment of FIGS. 1-8. As described above, in each of these cases, mass relocation occurs in a manner that minimizes adverse effects on overall performance, e.g. effecting effective bounce considerations and/or location-based aspects of the center of gravity other than lateral spacing from a face center.

Figure 11A:
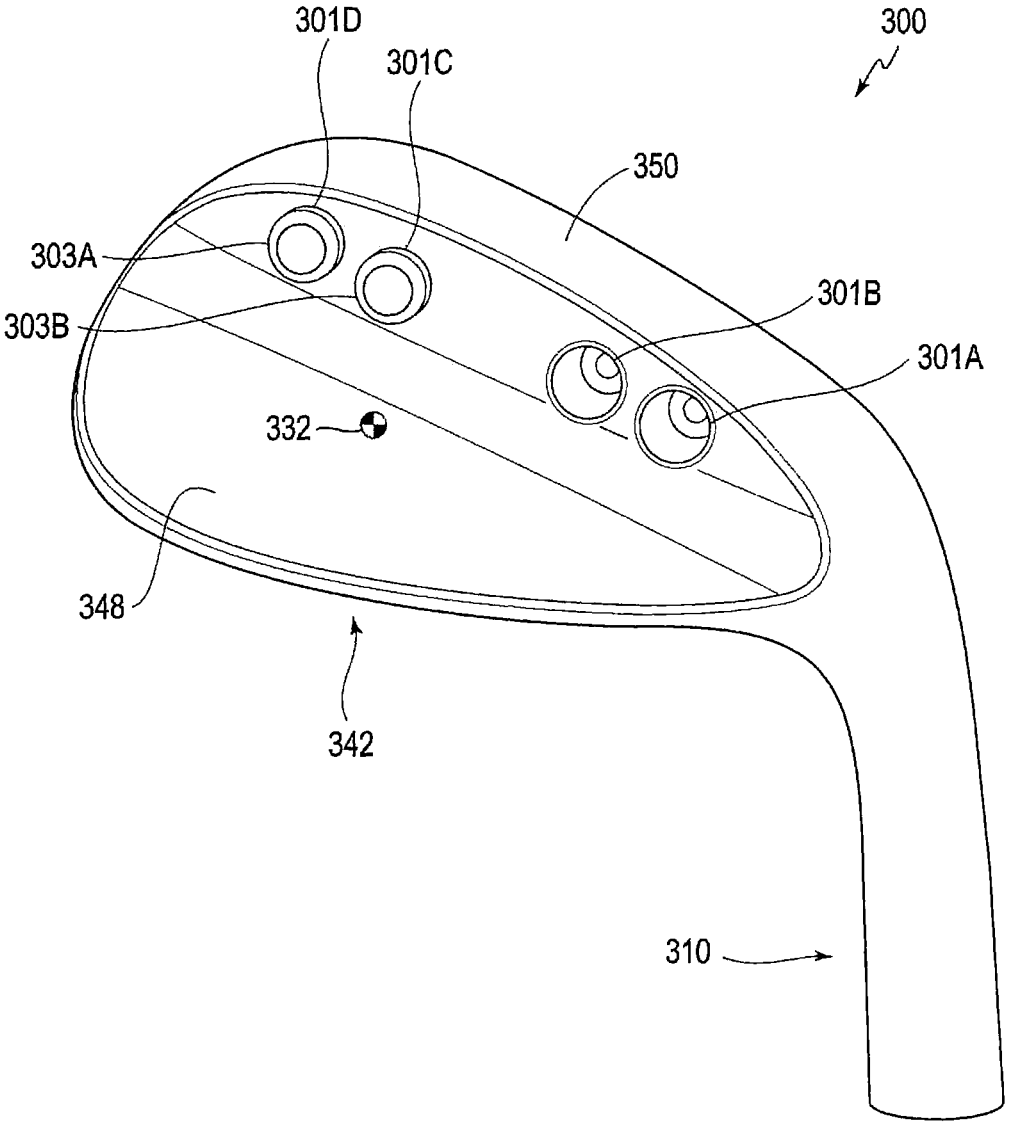
FIG. 11A is a rear perspective view of an exemplary golf club head in accordance with one or more embodiments.

In FIG. 11A, the golf club head 300 include a rear portion 342 having an upper blade portion 348 and a lower muscle portion 350. A plurality of circular recesses 301(*a*)-301(*d*) are formed in the rear portion 142 (extending inward from the rear surface thereof), particularly within the muscle portion 350 of the rear surface. Circular recesses 301(*a*)-301(*d*) preferably constitute weight ports adapted to receive, and secure, weight elements therewithin, e.g. weight elements 303(*a*)-303(*b*). Preferably, the recesses 301(*a*)-301(*d*) are aligned in a heel-to-toe direction. In some embodiments, the weight elements 303(*a*)-303(*b*) are removably associable with the weight ports 301(*a*)-301(*d*). However, in other embodiments, one or more weight elements are permanently secured within the weight ports 301(*a*)-301(*d*), e.g. with an adhesive material. In such embodiments in which the weight elements are removable, preferably the weight elements are also interchangeable between the various weight ports 301(*a*)-301(*d*) to enable to use to customize mass-related attributes of the club head 300 to meet the golfer's particular needs or desires. For example, in such embodiments, the weight elements 303(*a*)-303(*b*) may comprise threaded external shafts (not shown) adapted to mate with complementary threaded regions corresponding with each of the weight ports 301(*a*)-301(*d*).

Preferably, the weight ports 301(*a*)-301(*d*) and weight elements 303(*a*)-303(*b*) system is configured to provide the capability of shifting the club head center of gravity 332 toward the face center, laterally, in the manners described with regard to FIGS. 1-8. In some embodiments, and in some configurations thereof, this capability may be met by providing for states (an exemplary state thereof shown) in which some weight elements 303(*a*)-303(*b*) are located in toe-ward weight ports 301(*c*) and 301(*d*), while heel-ward weight ports 301(*a*) and 301(*b*) are absent weight elements.

Alternatively, or additionally, such weight-shifting capability may be met by proving a set of weight elements having differing weight values, by virtue of either spatial attribute and/or by density. E.g., the weight ports 301(*a*)-301(*d*) and weight elements system may provide for a state in which one or more high-density weight elements are positioned in toe-proximate weight ports, while lower-density weight elements are place in heel-proximate weight ports. Preferably, at least one weight element of the set of weight elements 303 exhibits a density no less than 7 g/cm$^3$, more preferably no less than 9 g/cm$^3$. Preferably, in such embodiments, density is increased by the provision of tungsten. Specifically, such weight elements have a composition including tungsten in an amount at least 20% by weight, more preferably at least 40% by weight.

Additionally, or alternatively, in such set, at least one other weight element exhibits a density no greater than 7 g/cm3, and more preferably no greater than 4 gh/cm3. Additionally, or alternatively, at least a first weight element of the set of weight elements 303 comprises a weight no less than 7 g, and optionally a second weight element of the set of weight elements comprises a weight no greater than 4 g. Accordingly, mass is removed, thereby shifting the center of gravity 332 of the club head 300 toward the center, without adversely affecting other key attributes.

Figure 11B:
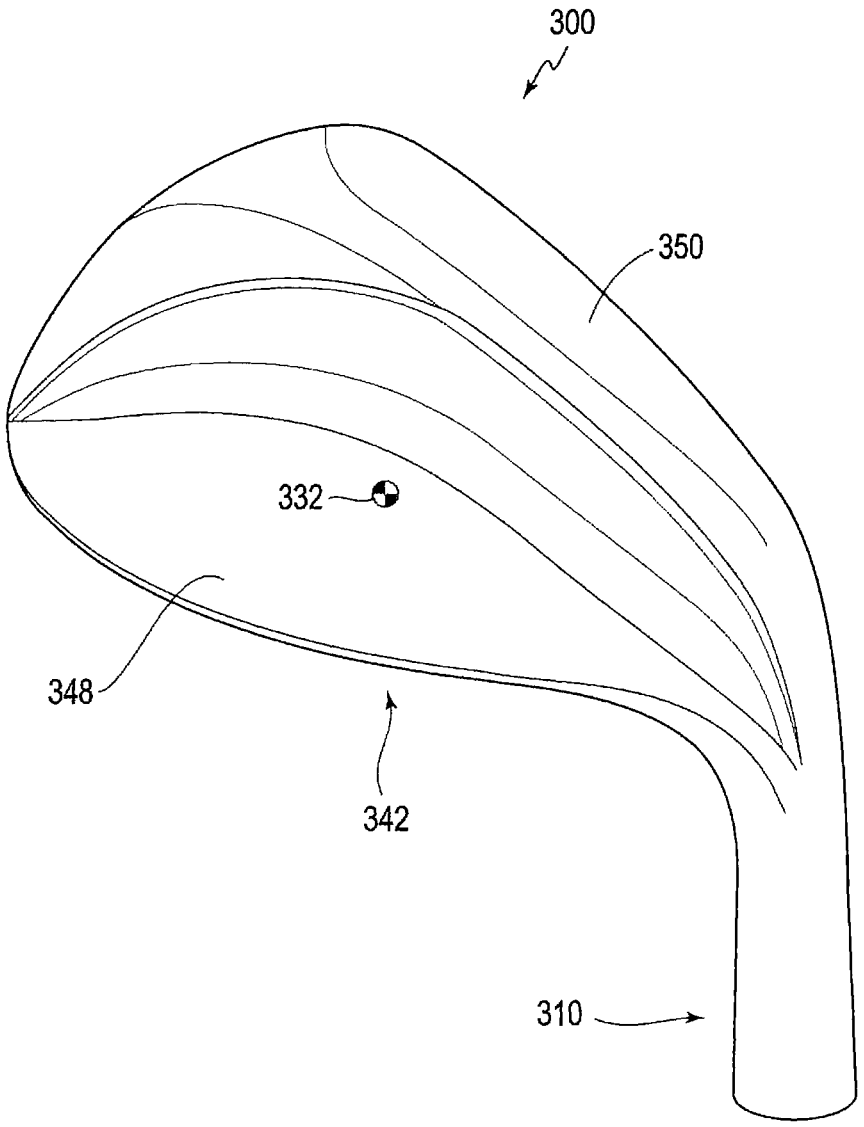
FIG. 11B is a rear perspective view of an exemplary golf club head in accordance with one or more embodiments.

In FIG. 11B, the golf club head 300 include a rear portion 342 having an upper blade portion 348 and a lower muscle portion 350. Notably, as opposed to a sharp junction, the blade portion 348 arcuately transitions to the hosel portion 310 as a result of mass removal. In particular, in the club head embodiment of FIG. 11B, the blade portion 248 smoothly transitions into the hosel portion 310 in a non-angular manner. Accordingly, mass is removed, thereby shifting the center of gravity 232 of the club head 200 toward the center, without adversely affecting other key attributes. In addition, the muscle portion flares in the toe-ward direction, resulting in a toe flare 305.

Figure 11C:
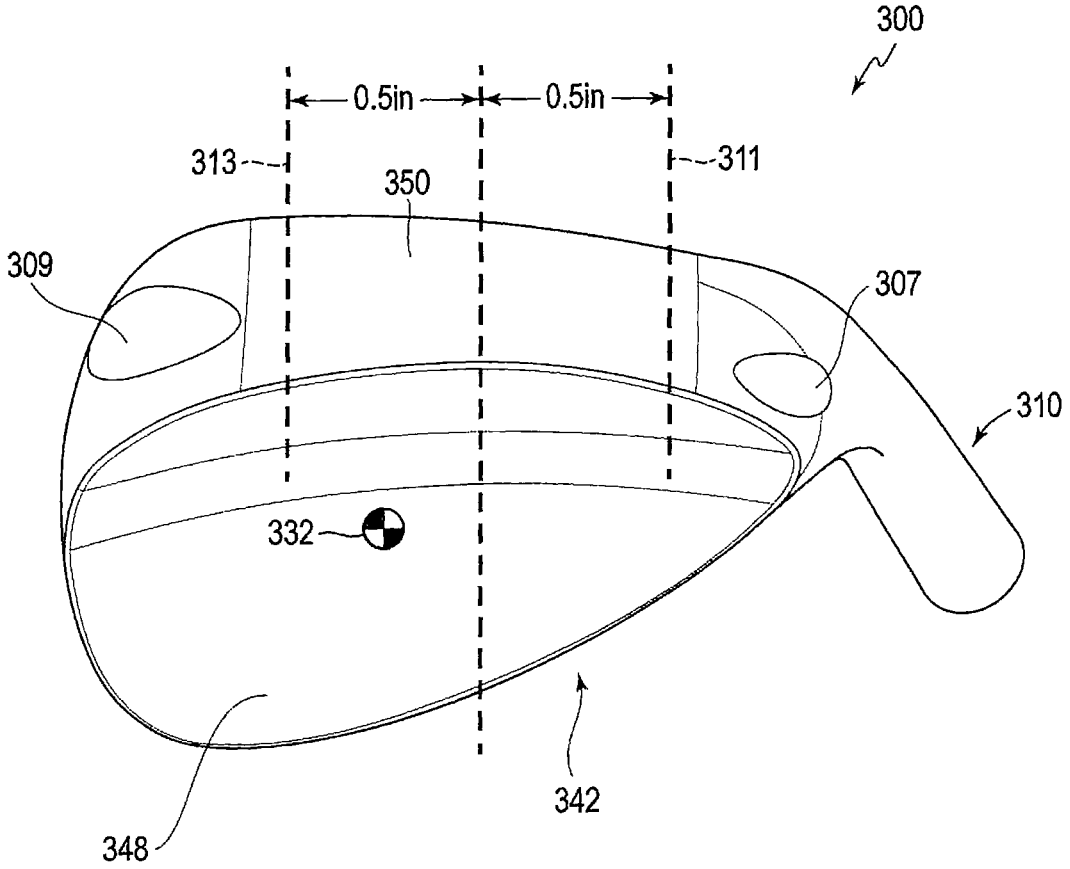
FIG. 11C is a rear perspective view of an exemplary golf club head in accordance with one or more embodiments.

In FIG. 11C, a golf club head 300 is shown including a rear portion 342 that has a blade portion 348 and a muscle portion 350 proximate the sole portion 104. The sole portion 104, in this particular embodiment, comprises a heel-side cavity 307 and a toe-side cavity 309. Preferably these cavities 307 and 309 are located, laterally, outside of a portion of the bottom surface of the sole portion 304 generally intended to interact with the turf. For example, the cavities 307 and 309 are preferably entirely located outside of a zone delimited by lateral boundaries 311 and 313 place 0.5 in from a virtual vertical plane perpendicular to the striking face and passing through the face center. These cavities 307 and 309 enable both controlled mass removal from areas in which may be removed without detriment to club head 300 aspects contributive of effective performance. These cavities 307 and 309 also enable the re-distribution of mass removed therefrom to other locations of the club head 300 to further control the location of the center of gravity 332 of the club head 300, e.g. in any of the manners described above with regard to the club head embodiment shown in FIGS. 1-8.

Preferably, the toe-side cavity 309 is dimensioned to be larger than the heel-side cavity 307. For example, the toe-side cavity 309 preferably has a depth greater than the depth of the heel-side cavity 307. Additionally, or alternatively, the toe-side cavity 309 preferably comprises a characteristic length (i.e. the maximum distance between any two points along the periphery of the cavity) greater than the characteristic length of the heel-side cavity 307. Additionally, or alternatively, the toe-side cavity 309 preferably comprises a displaced volume greater than a displaced volume of the heel-side cavity 307. These dimension enable shifting the center of gravity 332 of the club head 300, laterally toward the face center, e.g. to counteract mass occupied by the hosel 310. Accordingly, mass is removed, thereby shifting the center of gravity 332 of the club head 300 toward the center, without adversely affecting other key attributes.

Figure 11D:
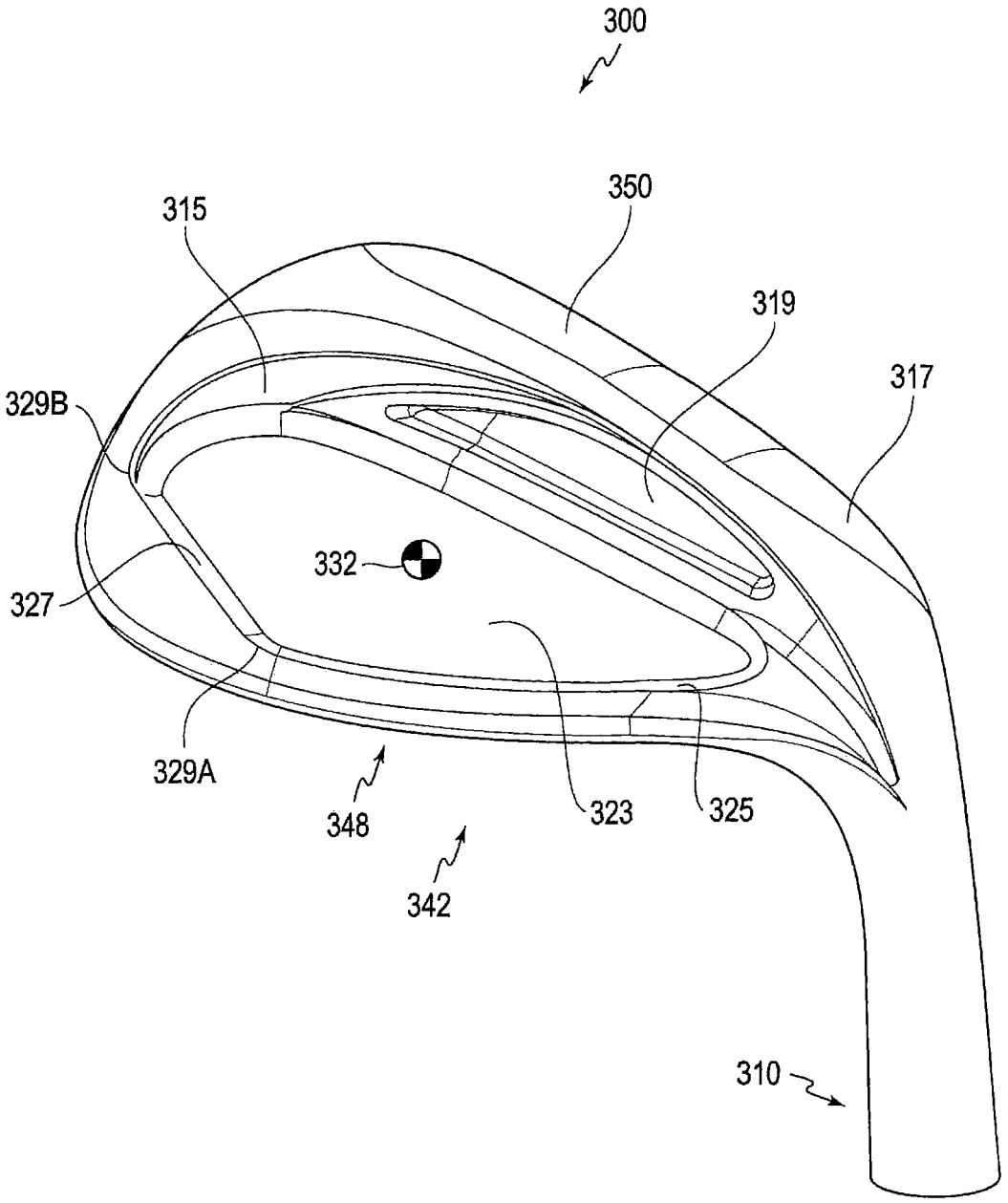
FIG. 11D is a rear perspective view of an exemplary golf club head in accordance with one or more embodiments.

In FIG. 11D, a golf club head 300 is shown having a rear portion 342 that includes a blade portion 348 and a muscle portion 350. In this particularly embodiment, again, mass is removed from a central, relatively sole-ward location to a relative toe-ward and upward location. Specifically, the sole portion 304 includes an upper sole surface 315 and a lower sole surface 317 configured to interact with turf during use. The upper sole surface 315 comprises a generally sole-ward extending recess 319. The recess 319 is generally centrally located in the heel-to-toe direction. E.g. a location half-way between the toe-most extent and the heel-most extent of the recess 319 is laterally spaced from the face center by a distance no greater than 10 mm, and more preferably no greater than 5 mm. This recess 319 permits mass removal in a manner that minimizes any adverse effect on attributes indicative of performance and feel. In some embodiments, the recess 319 is at least partially (in and some cases entirely) filled with an aft-attached insert or a filler material (which may be poured and formed in the recess 319). However, in other embodiments, the recess 319 remains partially or fully devoid of material, optionally open to the exterior of the club head 300. In some embodiments, a cap is position in the recess 319 in such manner as to be flush with club head surface portions adjacent to the recess 319.

In conjunction with the recess 319, mass is also preferably relocated to a toe-ward (and preferably upper) region of the club head 300. For example, as shown in FIG. 11D, the blade portion 148 of the club head 300 includes a perimeter weighting element 321 delimiting a shallow upper recess 323. The shallow upper recess 323 defines a periphery 325 having a chamfered upper toe-ward periphery portion 327. Particularly the chamfered periphery portion 327 is preferably entirely located in an upper and toe-ward quadrant of the club head 300 (as defined by a first virtual vertical plane passing through the face center perpendicularly to the striking face and a second virtual vertical plane parallel to the ground plane and passing though the face center). Additionally, the chamfered periphery portion 327 includes a first angled junction or corner 329(*a*) and a second angled junction or corner 329(*b*), delimiting the chamfered junction 327 from adjacent portions of the periphery 325 of the upper recess 323. Preferably, in some embodiments, the chamfered periphery portion 327 comprises a straight or linear edge. However, other edge types are contemplated, e.g. arcuate or jagged.

The presence of the chamfered junction 327 enables the relocation of mass to the upper and toe-ward region of the club head 300, assisting to achieve the desired mass properties described above with regard to the club head embodiment illustrated in FIGS. 1-8. Further, the chamfered junction 327 permits such relocation in a manner that does not adversely affect performance and disturb the confidence of the player during use. For example, in this particularly embodiment, mass may be added to the upper region without a thickening to the topline or undue perimeter weighting, both of which may otherwise adversely affect feel and performance of the club head 300, in specific by limiting workability.

Figure 12:
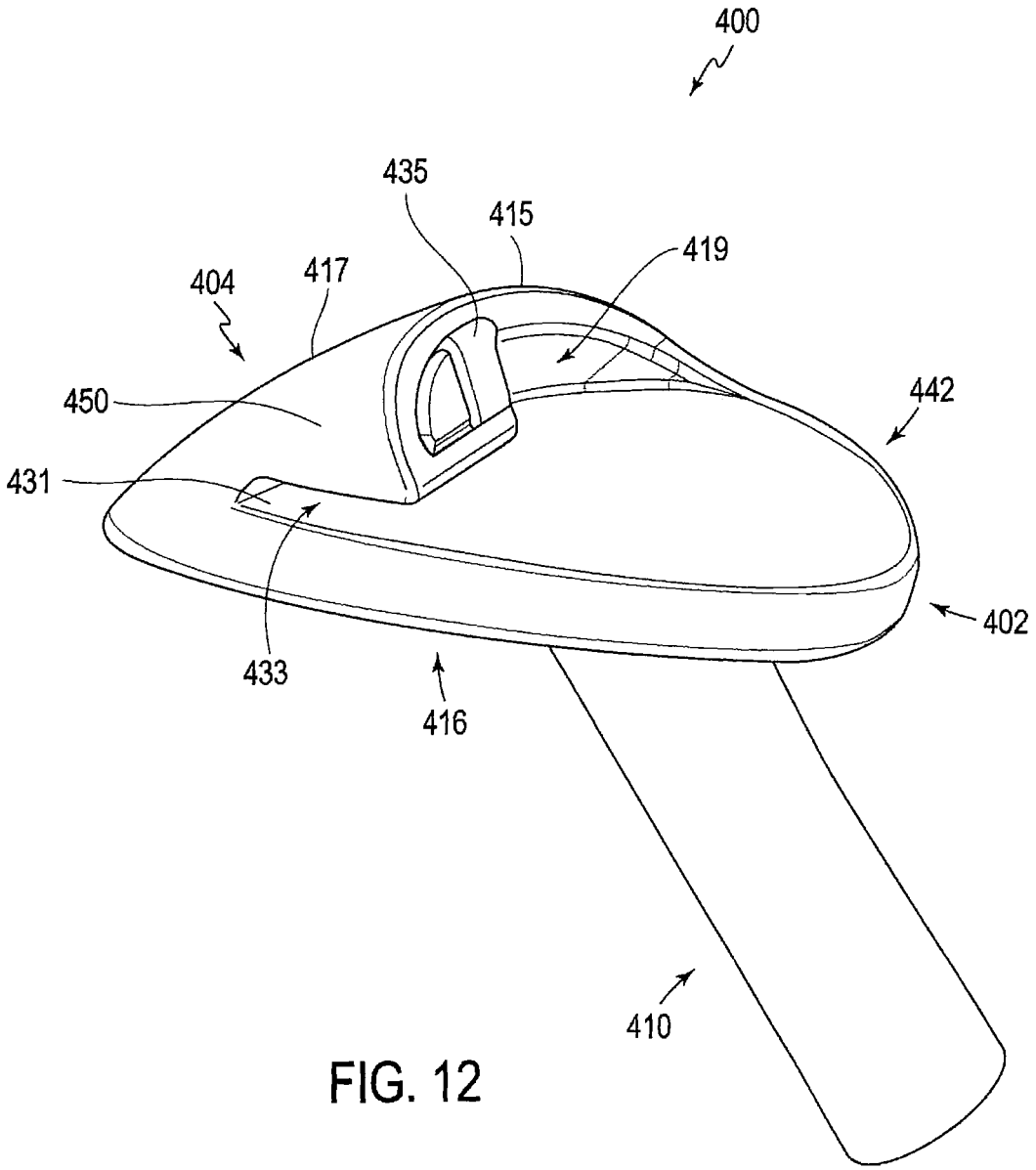
FIG. 12 is a toe-side perspective view of an exemplary golf club head in accordance with one or more embodiments.

Referring to FIG. 12, a club head 400 is shown in accordance with one or more embodiments of the present disclosure. Unless otherwise stated, the golf club head 400 is similar to the golf club head 100 of FIGS. 1-8 and embody all attributes thereof including mass-related attributes and structural attributes. The golf club heads 400 differs in that it embodies a differently-contoured rear portion 442. Particularly, mass is redistributed from a heel-ward location to a toe-ward location for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Specifically, the golf club head 400 includes a blade portion 448 and a muscle portion 450. The muscle portion 450 is located proximate the sole portion 404, which includes a sole upper surface 415 and a sole lower surface 417. The upper surface of the sole 415 includes a sole-ward extending recess 419. The recess 419, in some embodiments, is enclosed at both a recess toe end and a recess heel end. However, in other embodiments (as shown), the recess 419 is open at e.g. the toe end 431 by virtue of a notch 433.

Further, in some embodiments, a secondary recess 437 extends sole-ward from the upper surface 415 of the sole portion 404. The secondary recess 437 optionally contains, housed within it, an aft-attached insert 435. However, in alternative embodiments, a filler material is poured into the secondary recess 437 and cured in place.

Preferably, the insert 435 exhibits a density no less than 7 g/cm$^3$, more preferably no less than 9 g/cm$^3$. Preferably, in such embodiments, density is increased by the provision of tungsten. Specifically, the insert 435 has a composition including tungsten in an amount at least 20% by weight, more preferably at least 40% by weight. In some cases, the insert 435 may comprise a steel-, tungsten-, or other metal-alloy. In other embodiments, the insert may compromise a tungsten-impregnated polymeric material.

Figure 13A:
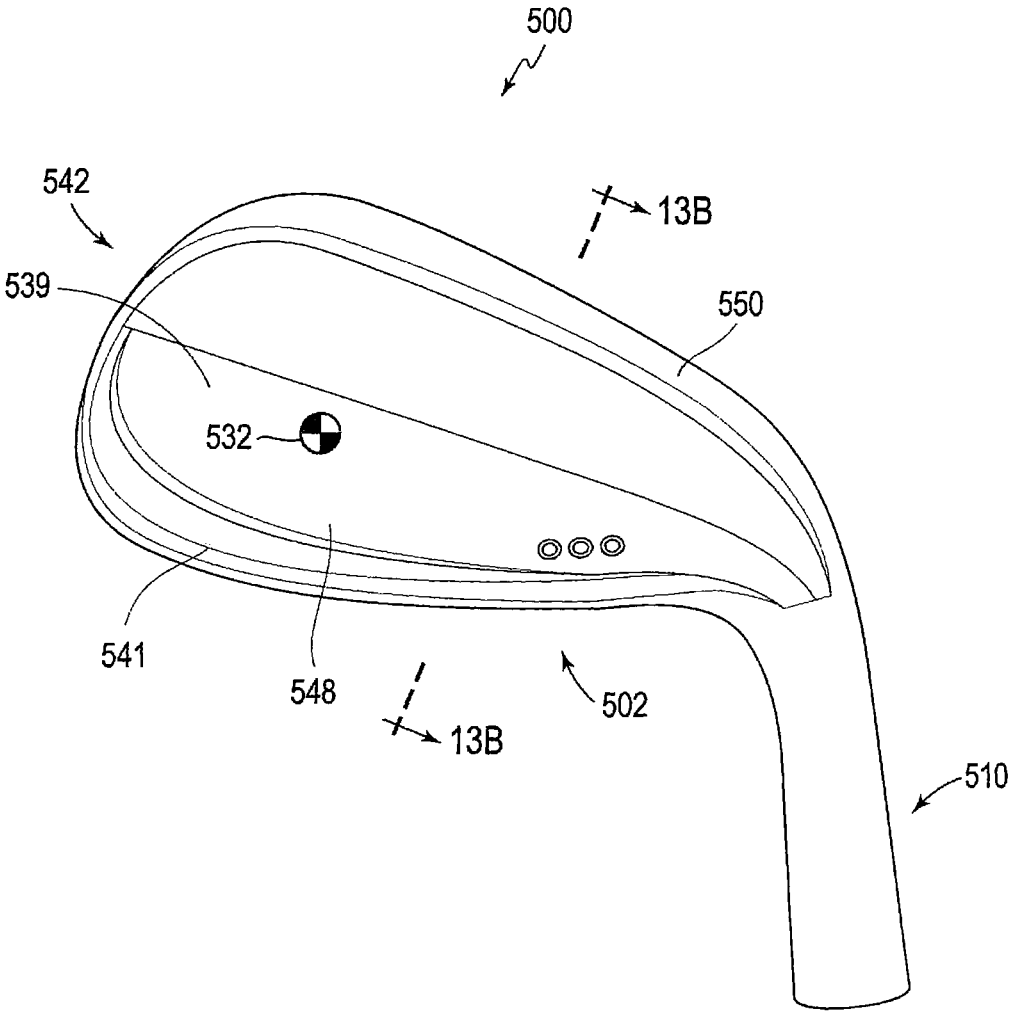
FIG. 13A is a rear perspective view of an exemplary golf club head in accordance with one or more embodiments.
Figure 13B:
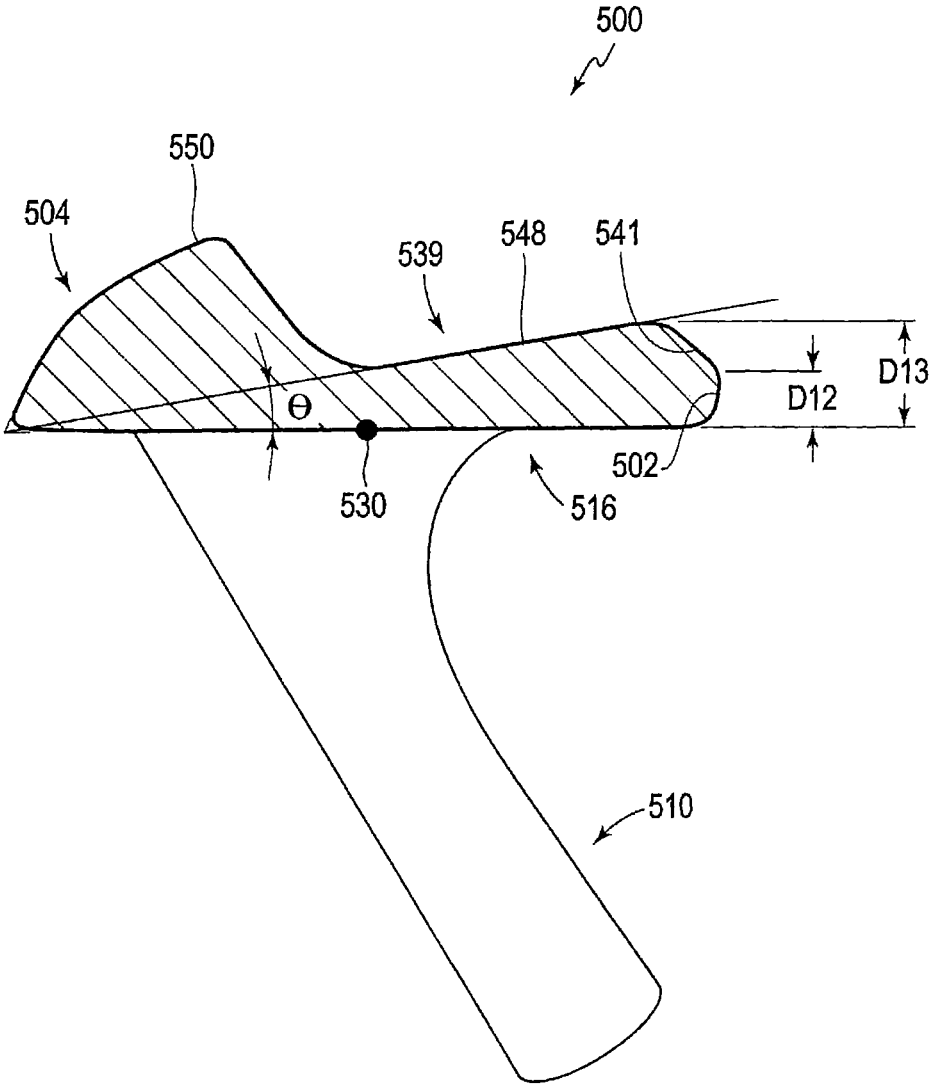
FIG. 13B is a cross-sectional view of the golf club head of FIG. 13A through cross-sectional plane 13B.

Referring to FIGS. 13A-13B, a club head 500 is shown in accordance with one or more embodiments of the present disclosure. Unless otherwise stated, the golf club head 500 is similar to the golf club head 100 of FIGS. 1-8 and embodies all attributes thereof including mass-related attributes and structural attributes. The golf club head 500 differs in that it embodies a differently-contoured rear portion 542. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Specifically, the club head 500 comprises a rear portion 542 including a lower muscle portion 550 and an upper blade portion 548. The blade portion 548 preferably comprises a generally planar rear surface 539 which opposes a striking face (not shown) adapted for impacting a golf ball. The blade portion 548 preferably varies in thickness. Preferably the blade portion 548 varies generally gradually in thickness such that the thickness increases upwardly, preferably substantially from a first location at the junction between the blade portion 548 and the muscle portion 550 to the uppermost extent of the rear surface 539 of the blade portion 539 of the rear portion 542. Additionally, or alternatively, the thickness of the blade portion 548 tapers heel-wardly.

Structuring the blade portion 548 to exhibit such variations in thickness provides a means for controlling the location of the center of gravity 532 to be relatively central, laterally, as described above with regard to the embodiments of the present disclosure shown in FIGS. 1-8. To reduce the effect of such structure on the top line thickness, a beveled surface 541 is preferably located between the top portion 502 and the rear surface 539, thereby permitting the above described mass relocation in a manner that retains traditional top line thickness.

Referring to FIG. 13B, the club head 500 is shown in cross-section 13B. The cross-section 13B corresponds to a virtual vertical plane perpendicular to the striking face 516 and passing through the face center 530. In at least this cross-section, preferably, the topline thickness D12, measured perpendicular to the striking face 516, is no greater than 7 mm, more preferably not greater than 6 mm and even more preferably between 5 mm and 6 mm. The distance D13, measured at the junction between the beveled surface 541 and the rear surface 539 of the blade portion 548, is preferably greater than D12 by at least 1 mm and, more preferably, by at least 2 mm. Additionally, or alternatively, the distance D13 is preferably no less than 6 mm, more preferably no less than 7 mm, and most preferably between 7 mm and 11 mm. These parameters enable desired lateral shifting of the center of gravity 532 as described above without adversely affecting the traditional appearance, feel, performance, and/or playability of the club head 500.

Additionally, or alternatively, referring again to FIG. 13B, the rear surface 539, when viewed in the vertical cross-section 13B, forms an angle θ relative the striking face 516 that is no less than 0.5°, more preferably no less than 1.0°, and most preferably between 1° and 4°. These parameters enable desired lateral shifting of the center of gravity 532 as described above without adversely affecting the traditional appearance, feel, performance, and/or playability of the club head 500.

The beveled surface 541 preferable forms a generally crescent shape where a location of maximum width generally coincides with the upper toe-most corner of the club head 500. The upper toe-most corner, as used herein, refers to the point along the periphery of the club head 500, located above and toe-ward of the face center 530, that is spaced a maximum radial distance from a virtual axis perpendicular to the striking face 516 and passing through the face center 530). The width of the beveled region 541 preferably tapers in the toe-to-heel direction from such corner, and in the top-to-bottom direction from such corner, in both cases along the periphery of the rear surface 539.

Figure 14A:
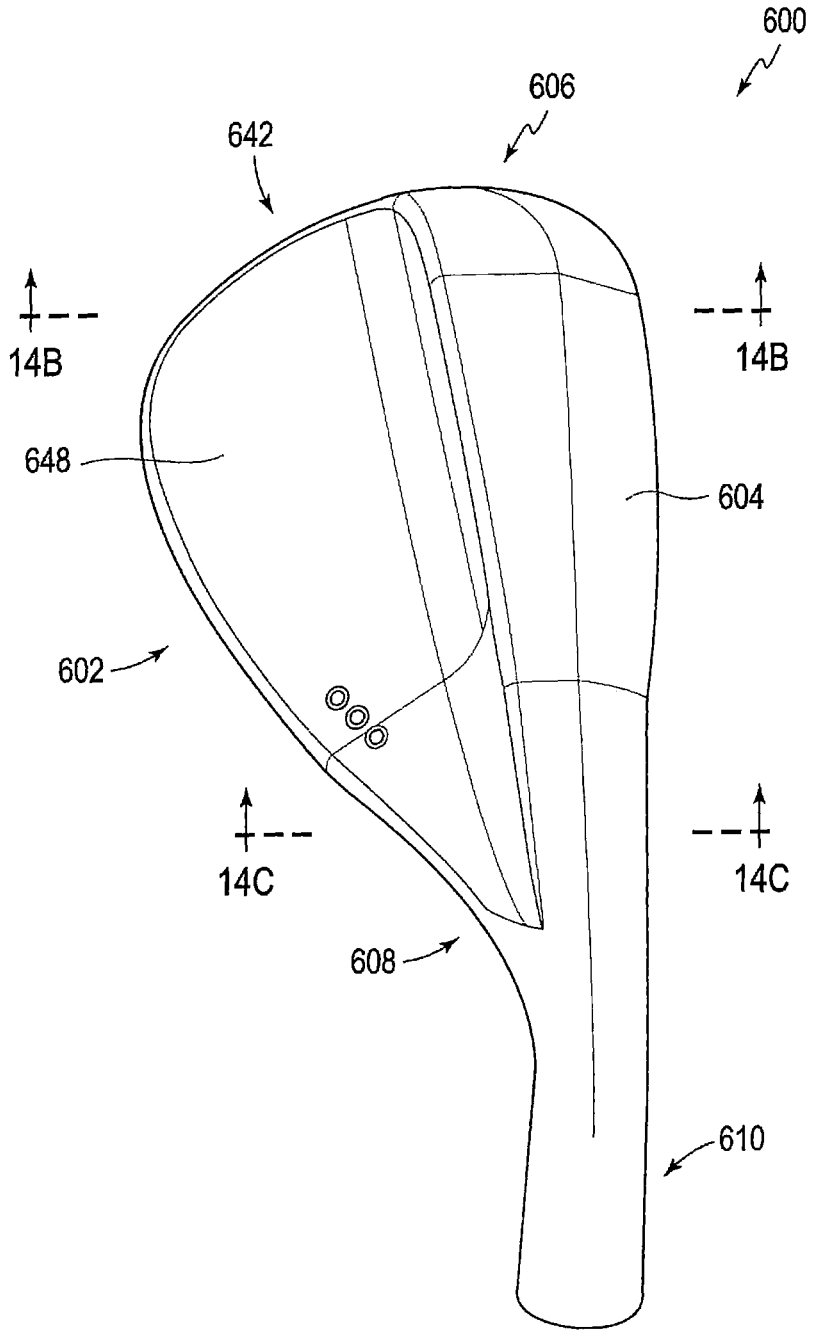
FIG. 14A is a bottom plan view of an exemplary golf club head in accordance with one or more embodiments.
Figure 14B:
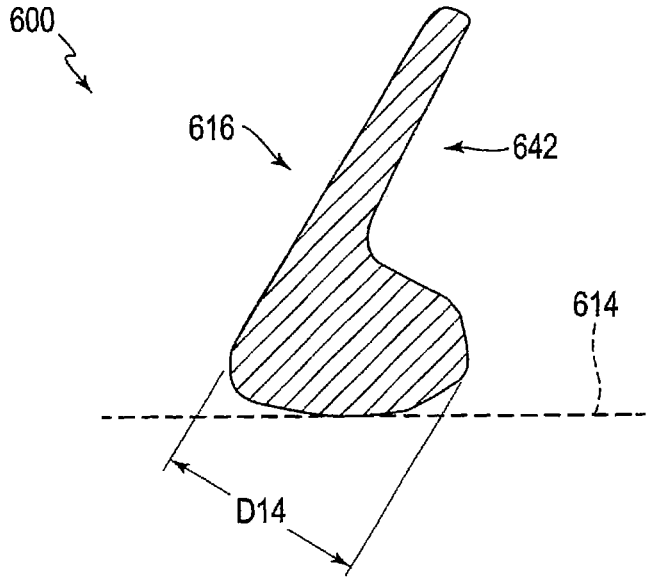
FIG. 14B is a cross-sectional view of the golf club head of FIG. 14A through cross-sectional plane 14B.
Figure 14C:
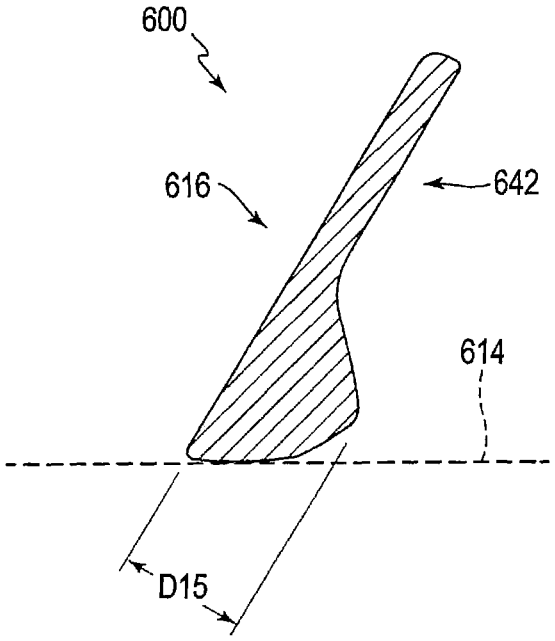
FIG. 14C is a cross-sectional view of the golf club head of FIG. 14A through cross-sectional plane 14C.

Referring to FIGS. 14A-C, a club head 600 is shown in accordance with one or more embodiments of the present disclosure. Unless otherwise stated, the golf club head 600 is similar to the golf club head 100 of FIGS. 1-8 and embodies all attributes thereof including mass-related attributes and structural attributes. The golf club head 600 differs in that it embodies a differently-contoured sole portion 604. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Referring to FIGS. 14A-C, the golf club head 600 comprises a sole portion 604 that generally tapers in thickness in the toe-to-heel direction. As shown, a virtual vertical central plane 628 is perpendicular to the striking face 616 and passes through a face center (not shown) of the striking face 616. Preferably, the sole portion 604 includes a maximum thickness D14 (measured from and in a direction perpendicular to the striking face 616) that is located toe-ward of the plane 628. More preferably, the location on the sole portion 604 associated with maximum sole thickness D14 is spaced from the central vertical plane 628 by a distance no less than 0.5*D7.

Additionally, or alternatively, the sole portion 604 of the club head 600 includes a minimum sole thickness D15 and a corresponding location on the sole associated with minimum sole thickness D15. Preferably, this location is located heel-ward of the virtual vertical plane 628. More preferably, this location is located heel-ward of the virtual plane by a distance no less than 0.5*D7.

Additionally, or alternatively, the difference between the maximum sole thickness D14 and the minimum sole thickness D15 is no less than 5.5 mm, more preferably no less than 6 mm, and most preferably no less than 7 mm. As described above, in each of these cases, mass relocation occurs in a manner that minimizes adverse effects on overall performance, e.g. effecting effective bounce, location-based aspects of the center of gravity other than lateral spacing from a face center, and/or workability.

Figure 15A:
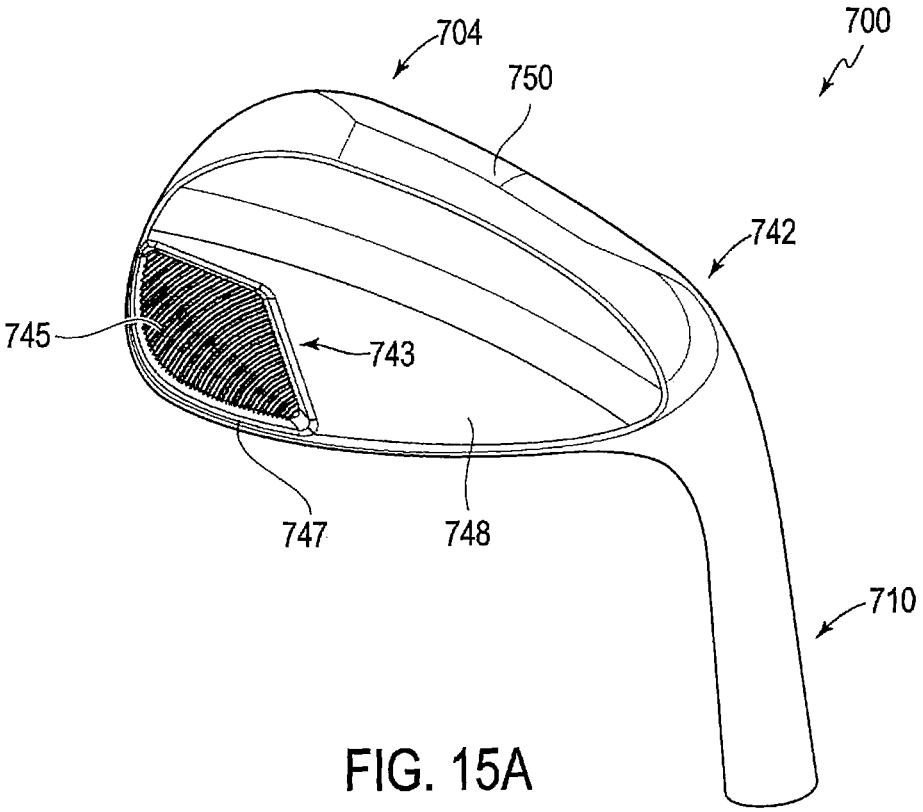
FIG. 15A is a rear perspective view of an exemplary golf club head in accordance with one or more embodiments.
Figure 15B:
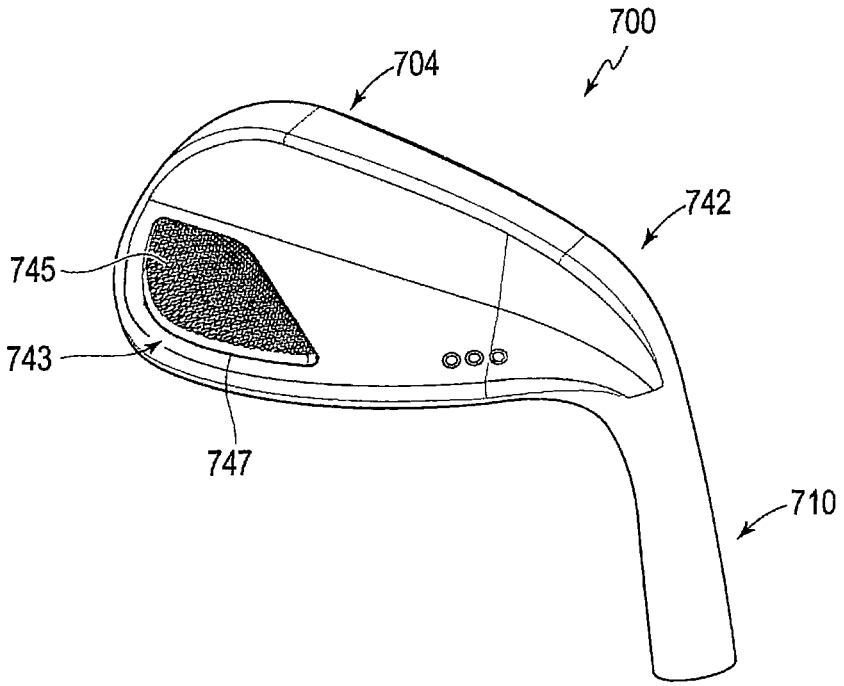
FIG. 15B is a rear perspective view of an exemplary golf club head in accordance with one or more embodiments.

Referring to FIGS. 15A-B, alternative club heads 700 are shown in accordance with one or more embodiments of the present disclosure. Unless otherwise stated, the golf club head 700 is similar to the golf club head 100 of FIGS. 1-8 and embodies all attributes thereof including mass-related attributes and structural attributes. The golf club head 700 differs in that it embodies a differently-contoured rear portion 742. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Specifically, the rear portion 742 includes an upper blade portion 748 and a lower muscle portion 750. The blade portion 748 comprises a portion of generally uniform thickness and includes a rear surface 739 that is generally planar. Preferably, a mass element 743 is position in the upper, toe region of the rear surface 739. In some embodiments, the mass element 739 is cast-in and may constitute a generally raised region of generally uniform thickness. Alternatively, or additionally, the raised region 743 may include a textured rear surface 745, e.g. containing a surface-milled pattern.

In alternative embodiments, the mass element 743 may constitute an aft-attached weighted insert or medallion (see FIG. 15B). Preferably, in such embodiments, the insert 743 comprises a density greater than the main body of the club head. Preferably, the insert 743 exhibits a density no less than 7 g/cm$^3$, more preferably no less than 9 g/cm$^3$. Preferably, in such embodiments, density is increased by the provision of tungsten. Specifically, the insert 743 has a composition including tungsten in an amount at least 20% by weight, more preferably at least 40% by weight. In some cases, the insert 743 may comprise a steel-, tungsten-, or other metal-alloy. In other embodiments, the insert may compromise a tungsten-impregnated polymeric material.

The insert 743 may be attached by mechanical means, e.g. a threaded fastener or interference fit, or by chemical adhesive, e.g. double-sided tape optionally comprising a visco-elastic material sandwiched between two layers of adhesive tape. In some embodiments, the mass element 743 is spaced from the periphery of the blade portion 748. In other embodiments, a side edge 747 of the mass element 743 is substantially flush with the periphery of the blade portion 748 of the club head 700. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g.

effecting effective bounce, location-based aspects of the center of gravity other than lateral spacing from a face center, and/or workability.

Figure 16A:
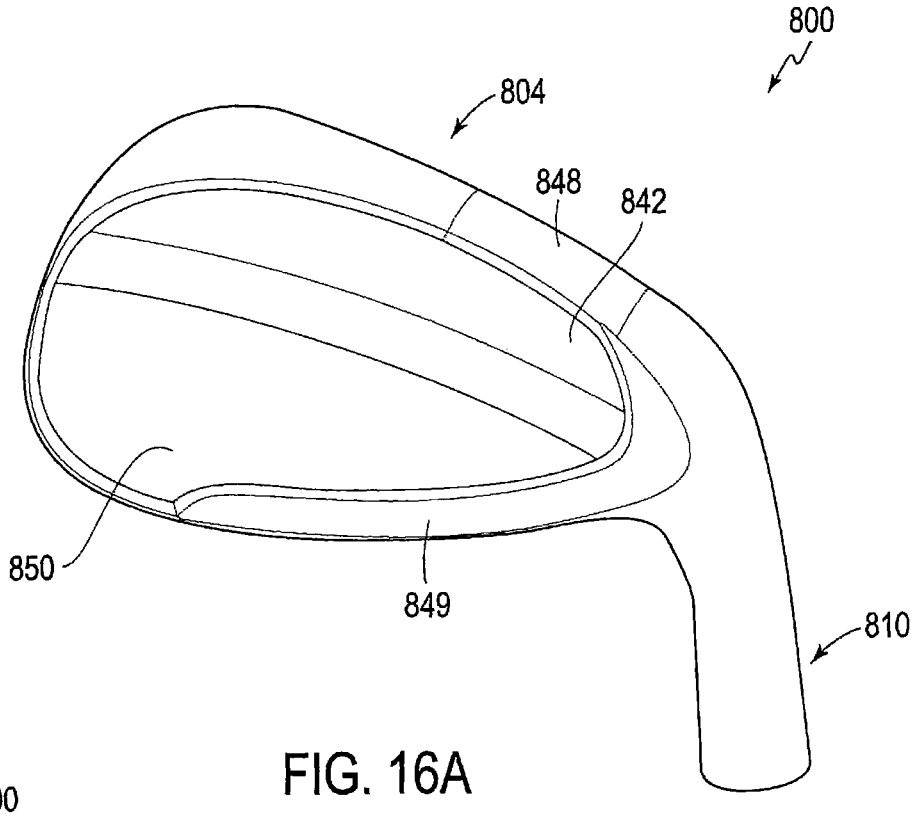
FIG. 16A is a rear perspective view of an exemplary golf club head in accordance with one or more embodiments.
Figure 16B:
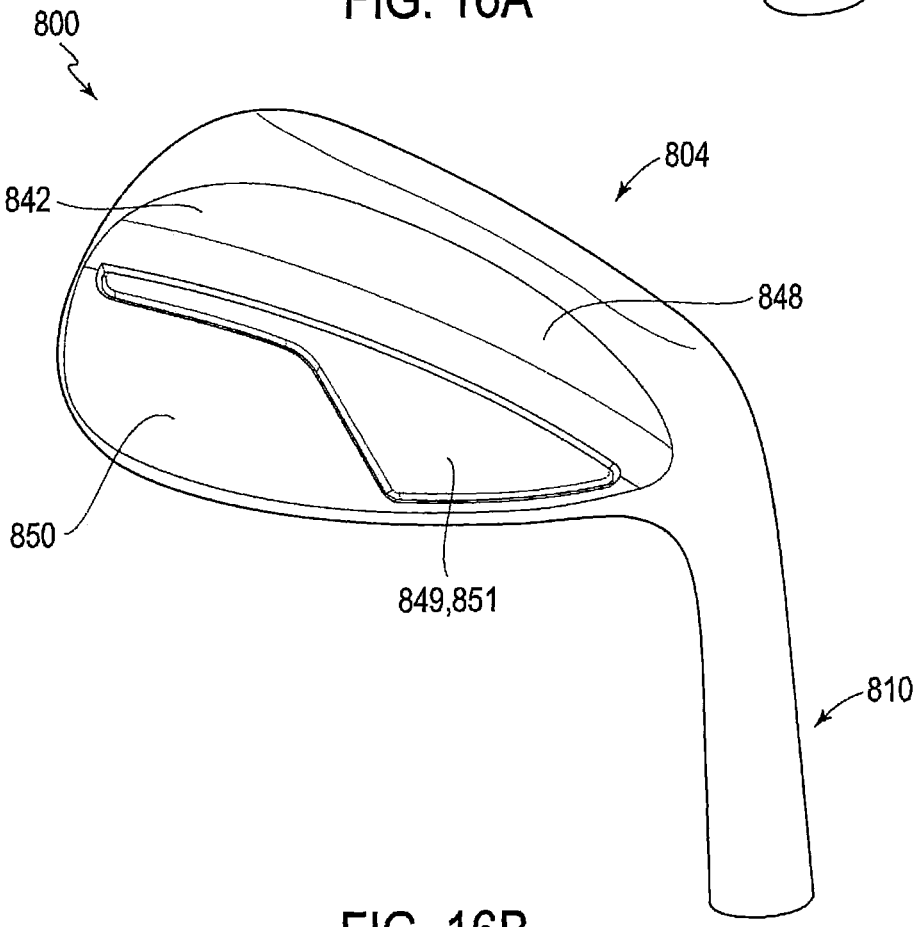
FIG. 16B is a rear perspective view of an exemplary golf club head in accordance with one or more embodiments.

Referring to FIGS. 16A-B, alternative club heads 800 are shown in accordance with one or more embodiments of the present disclosure. Unless otherwise stated, the golf club head 800 is similar to the golf club head 100 of FIGS. 1-8 and embodies all attributes thereof including mass-related attributes and structural attributes. The golf club head 800 differs in that it embodies a differently-contoured rear portion 842. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

The rear portion 842 includes an upper blade portion 848 and a lower muscle portion 850. The blade portion 848 and muscle portion 850 define a rear surface 839. A stepped-down region 849 is provided in the rear surface 839. The stepped down region 849 is preferably recessed from the general contour of the rear surface 839, and comprises a substantially constant depth therefrom. The substantially constant depth is preferably no less than 0.25 mm and more preferably no less than 0.5 mm, even more preferably no less than 1.0 mm.

Additionally, or alternatively, a majority of the surface area of the rear surface 839 occupied by the stepped-down region 849 is located heel-ward of a face center of a striking face of the club head 800 (not shown) (see FIGS. 16A and 18B). More preferably, the stepped-down region 849 is located entirely heel-ward of the face center of the striking face of the club head 800 (see FIG. 16A). In some embodiments, the stepped-down region 849 is adjacent a periphery of the club head 800 (see FIG. 16A). However, in alternative embodiments, the stepped-down region 849 is spaced from the periphery of the club head (see FIG. 18B). In some such embodiments, the stepped-down region 849 is fully-enclosed (as considered in plan view).

Additionally, or alternatively, an aft-attached insert or poured-in filler 851 is located at least partially, or optionally fully, within the stepped-down region. In some cases, an insert 851 both substantially fills the stepped-down region 849 and extends from the stepped-down region 849 above the contour of adjacent portions of the rear surface 839 of the club head 800. In such cases, the insert 851 preferably comprises a density less than the density of the main body and/or a density no greater than 4 g/cc.

These attributes provide for redistribution of mass from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Referring to FIGS. 17A-D, alternative club heads 900 are shown in accordance with one or more embodiments of the present disclosure. Unless otherwise stated, the golf club head 900 is similar to the golf club head 100 of FIGS. 1-8 and embodies all attributes thereof including mass-related attributes and structural attributes. The golf club head 900 differs in that it embodies a differently-contoured rear portion 942. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Figure 17A:
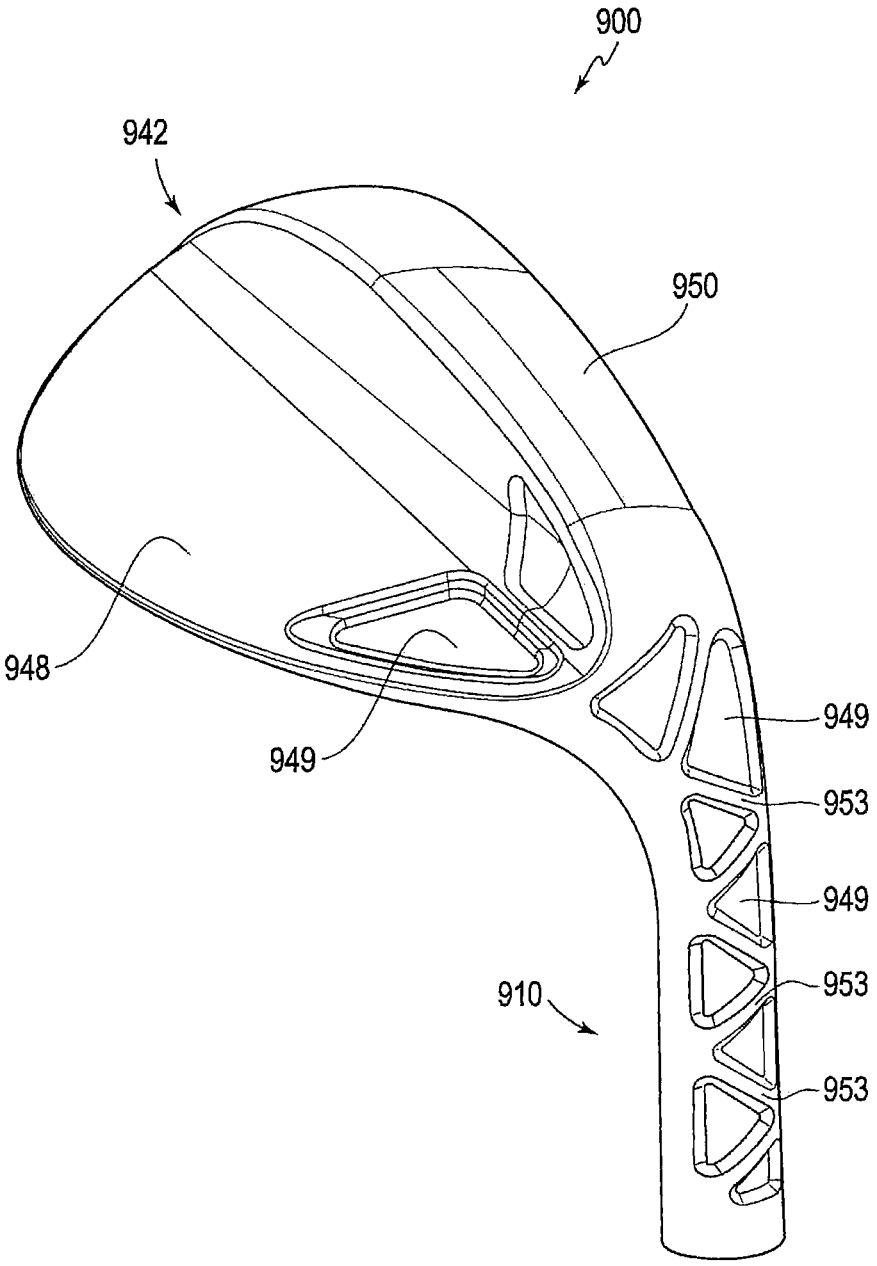
FIG. 17A is a rear perspective view of an exemplary golf club head in accordance with one or more embodiments.
Figure 17B:
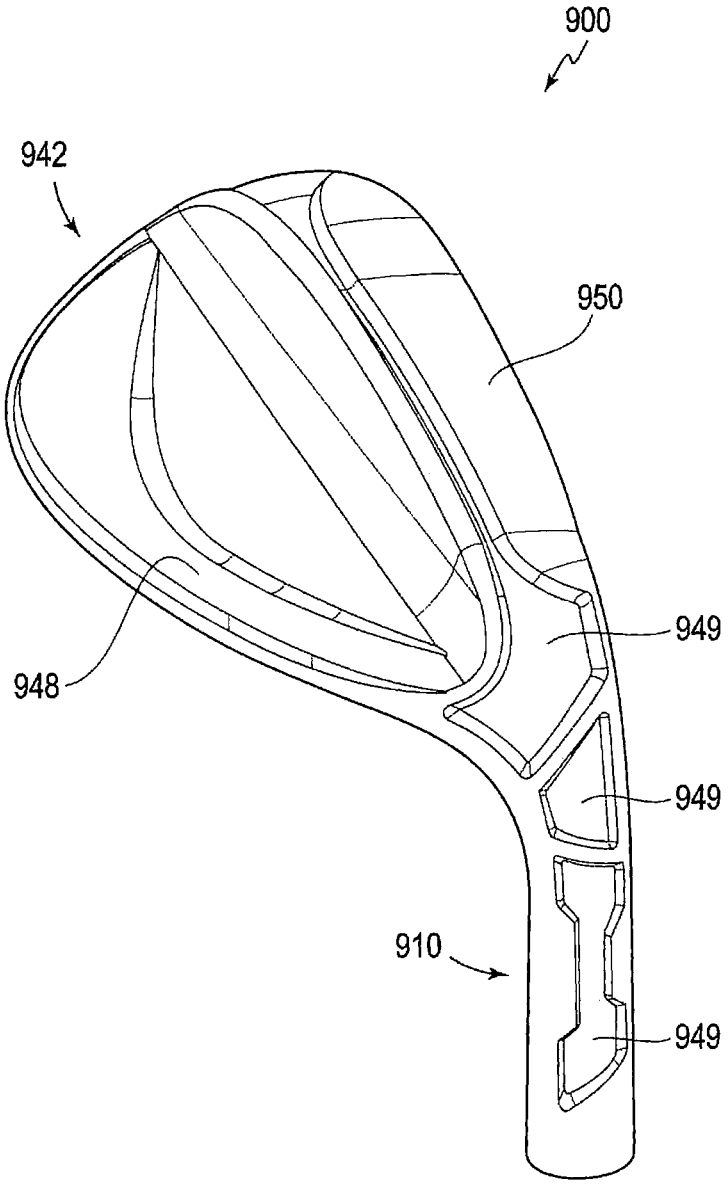
FIG. 17B is a rear perspective view of an exemplary golf club head in accordance with one or more embodiments.

Referring specifically to FIG. 17A, a golf club head 900 includes an upper blade portion 948, a lower muscle portion 950, and a hosel 910. A plurality of stepped-down regions 949 are positioned in various locations proximate the heel-side of the club head 900 (e.g. heel-ward of a virtual vertical plane perpendicular to the striking face and passing through the face center thereof).

The stepped down regions 949 are preferably recessed from the general contour of the club head 900 and comprises a substantially constant depth therefrom. The substantially constant depth is preferably no less than 0.25 mm, more preferably no less than 0.5 mm and most preferably no less than 1.0 mm. In some embodiments, the stepped-down regions 949 vary in depth from each other. In other embodiments, the stepped-down regions 949 are of a substantially constant depth from one to others.

Additionally, or alternatively, a majority of the surface area of the club head 900 occupied by the stepped-down regions 949 is located heel-ward of a face center of a striking face of the club head 900 (not shown). More preferably, the stepped-down regions 949 are located entirely heel-ward of the face center of the striking face of the club head 900. In some embodiments, the stepped-down regions 949 are adjacent (and share an edge with) a periphery of the club head 900.

Preferably, in some embodiments, in some regions of the exterior surface of the club head 900, the stepped-down regions 949 are so spaced such that they form one or more trusses (or ribs) 953 therebetween. Preferably, the trusses 953 are of substantially constant width and are located at least on the exterior surface of the club head 900 proximate the hosel 910. In some cases, the trusses 953 form a zig-zag pattern whereby the stepped-down regions 949 form alternating triangular-shaped features. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Figure 17C:
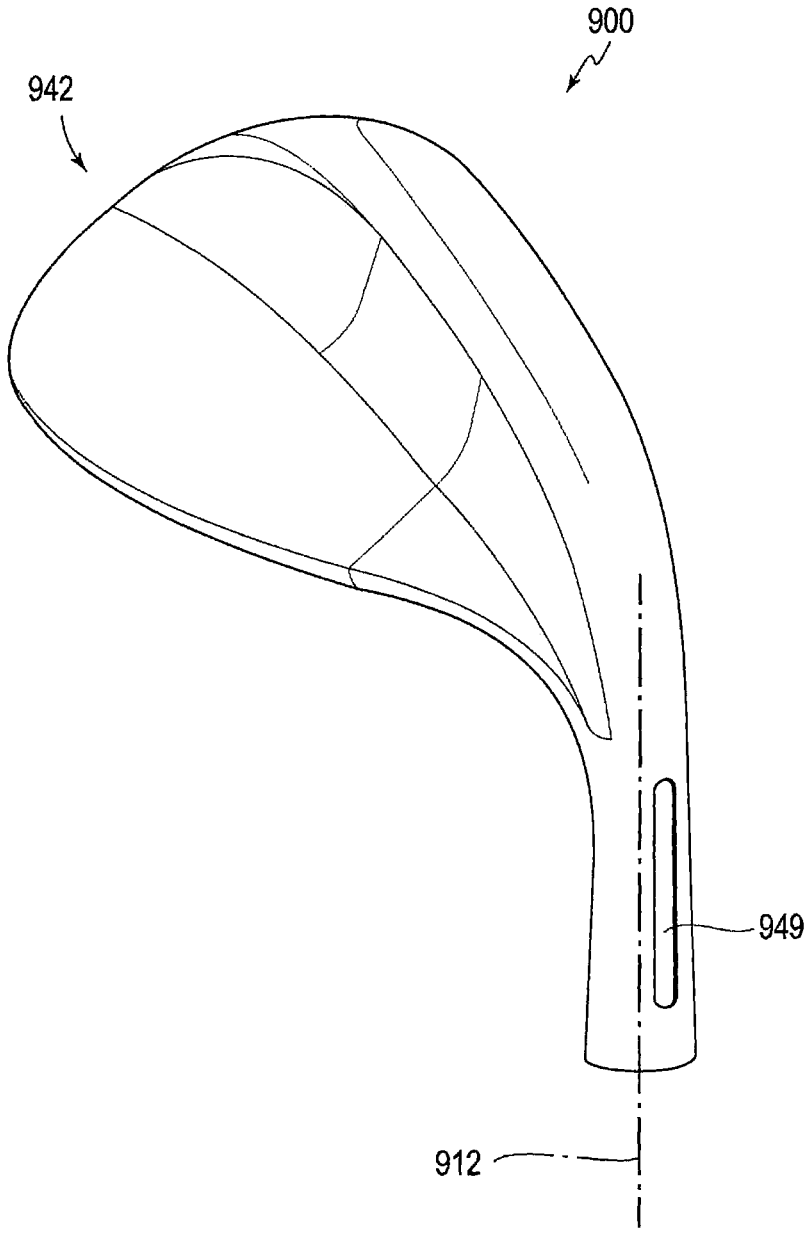
FIG. 17C is a rear perspective view of an exemplary golf club head in accordance with one or more embodiments.

Referring to the golf club head 900 as shown in FIG. 17C, in this particular embodiment a single stepped-down region 949 extends longitudinally in the longitudinal direction of the hosel 910, e.g. parallel with a virtual central hosel axis 912. The stepped region 949 comprises two generally parallel linear side edges spaced by an upper and a lower edge that are generally arcuate and/or radiused.

Figure 17D:
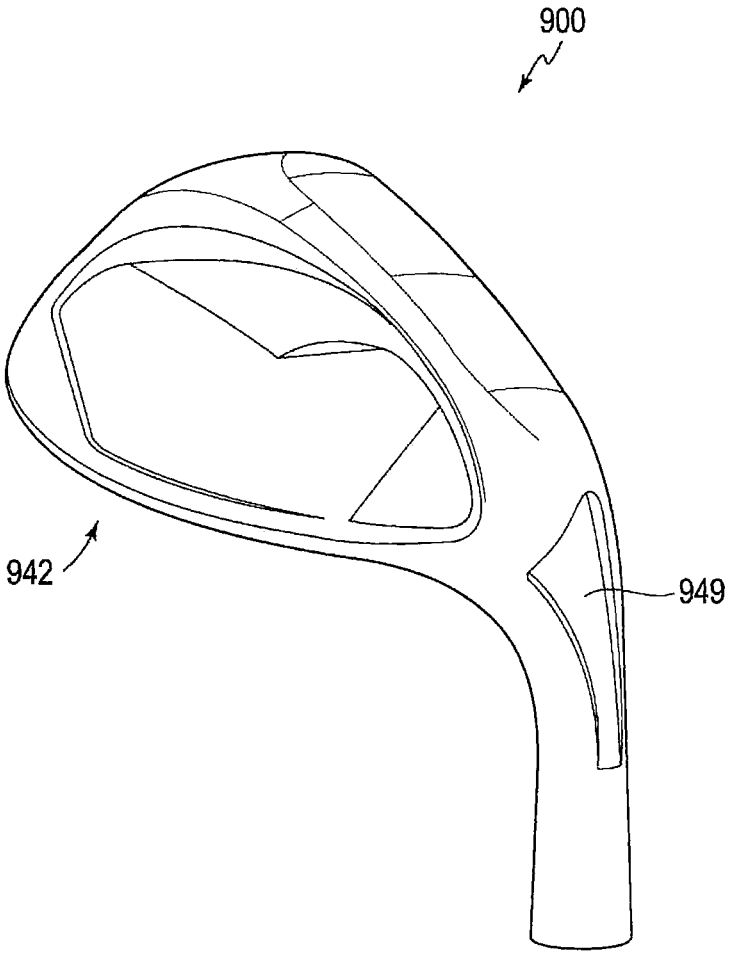
FIG. 17D is a rear perspective view of an exemplary golf club head in accordance with one or more embodiments.

Referring to the golf club head 900 as shown in FIG. 17D, in this particular embodiment a stepped-down region 949 extends longitudinally in the longitudinal direction of the hosel 910, e.g. parallel with a virtual central hosel axis 912. The stepped region 949 tapers in width in the up-ward direction (i.e. toward the tip end of the hosel 910), and flares in the sole-ward direction in generally similar manner to the filleted contour of the hosel-main body junction.

Figure 18:
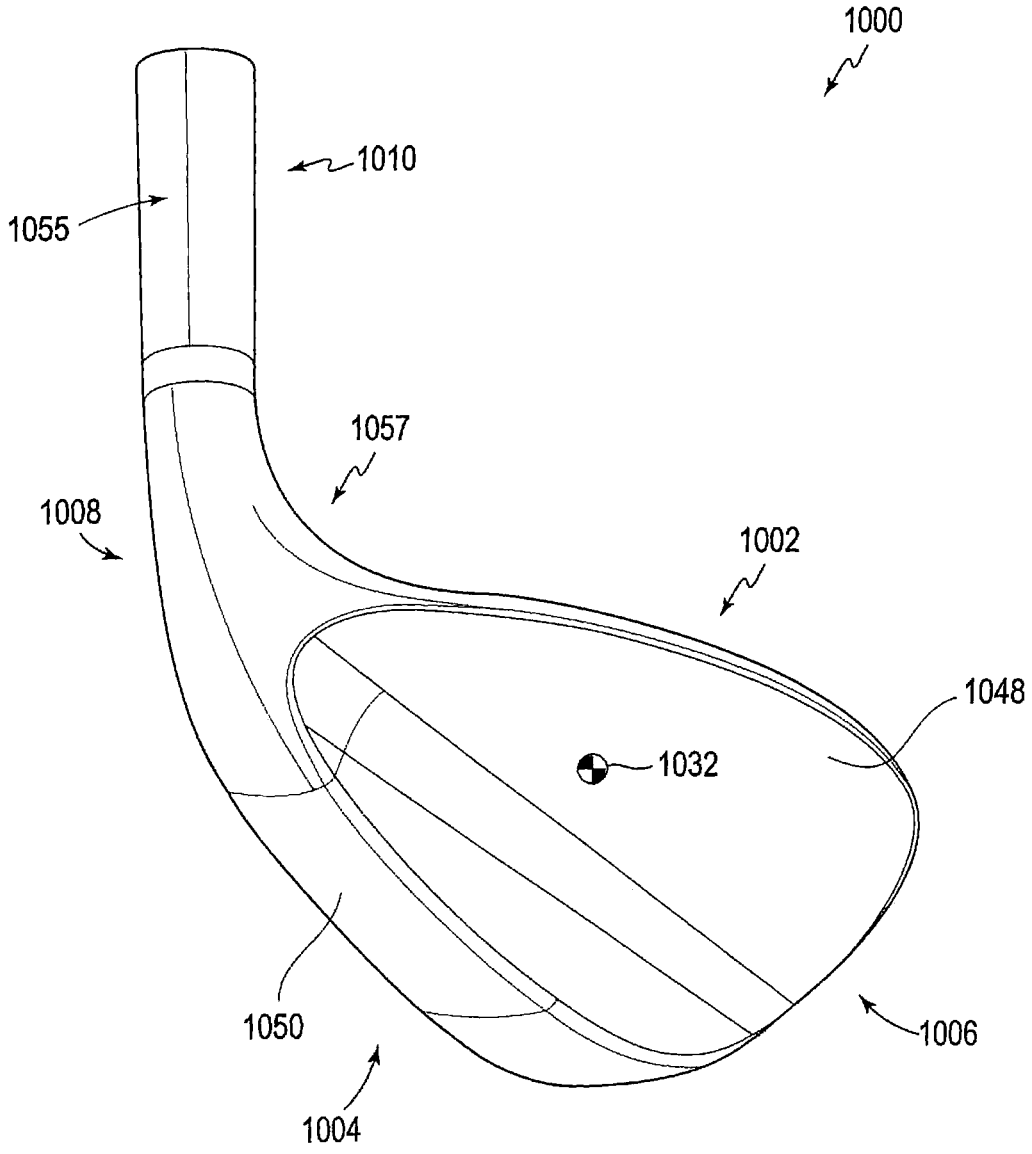
FIG. 18 is a rear perspective view of an exemplary golf club head in accordance with one or more embodiments.

Referring to FIG. 18, a club head 1000 is shown in accordance with one or more embodiments of the present disclosure. Unless otherwise stated, the golf club head 1000 is similar to the golf club head 100 of FIGS. 1-8 and embodies all attributes thereof including mass-related attributes and structural attributes. The golf club head 1000 differs specifically in that it embodies a differently-structured hosel 1010. Particularly, mass is redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

Referring again to FIG. 18, a golf club head 1000 includes a main body having a top portion 1002, a bottom portion 1004, a heel portion 1008, and a toe portion 1006. The main body further defines an upper blade portion 1048 and a lower muscle portion 1050. A hosel 1010 extends from a location on the main body proximate the heel portion 1008. In this particular embodiment, the hosel 1010 comprises a low-density material having a density less than the density of the main body. Preferably, the density of the low-density material is no greater than 4 g/cc. In some embodiments, the low density material takes the form of an aft-attached insert or poured-in and cured-in-place material, preferably located within a recessed region of the hosel 1010. However, in other embodiments, as shown, portions of the hosel 1010 are formed of the low-density material and secured to the remaining portion of the club head 1000 using mechanical means, e.g. interference fit and/or threaded bolts, or chemical adhesive, welding, or brazing. The low-density material itself may include a threaded region configured to rotatably associate with a complementary threaded region of the remaining main body portion. Provided these attributes, mass may be redistributed from heel-ward locations to toe-ward locations for purposes of effecting the mass-related properties described with regard to the embodiment of FIGS. 1-8. As described above, in each of these cases, mass relocation occurs in a manner that minimizes adverse effects on overall performance, e.g. effecting effective bounce, location-based aspects of the center of gravity other than lateral spacing from a face center, and/or workability.

FIGS. 19A-25 illustrate some other embodiments of the present application and may be combinable with one or more features of the embodiments discussed above from FIGS. 1-18. The golf club heads of these embodiments allow the center of gravity to move even closer to the lateral center as compared with the above-described embodiments of FIGS. 1-18. Attributes of the club heads of FIGS. 19A-25 are intended to be similar to like features of the club head embodiments of FIGS. 1-18 unless otherwise indicated as will be described below and shown in FIGS. 19A-25.

The golf club head 1900 according to the embodiment illustrated in FIGS. 19A-19E has a striking face 1902, a sole portion 1904, a top portion 1906, a hosel 1908, and a rear surface 1910 opposite the striking face 1902. The striking face 1902 of the golf club 1900 has a face center 1930, a leading edge 1912, and a virtual striking face plane 1916 generally parallel to the striking face 1902. The sole portion 1904 extends rearward from the leading edge of the striking face to a trailing edge 1914.

The golf club head 1900 illustrated in FIGS. 19A-19E comprises an iron-type club head, and more preferably a wedge-type club head. Additionally, the club head 1900 is preferably a "blade"-type club head, e.g. bearing an upper portion of generally uniform thickness and a lower thickened muscle portion. It is however contemplated that, in some such embodiments, the upper portion may include some minor degree of thickness variation, including a perimeter-weighting feature.

The golf club head 1900 has a loft L (also referred to as a "loft angle") no less than 40°. The golf club head 1900 defines a virtual vertical plane 1933 (relative to ground plane 1931) (see FIG. 20B) perpendicular to the striking face plane 1916 and passing through the face center 1930. The above features in concert with those described in the following, may allow the club head center of gravity 1932 to be spaced from the virtual vertical plane 1933 in the heel-to-toe direction by a distance D1A.

In some embodiments, the distance D1A is less than or equal to 6 mm, preferably less than or equal to 4.5 mm, more preferably less than or equal to 4 mm, even more preferably less than or equal to 3.5 mm (particularly on a club head with loft of 40-56 degrees), and most preferably, less than or equal to 3 mm (particularly on a club head with a loft of 46-52 degrees), thereby providing improved performance attributes such as reduced shot dispersion, and loss of energy due to undesirable side spin, while maintaining the overall traditional appearance of the golf club head.

Additionally, or alternatively, the relative location of center of gravity 1932 is loft-dependent. Thus, in a set of iron-type or wedge-type golf club heads, the center of gravity location varies from club head to club head with loft angle. Preferably, the club head 1900 is configured such that the distance D1A is related to club head loft angle L by being less than or equal to (0.08 mm/°)×L, less than or equal to (0.075 mm/°)×L, or less than or equal to (0.065 mm/°)×L, in some embodiments. Such attributes ensure the advantages associated with blade-type construction are achieved, while accounting for natural variations in club head design properties that may be associated with club head loft angle, thus more precisely providing a high performance club head.

Figure 19A:
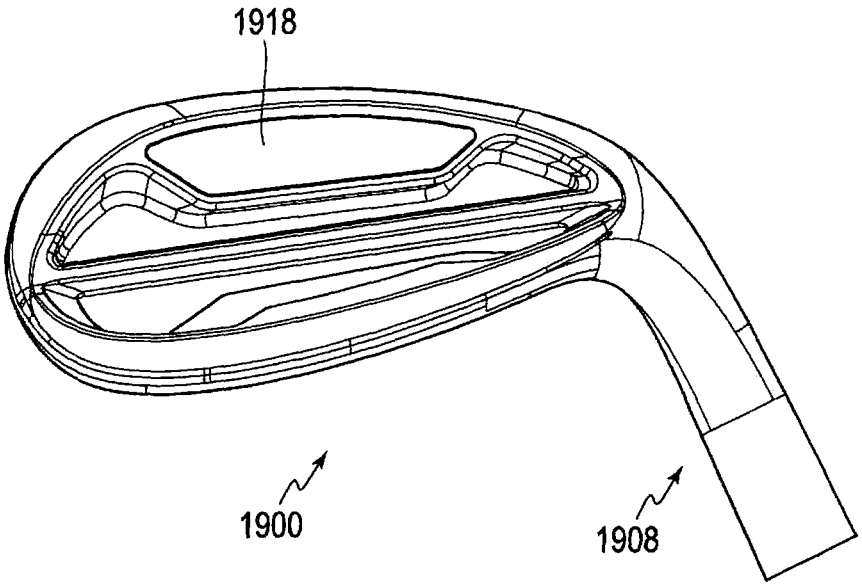
FIG. 19A is a rear perspective view of an exemplary golf club head in accordance with one or more embodiments.
Figure 19B:
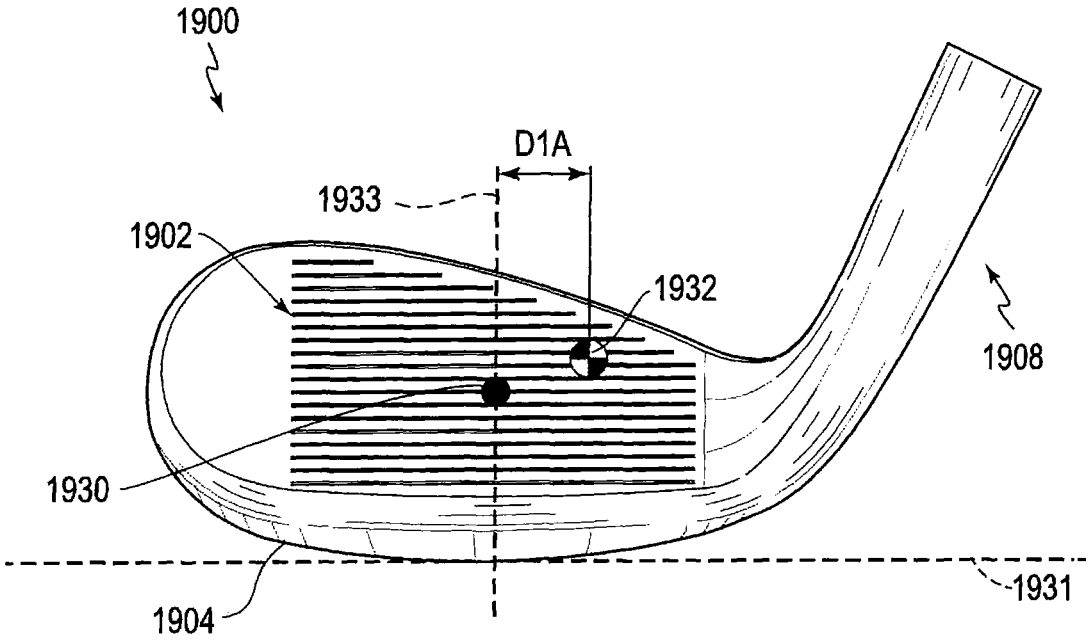
FIG. 19B is a front view of the exemplary golf club head of FIG. 19A.
Figure 19C:
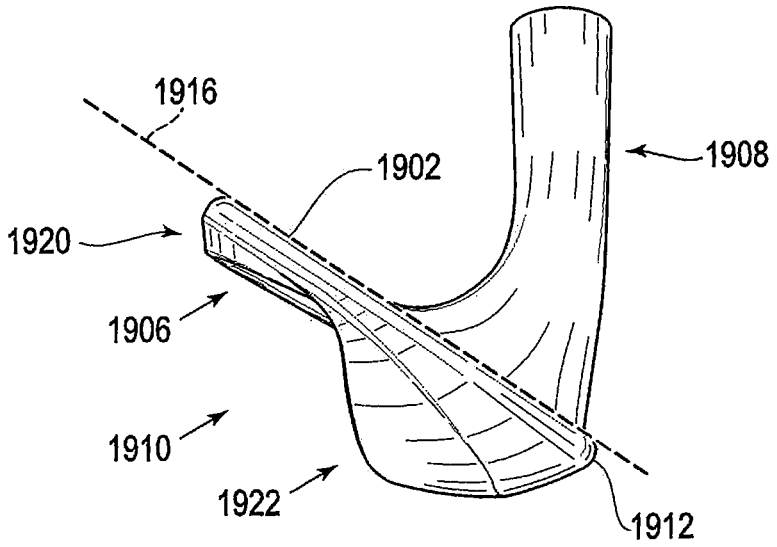
FIG. 19C is a toe side view of the exemplary golf club head of FIG. 19A.
Figure 19D:
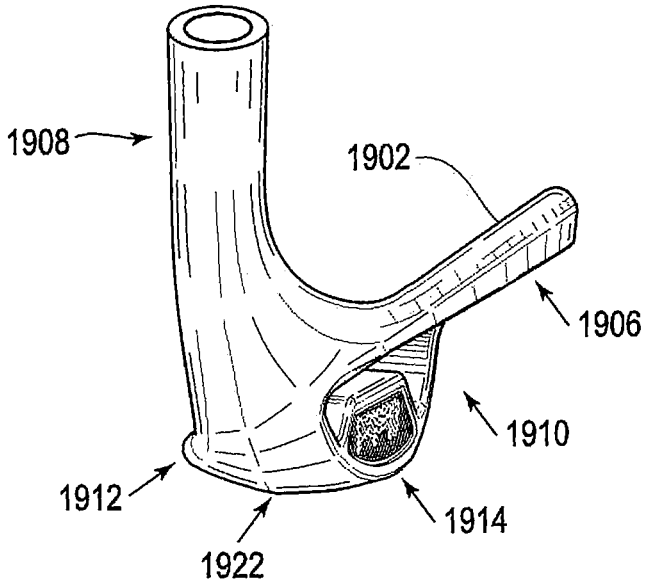
FIG. 19D is a heel side view of the exemplary golf club head of FIG. 19A.
Figure 19E:
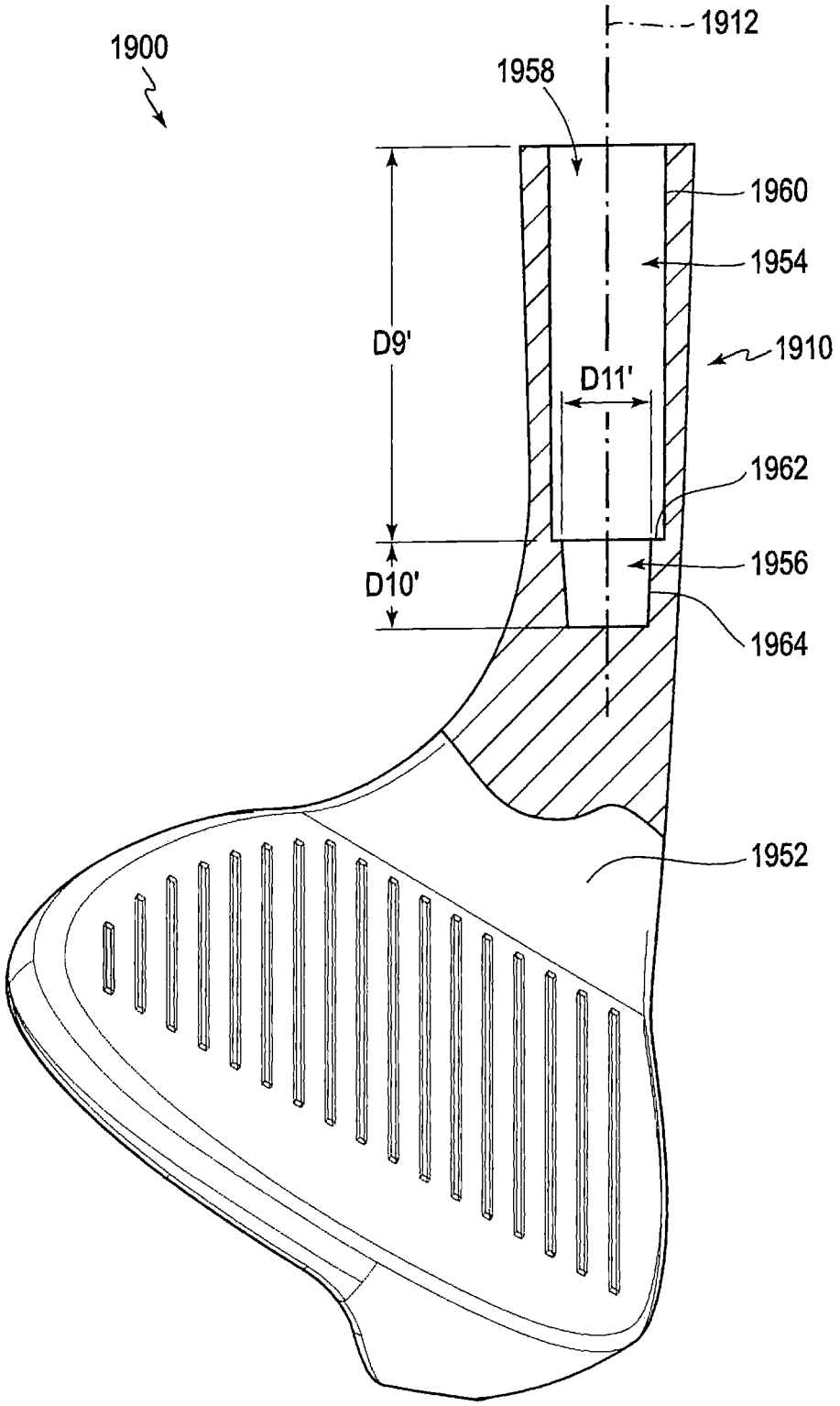
FIG. 19E is a toe-side perspective view of the exemplary golf club head of FIG. 19A, with the club head oriented such that a virtual hosel axis extends parallel to the plane of the paper.

As shown in FIG. 19E, the hosel 1908 of the club head 1900 includes an internal bore 1958. The internal bore 1958 is preferably dimensioned to receive and secure a conventional golf club shaft to the club head 1900, thereby forming a golf club. The internal bore 1958, specifically, includes a peripheral side wall 1960 and a bottom surface 1962 being a surface configured to abut and support a tip end of a conventional golf shaft. In some embodiments, the abutment surface takes the form of a peripheral ledge.

The internal bore 1958 also includes an internal bore depth D9' less than or equal to 30 mm, less than or equal to 28 mm, or about 27 mm, according to some embodiments, which allows a reduced hosel height (shown as D4 in FIG. 1). By reducing the hosel height, lateral spacing between the face center 1930 of the striking face and the center of gravity 1932 may also be reduced, as previously discussed.

The abutment surface 1962 (or peripheral ledge in the particular embodiment shown in FIG. 19E) ensures sufficient surface area and counter force applied to the shaft in consideration of typical loads applied at the shaft-hosel junction during use.

A recessed region 1956 (in the particular embodiment of FIG. 19E, an auxiliary recess) extends sole-ward from the abutment surface 1962 of the internal bore 1958 of the hosel 1908, thereby forming a "blind cavity." The auxiliary recess 1956 preferably has a depth D10', measured along the hosel axis 1912, greater than or equal to 4 mm, more preferably greater than or equal to 6 mm, and most preferably about or equal to 7 mm. The auxiliary recess 1956, in addition, preferably includes a width D11' (in the particular embodiment of FIG. 19E, a maximum diameter D11') of between 4 mm and 10 mm, more preferably between 5 mm and 8 mm. The auxiliary recess 1956 further include a sidewall 1964, which is preferably inclined such that the width D11' (or diameter D11' as the case may be) of the auxiliary recess 1956 tapers in the sole-ward direction along height D10'.

As an alternative to cast-in formation, the auxiliary recess 1956, in some embodiments, is machined into the club head 1900 subsequent to formation of the club head main body (e.g. by investment casting). In such embodiments, preferably the auxiliary recess 1956 is milled by applying a tapered bit configured to rotate about, and penetrate along, the virtual hosel axis 1912.

In some embodiments, the auxiliary recess 1956 is at least partially filled. In some such embodiments, the auxiliary recess is entirely filled with a filler material. Such may be advantageous for dampening vibrations emanating from impact with a golf ball. In such embodiments, the filler material is preferably a material having a density less than that of the main body of the club head. Alternatively, or additionally, the density of the auxiliary recess filler material is no greater than 7 g/cm$^3$ and more preferably no greater than 4 g/cm$^3$. Additionally, or alternatively, the filler material has a hardness less than that of the main body and optionally comprises a resilient material such as a polymeric material, natural or synthetic rubber, polyurethane, thermoplastic polyurethane (TPU), an open- or closed-cell foam, a gel, a metallic foam, a visco-elastic material, or resin.

Figure 20A:
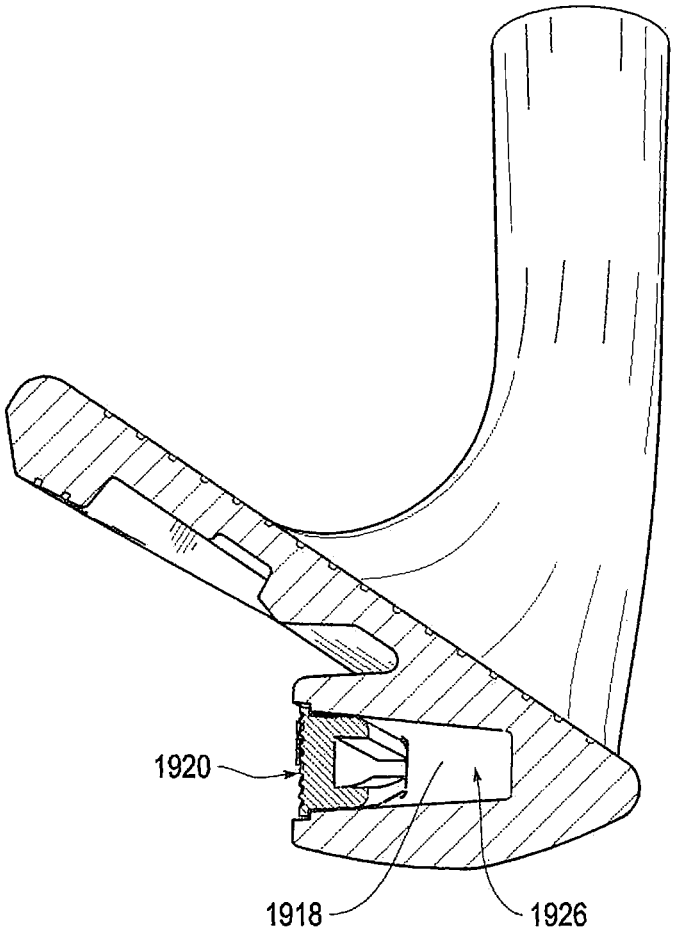
FIG. 20A is a cross-sectional view of the golf club head of FIG. 20B through cross-sectional plane 20A.

The golf club head 1900 includes a blade portion 1920 on the upper portion of the golf club head 1900 and a muscle portion 1922 on the lower portion of the club head 1900. The muscle portion 1922 of the golf club head 1900 is located proximate the sole portion 1904. The rear portion of the sole 1904 includes a forward-extending recess 1918 (FIG. 20A). As shown in FIG. 20A, the recess 1918, in some embodiments, is at least partially, and preferably fully, enclosed by a resilient cover 1920 (also referred to herein as an "insert"). This configuration permits selective mass location of a discretionary mass, while covering such mass features to exhibit a traditional appearance. The insert 1920 covers the forward-extending recess such that a hollow portion 1926 is formed by the insert 1920 and the recess 1918, as shown in FIG. 20A.

It is noted that the disclosed golf cub heads in the embodiments shown in FIGS. 19A-25 has a tapering from the top portion to the sole of the club head similar to that described in the embodiment of FIG. 13B. However, such taper is preferably limited to the perimeter weighting feature in the embodiments of FIGS. 19A-25.

The golf club head 1900 also may have "V-sole" aspects, including a front-to-rear V shape (keel point) and a heel-to-toe V shape (sole taper angle). The front-to-rear V shape at the sole is described first below.

Figure 20B:
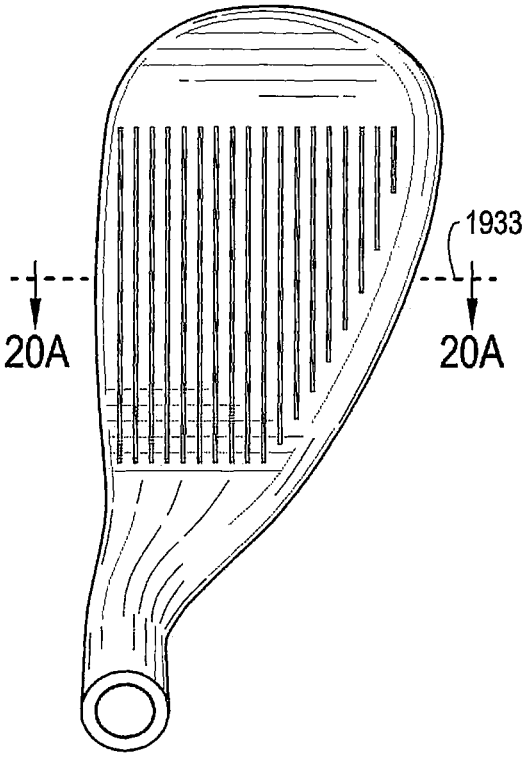
FIG. 20B is top plan view of an exemplary golf club head in accordance with one or more embodiments.
Figure 21:
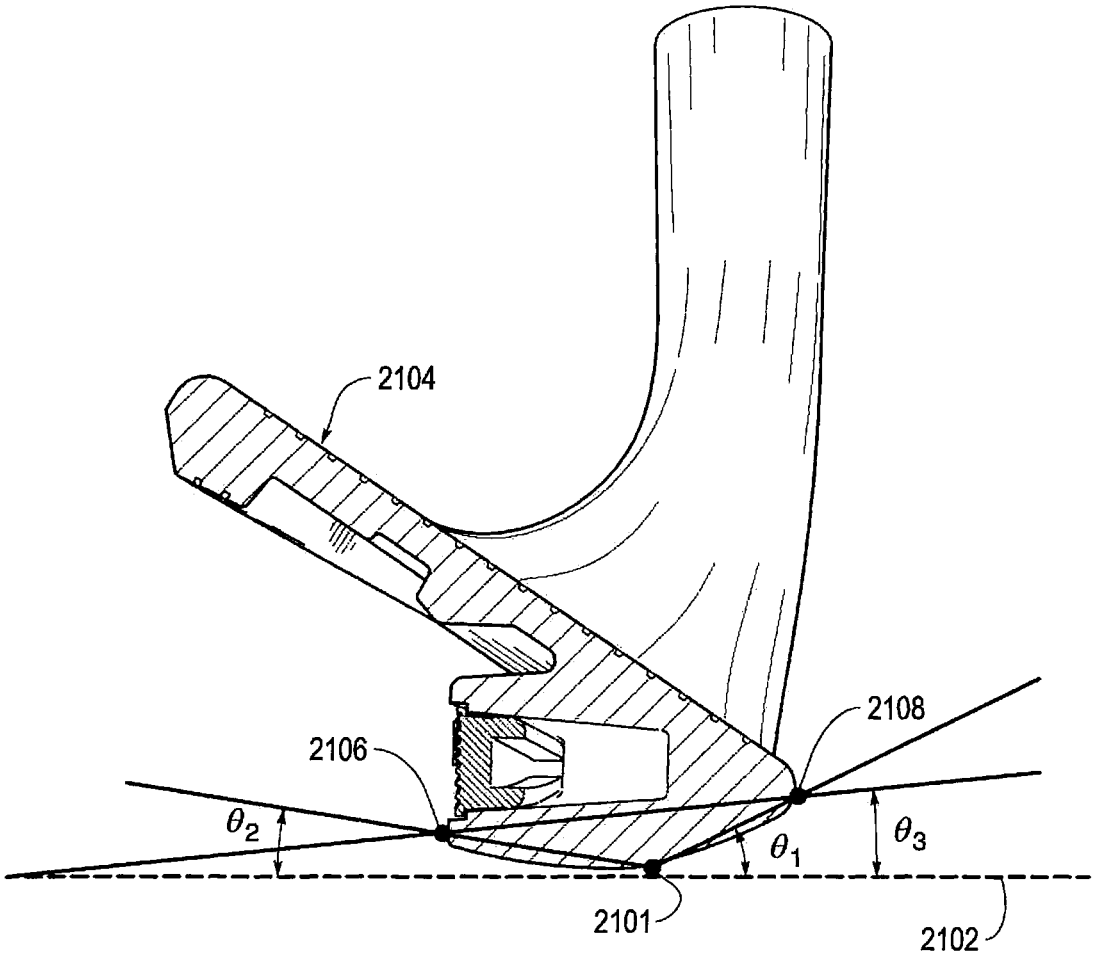
FIG. 21 is a cross-sectional view of the golf club head of FIG. 20B through cross-sectional plane 20A, illustrating the bounce angle in accordance with one or more embodiments.

The front-to-rear V shape is shown in FIG. 21 where there are three virtual angles shown in plane 1933 (see FIGS. 19B and 20B for plane 1933). As shown in FIG. 21, a striking face 2104 is shown and the golf club head is in a reference position relative to the ground plane 2102. A leading edge bounce angle $\theta_1$ is created between (1) the ground plane 2102 and (2) a straight line defined by connecting two points—an intersecting point 2101 between a vertex point 2101 on the sole and plane 1933 (i.e. a lowermost sole point in the plane 1933) and an intersecting point 2108 between plane 1933 and the leading edge 2108 of the club head sole. The vertex point 2101 is the point at which the sole first contacts or is otherwise closest to the ground plane 2102 when the club is in the reference position.

A trailing edge bounce angle $\theta_2$ is created by an angle created between (1) the ground plane 2102 and (2) a straight line connecting the vertex point 2101 (defined above) and the point where the plane 1933 interests the trailing edge 2106 of the club head 1900.

An overall bounce angle $\theta_3$ is created by an angle between the ground plane 2102 and a straight line formed by connecting the trailing edge point 2106 and the leading edge point 2108.

The leading edge bounce angle $\theta_1$ may be less than or equal to 20 degrees or between 18 and 20 degrees, according to two aspects. The trailing edge bounce angle $\theta_2$ may be greater than or equal to 6 degrees or between 6 and 8 degrees, according to two aspects. The total bounce angle $\theta_3$ may be greater than or equal to 4 degrees or between 4 and 8 degrees, according to two aspects.

The heel-to-toe V shape is measured by a sole taper angle $\theta_4$, which is illustrated using FIGS. 22A-22F and is defined using two planes, planes A and B, that extend through the golf club head. The sole taper angle $\theta_4$ is defined using four points that are projected onto ground plane 2102.

As shown in FIGS. 22A-22E, plane A is a vertical plane perpendicular to a plane defined by the striking face and intersects the striking face plane at the toe edge of scorelines in the striking face. Plane A intersects the leading edge at a point on the sole, which is projected (perpendicularly to the ground plane 2102) onto ground plan 2102 at a first point 2216. Plane A also intersects the sole at a trailing edge at a point, which is projected (perpendicularly to the ground plane 2102) onto the ground plane 2102 at a second point 2212.

Also shown in FIGS. 22A-22E, plane B is also a vertical plane that is perpendicular to the striking face plane and intersects the striking face plane at the heel edge of scorelines on the striking face. Plane B thereby intersects the leading edge at a point which is projected (perpendicularly to the ground plane 2102) onto the ground plane 2102 at a third point 2214. Plane B also intersects the sole at the trailing edge 1914 at a point, which is projected (perpendicularly to the ground plane 2102) onto the ground plane 2102 at a fourth point 2210.

These four points 2210, 2212, 2214, and 2216 may be considered representative of a heel-to-toe taper of the sole portion; e.g., these points define two lines that intersect to form a sole taper angle $\theta_4$, as described below.

Figure 22A:
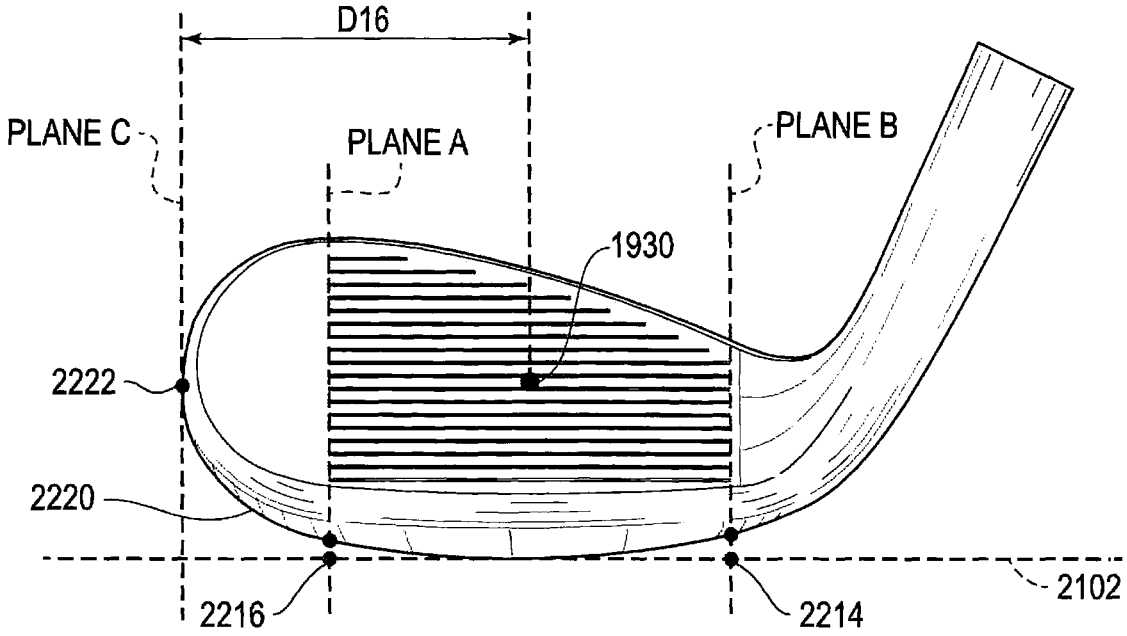
FIG. 22A is a front view of an exemplary golf club head in accordance with one or more embodiments.
Figure 22B:
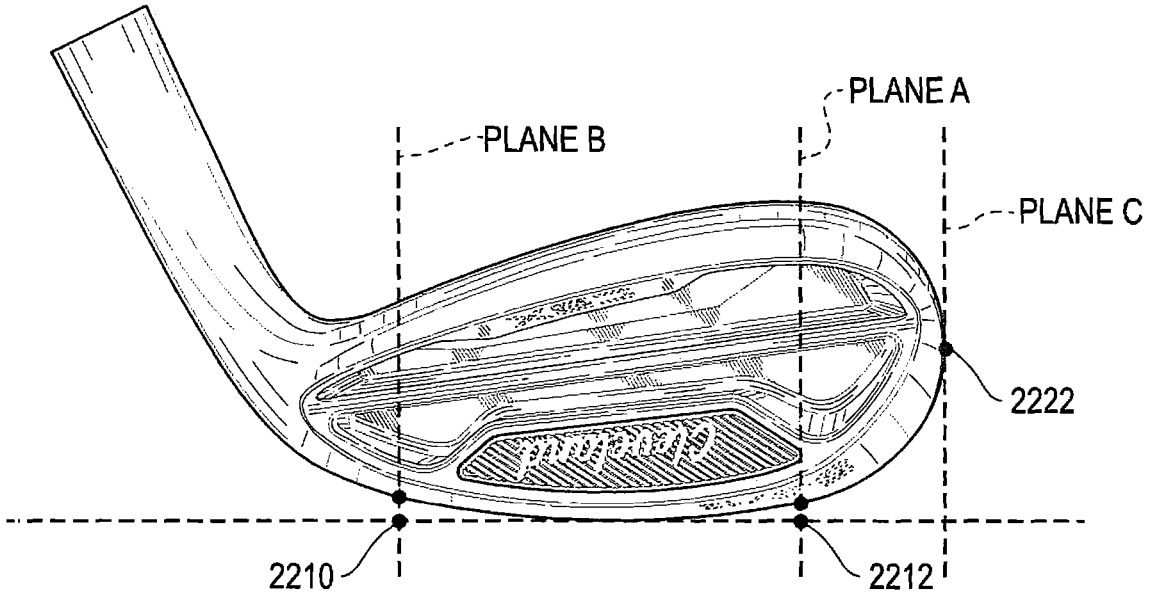
FIG. 22B is a rear view of the exemplary golf club head of FIG. 22A.
Figure 22C:
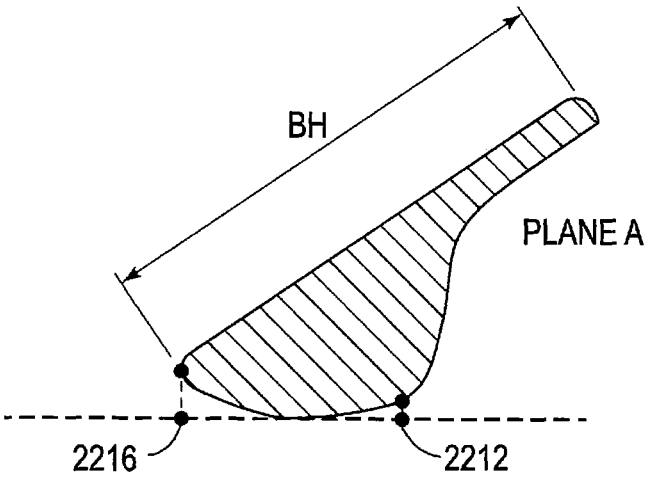
FIG. 22C is a cross-sectional view of the exemplary golf club head of FIG. 22A taken along plane A.
Figure 22D:
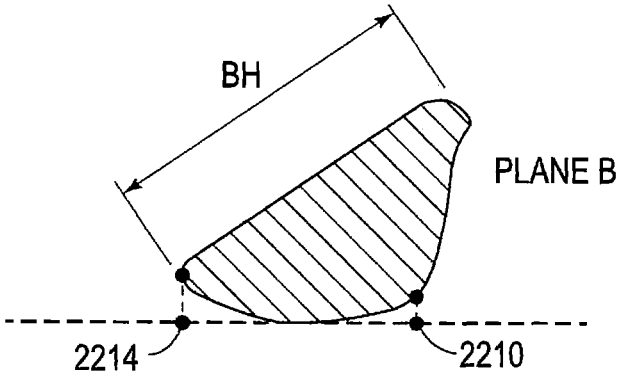
FIG. 22D is a cross-sectional view of the exemplary golf club head of FIG. 22A taken along plane B.
Figure 22E:
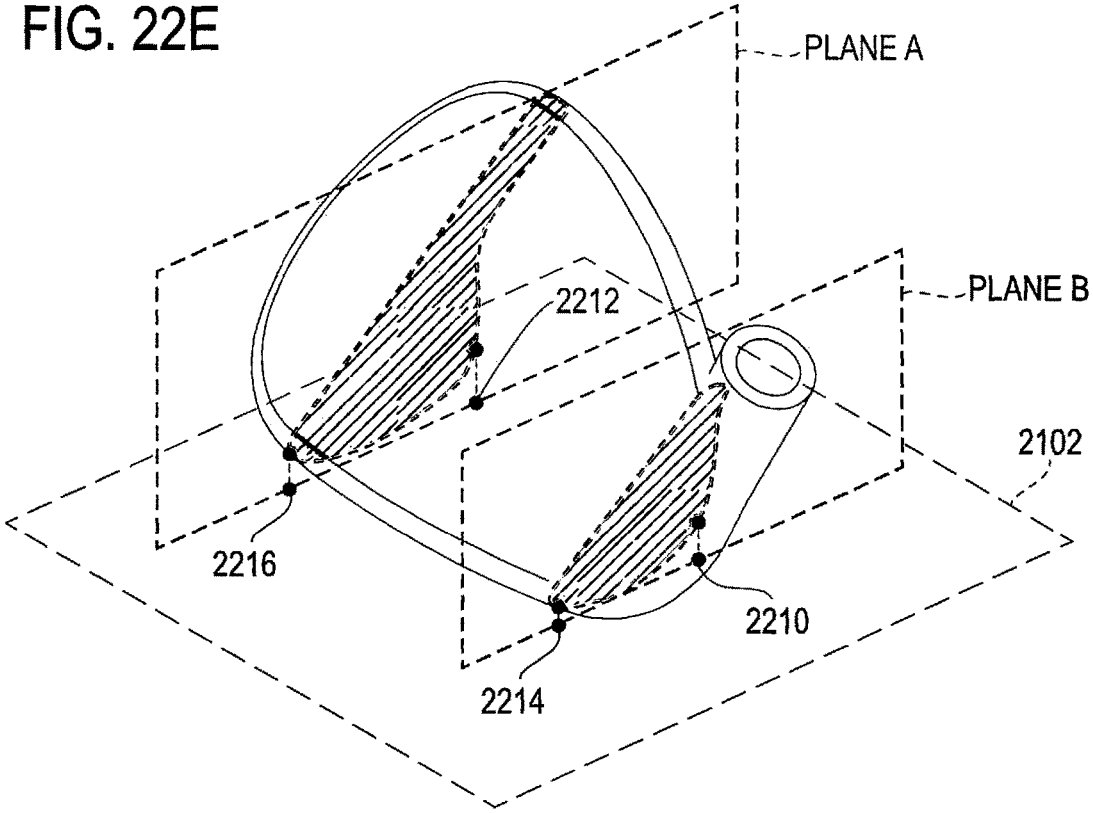
FIG. 22E is a three-dimensional view of the exemplary golf club head of FIG. 22A showing cross-sectional planes A and B through the golf club head.
Figure 22F:
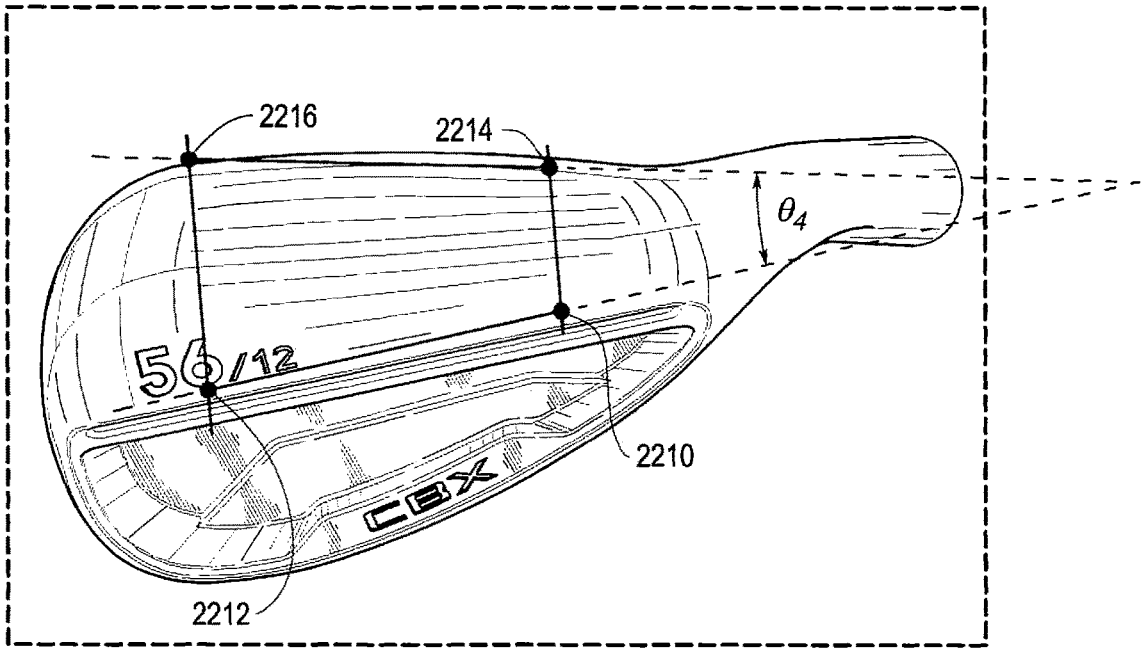
FIG. 22F is an illustration of the taper angle based on points illustrated in FIGS. 22A-22E.

As shown in FIG. 22F, a first line passes through the first point 2216 and the third point 2214 and a second line passes through the second point 2212 and the fourth point 2210. The sole taper angle $\theta_4$ is the angle formed at the intersection of the first and second lines as shown in FIG. 22F.

The sole taper angle $\theta_4$ may be greater than or equal to 5 degrees, greater than or equal to 8 degrees, or equal to any of the values shown in Table 1 below. Relative to loft L of the club head 1900, the sole taper angle $\theta_4$ may be greater than or equal to 0.1 times the loft (0.1×L), greater than or equal to 0.15 times the loft (0.15×L), between 0.75 times the loft (0.75×L) and 1.25 times the loft (1.25×L), or equal to or about 0.20 times the loft (0.20×L).

Alternative ways to quantify the sole taper angle are based on the sole width at the center of the scorelines, the heel edge of the scorelines (i.e., edge of the scorelines closest to the heel of the golf club head as shown at the intersection of the striking face and plane B in FIGS. 22A, 22B and 22E), and the toe edge of the scorelines (i.e., edge of the scorelines closest to the toe of the golf club head as shown at the intersection of the striking face and plane A in FIGS. 22A, 22B and 22E). The sole width is generally defined as the distance between corresponding points on the trailing edge and the leading edge of the golf club head (whereby such corresponding points each lie within a plane that is perpendicular to the striking face). For example, the sole width at the heel edge ("toe-side sole width") may be less than or equal to 20 mm, between 15-20 mm, or between 16-18 mm. And the sole width at the toe edge of scorelines ("toe-side sole width") may be greater than or equal to 25 mm or between 25-30 mm.

The ratio of the heel-side to toe-side sole widths may be preferably less than or equal to 75%, more preferably less than or equal to 65%, or even more preferably between 60-65%.

Some consider there to be three types of golf club irons—player's irons, game-improvement irons and super game-improvement irons. Player's irons are targeted to players with the highest ability level and produce the greatest response when struck correctly. Game-improvement irons are for mid-level golfers. These irons are designed to produce better results—straighter and longer shots—when contacting the ball off-centered on the clubface. For higher handicap golfers, super game-improvement ("SGI") irons offer even more forgiveness on off-center hits.

Also within the scope of the present disclosure, is to adapt wedges to blend with, or to be used along with, SGI irons. By modifying traditional attributes of wedges (or at least some wedges of a set of wedges), to some degree, to perform more like SGI irons, greater comfort and confidence in high handicapped golfers is achievable. There are many features of the wedges described herein which allow for this "blending" of wedges with SGI iron sets. First, according to some embodiments, the blade height for wedges according to the embodiments of FIGS. 19A-25 may be set as described below.

Figure 23:
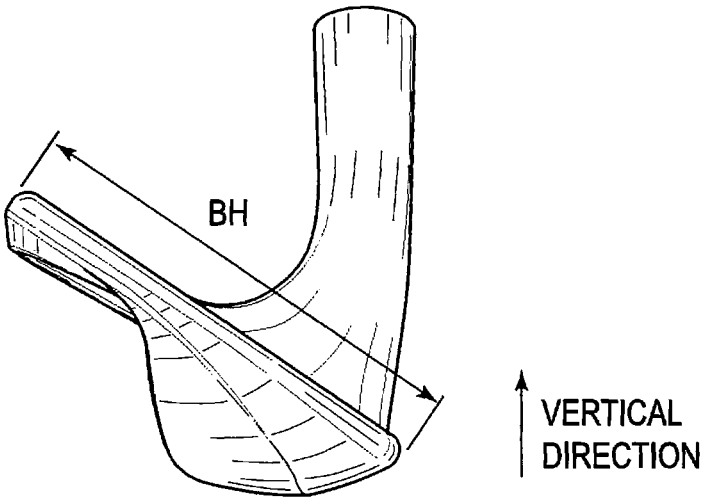
FIG. 23 is a toe side view of an exemplary golf club head illustrating the blade height BH of a golf club head in accordance with one or more embodiments.

A golf club set (or golf club head set thereof) may include wedges that include a first golf club and a second golf club, each of which include the parameters discussed and illustrated herein in conjunction with FIGS. 19A-25. Each of the first and second golf clubs has a blade height BH. The blade height BH of a golf club head refers to the distance along the striking face of the blade, measured from the sole to the crown of the club, as shown in FIG. 23. The blade height can be measured along various parts of the golf club head. For example, the blade height may be considered at the heel (referred to herein as "heel blade height"). The heel blade height BH refers to the distance along the striking face of the blade, measured from the sole to the crown of the club along the heel edge of the scorelines at plane B, as illustrated at FIGS. 22A, 22B, 22D, and 22E.

The first golf club may have a head with a loft of between 40° and 50°, between 45° and 48°, or equal to 46°, according to three aspects. The head of the first golf club in the golf club set may have a heel blade height BH1 less than or equal to 38 mm in one embodiment or less than or equal to 36 mm in another embodiment.

The second golf club may have a head with a loft of greater than 50°, between 52° and 60°, or equal to 56°, according to three aspects. The heel blade height BH2 of the second golf club may be greater than or equal to 39 mm in one embodiment or equal to or about 40 mm in another embodiment.

The club head (e.g., the first club head, the second club head, etc.) is configured to satisfy the following relationship where L is the loft of the golf club head (e.g., where L could be L1 for the first club head and L2 for the second club head) and BH is the heel blade height (e.g., BH1 or BH2):

$$(-0.017\times L^2)+(2.061\times L)-24.63\leq BH\leq(-0.0167\times L^2)+(2.061\times L)-22.63$$

where L is measured in degrees and BH is expressed in millimeters.

Figure 24A:
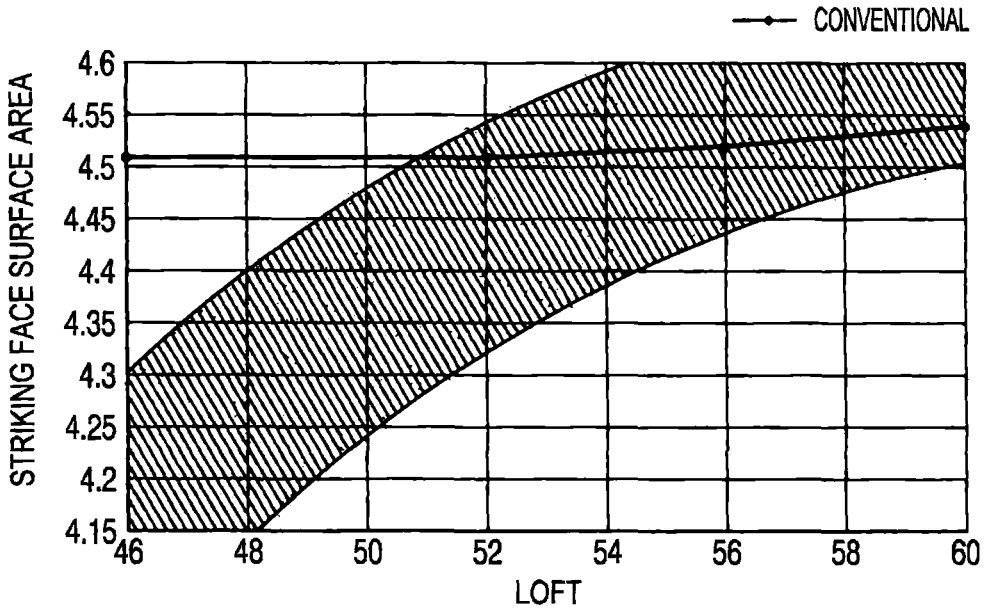
FIGS. 24A and 24B are graphs illustrating striking face surface area vs. loft and heel blade height vs. loft, respectively, as compared with conventional golf club heads in accordance with one or more embodiments.
Figure 24B:
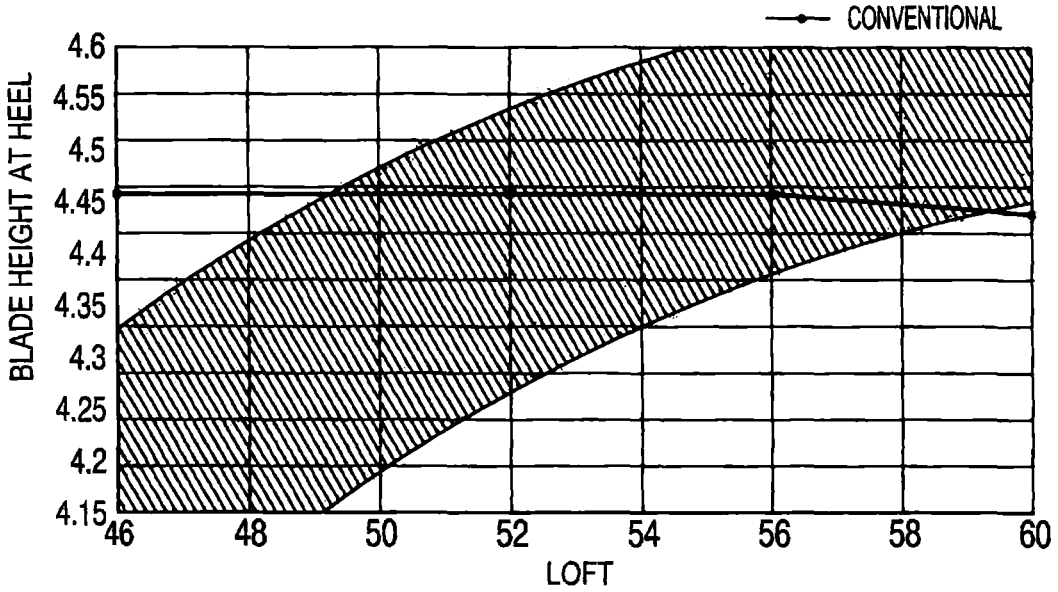

This equation is plotted as the graph shown in FIG. 24B where the loft L is shown plotted on the x-axis and the blade height at the heel is plotted on the y-axis. As shown in FIG. 24B, the blade height BH of the disclosed club heads varies with the loft L whereby the blade height BH of prior art wedge heads substantially does not vary with the loft. FIG. 24B illustrates graphs of a range of plots based on varying the loft L and/or blade height BH of a golf club of the present disclosure. Preferably, the above relationship between BH and L is satisfied for greater than two clubs (or club heads) of a set of clubs, e.g. for three clubs, and (alternatively and/or additionally) preferably for all clubs of a correlated set of clubs. Further, the striking face surface area of the club heads may vary with loft, as discussed below.

Figure 25:
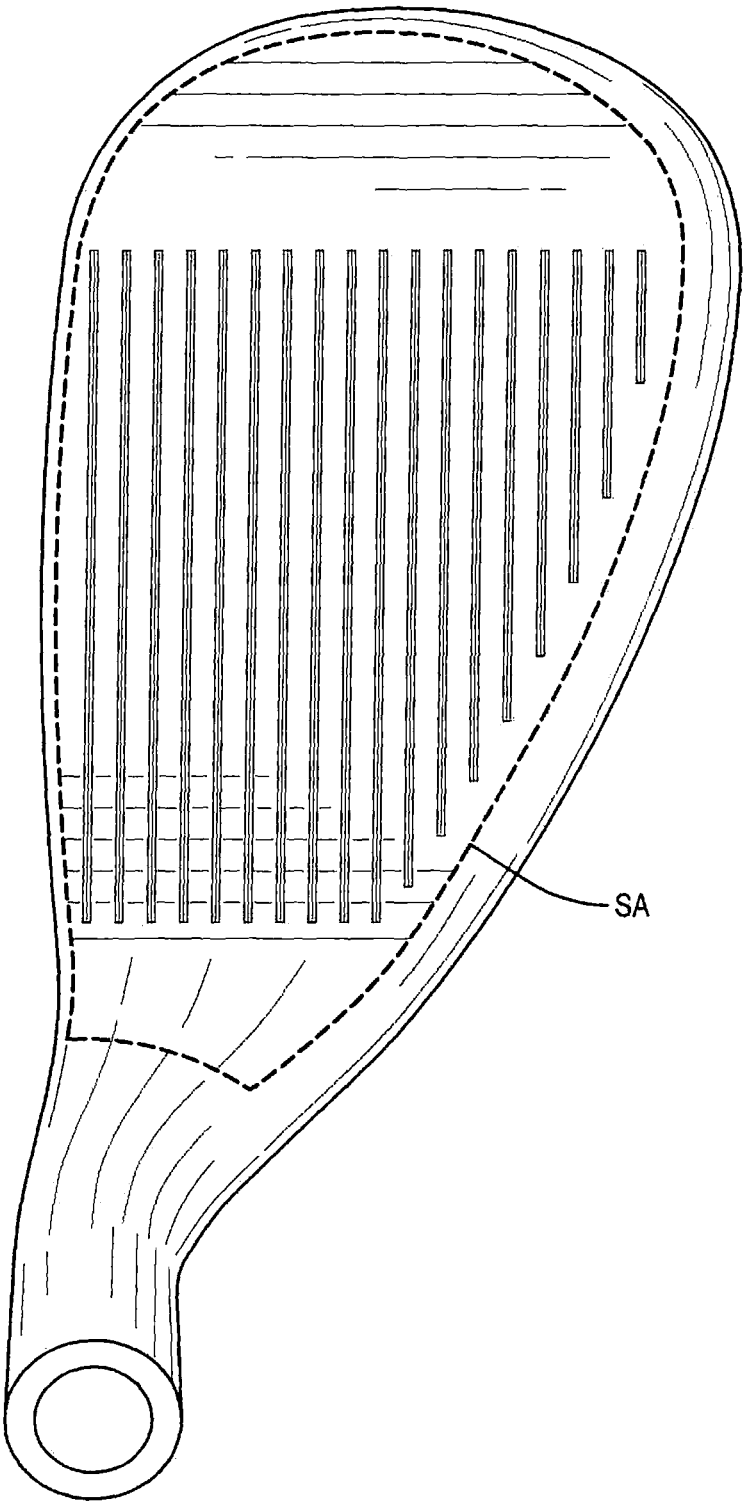
FIG. 25 is a top view of an exemplary golf club head illustrating the striking area in accordance with one or more embodiments.

The striking face surface area (SA) is defined as the generally planar region of the striking face portion including regions having scorelines or other texture aspects. For example, FIG. 25 illustrates an example of the striking face surface area as reference SA. It should be understood that the striking face surface area SA may be greater than or less than what is shown in FIG. 25.

For the example given above for the first and second golf clubs, the head of the first golf club (e.g., with a loft of between 40° and 50°, between 45° and 48°, or equal to 46°, according to three aspects) may have a striking face surface area SA of preferably less than or equal to 4.35 $in^2$, more preferably a striking face surface area SA of less than or equal to 4.25 $in^2$, or even more preferably a striking face surface area SA of 4.2 $in^2$, according to some aspects. The head of the second golf club (e.g., with a loft of greater than 50°, between 52° and 60°, or equal to 56°, according to three aspects) may have a striking face surface area SA of preferably greater than or equal to 4.45 $in^2$ or more preferably a striking face surface area SA of greater than or equal to 4.5 $in^2$, according to some aspects.

Preferably, at least two club heads (of the correlated set of club heads) (e.g., the first club head, the second club head, etc.) are configured to satisfy the following relationship where L is the loft of the first golf club (e.g., L1, L2, etc.), measured in degrees, and SA is the striking face surface area SA (e.g., SA1, SA2, etc.), measured in square inches, of the golf club head:

$$(-0.0016\times L^2)+(0.195\times L)-1.5\leq SA\leq(-0.0016\times L^2)+(0.195\times L)-1.3$$

This equation is plotted as the graph shown in FIG. 24A where the loft L is shown plotted on the x-axis and the striking face surface area (SA) of the golf club head is plotted on the y-axis. As shown in FIG. 24A, the striking face surface area SA of the disclosed club head varies with the loft L whereby the striking face surface area SA of prior art wedges substantially does not vary with the loft. FIG. 24A illustrates graphs of a range based on varying the loft L and/or surface area SA. Preferably, the above relationship between SA and L is satisfied for greater than two clubs (or club heads) of a set of clubs, e.g. for three clubs, and (alternatively and/or additionally) preferably for all clubs of a correlated set of clubs.

The blade height may also be defined at the toe (referred to herein as "toe blade height"). The toe blade height BH refers to the distance along the striking face of the blade, measured from the sole to the top portion of the club head along the toe edge of the scorelines at plane B, as illustrated at FIGS. 22A, 22B, 22C, and 22E. The toe blade height BH of the disclosed club heads varies with the loft L.

The golf club head also has a lateral distance D16 from the face center 1930 to the a vertical plane perpendicular to the striking face plane and passing through the toe edge 2222 of the club head. This lateral distance may vary with loft L and may be greater than or equal to 46 mm, greater than or equal to 45 mm, or greater than 44.8 mm.

The above aspects in combination with the other aspects discussed herein allow: (1) a high number of loft options for selecting a set, (2) the face grooves to be milled (as opposed to cast or stamped), (3) the face pattern to be milled (as opposed to media blast), and (4) optional laser milling.

Each of the above-described club heads may have additional features that help to affect a centrally-located center of gravity, while maintaining a traditional club head appearance (e.g. wedge-type club head appearance). For example, each club head may have a shell-like structure. There may be a number (one or more) of rear cavities in the golf club head, such cavities preferably provided with a cap thereon to effect a flush appearance and/or optionally filled with a resilient and/lightweight filler material or aft-attached insert. The golf club head may be considered to have an actual volume (which, as used herein, refers to the volume of the entire golf club head including the hosel and any recesses that may deviate from the general contour of the club head) and/or a "filled volume." The "filled volume" as used herein includes the club head volume after filling in "fully recessed regions" of the golf club head. "Fully recessed region," as used herein, refers to a region of an exterior surface of a portion of the golf club head consisting of all points on the exterior surface of the portion such that every imaginary infinite straight line that passes through any one of such points also penetrates the exterior surface, as defined in U.S. Pat. No. 9,492,720, which is herein incorporated by reference. In a practical sense, "filled volume" generally corresponds to the believed manner in which the USGA may measure the volume of a club head for compliance purposes, while "actual volume" corresponds to the real volume of the club head (excepting the internal volume of any hosel bore). Apart from determining compliance with USGA regulation, a comparison of"filled volume" to "actual volume" could provide an indication of the degree of "shell"-likeness or structural minimalism of a golf club head. This, in turn, may correspond to an indication of degree of discretionary mass, which may be used—and preferably is used—to locate the center of gravity laterally closer to center, as further described below.

The filled volume may be greater than or equal to 42 cc, greater than or equal to 45 cc, or greater than or equal to 47 cc, in some aspects. The ratio of actual volume to the filled volume is less than or equal to 90%, less than or equal to 85%, less than or equal to 80%, or in the range between 65-80%.

The shell-like structure described above increases discretionary mass, and also with more recesses, there are more regions where mass pockets could be "hidden" or out of view, resulting in facilitating achieving D1A values described above Referring to FIGS. 26A-26I, a club head 1100 is shown in accordance with one or more embodiments of the present disclosure. Unless otherwise stated, the golf club head 1100 is similar to the golf club head 100 of FIGS. 1-8 and embodies all attributes described in relation thereto including mass-related attributes and structural attributes.

The golf club head 1100 includes a top portion 1102, a bottom portion 1104, a heel portion 1108, and a toe portion 1106. The golf club head 1100 further includes a striking face 1116 in a front portion of the club head 1100, and a rear portion 1142 opposite of the striking face 1116.

Figure 26A:
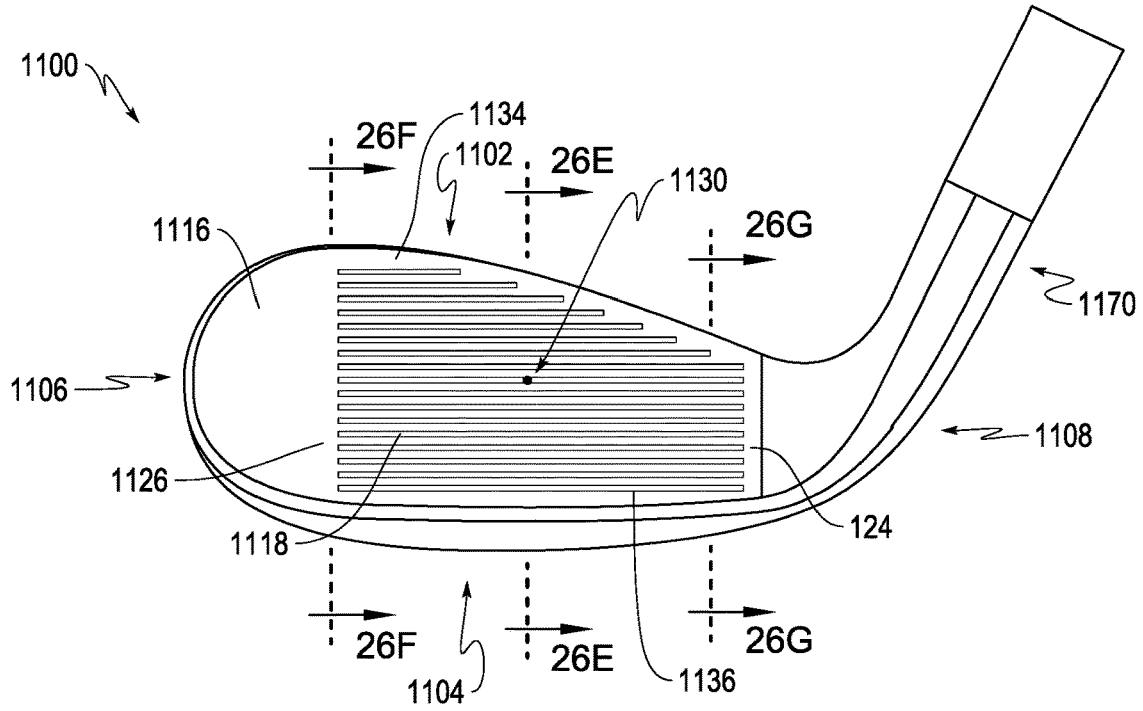
FIG. 26A is a front elevation view of an exemplary golf club head in accordance with one or more embodiments.
Figure 26B:
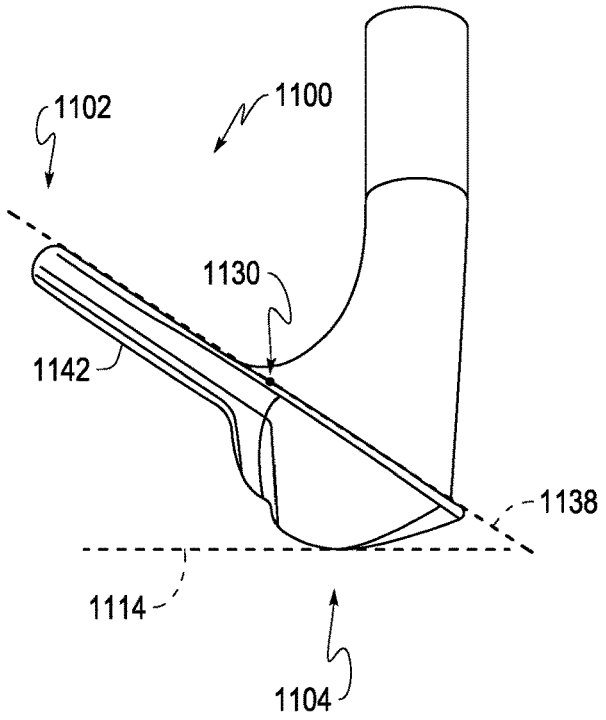
FIG. 26B is a toe side elevation view of the exemplary golf club head of FIG. 26A.
Figure 26C:
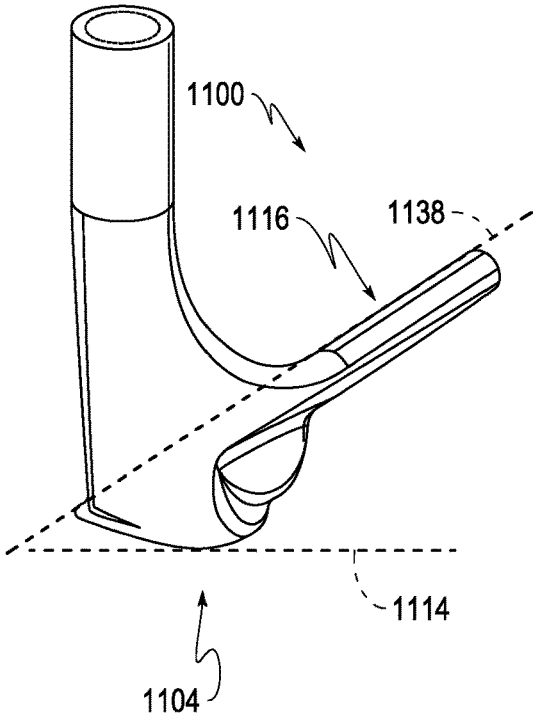
FIG. 26C is a heel side elevation view of the exemplary golf club head of FIG. 26A.

As shown particularly in FIG. 26A, the striking face 1116 comprises a generally planar surface. For example, the striking face 1116 generally conforms to a planar hitting surface suitable for striking a golf ball, but may deviate to a minor extent as it may preferably include formed therein a plurality of scorelines 1118 extending in the heel-to-toe direction. In some embodiments, the striking face 1116 may also possess bulge and/or roll of a constant or variable radius that are customary of a wood-type or hybrid-type club head (e.g. a radius no less than about 9 in). The plurality of scorelines 1116 defines a heel-most extent 1124, a toe-most extent 1126, a top-most extent 1134, and a bottom-most extent 1136.

The striking face 1116 further includes a face center 1130. The face center 1130, for all purposes herein, denotes the location on the striking face 1116 that is both equidistant between: (a) the heel-most extent 1124 and the toe-most extent 1126 of the plurality of scorelines 1118; and (b) the top-most extent 1134 and the bottom-most extent 1136 of the plurality of scorelines 1118. The striking face 1116 corresponds to a virtual striking face plane (see e.g. FIGS. 26B and 26C) 1138. Where the striking face 1116 includes bulge and/or roll, the virtual striking face plane 1138 is to be considered to be a virtual plane tangent to the striking face 1116 at the face center 1130. A virtual vertical plane 1128, perpendicular to the striking face plane 1138 and passing through the face center 1130, is also shown.

In some embodiments, the striking face 1116 may have formed therein one or more texture patterns. For example, the striking face 1116 may include a surface milled region (as described below), a media-blasted region, a chemical etched region, a laser-milled region. Such regions may be formed in a striking face 1116 in combination, either in discrete mutually exclusive regions or at least partially (or fully) overlapping. Preferably, textured striking face regions are located at least in a central region, e.g. a region of intended impact, that includes the majority (and more preferably the entirety) of the plurality of scorelines 1118. In such cases, interaction between the striking face 1116 and golf ball may be enhanced (e.g. by increasing friction), thereby better controlling and/or increasing spin.

In some embodiments, in addition to a central region that exhibits a media-blasted and/or surface milled texture, heel and toe regions peripheral to such central region exhibit surfacing, e.g. high-polish surface textures. However, preferably, at least one of the peripheral toe region (e.g. "toe par") or the peripheral heel region, but preferably at least the peripheral toe region, exhibits a textured pattern.

Figure 26D:
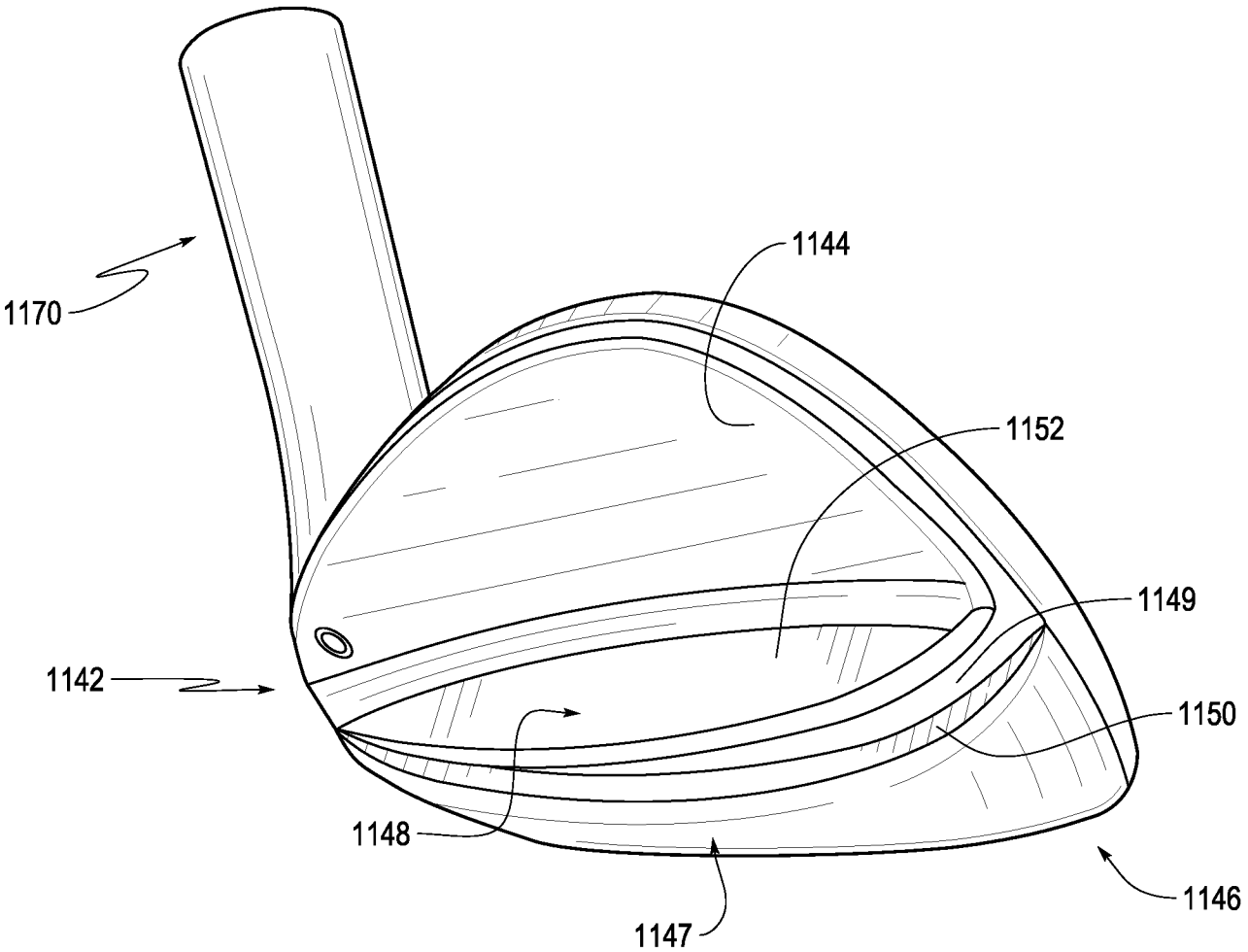
FIG. 26D is a rear perspective view of the exemplary golf club head of FIG. 26A.

As shown in FIG. 26D, the rear portion 1142 of the club head 1100 includes a blade portion 1144 and a muscle portion 1146. In some embodiments, the muscle portion includes a sole portion 1147 and a stepped portion 1148 located between the sole portion 1147 and the blade portion 1144. The stepped portion includes a step surface 1149 that is recessed from the sole portion 1147 by virtue of a first sidewall 1150. The first sidewall 1150 may be substantially perpendicular to the step surface 1149 or at an angle therefrom. A second sidewall 1152 is located between the step surface 1149 and the rear surface constituting the blade portion 1144. A bevel or arcuate region may be formed between the first sidewall 1150 and the step surface 1149. A junction formed between the second sidewall 1152 and the blade portion 1144 preferably includes a fillet region.

The step surface 1149 preferably varies in width in the heel to toe direction. Preferably, a width of the step surface 1149 in a heelward location is less than a width of the step surface 1149 in a toe-ward location.

The step surface 1149 provides a benefit in improving mass-related aspects of the golf club head 1100, in particular, a location of the center of gravity, preferably the lateral location of the center of gravity, thereby facilitating the center of gravity location properties described above with regard to the embodiment of FIG. 1. Such design features further enable forming a golf club head that more readily achieves a predetermined target mass without denigrating from a traditionally-appearing golf club head nor forfeiting other performance-related features of the golf club head, i.e. "feel" and "playability." The club head 1100 thus preferably exhibits the center of gravity location attributes described with regard to the embodiment of FIG. 1.

Figure 26E:
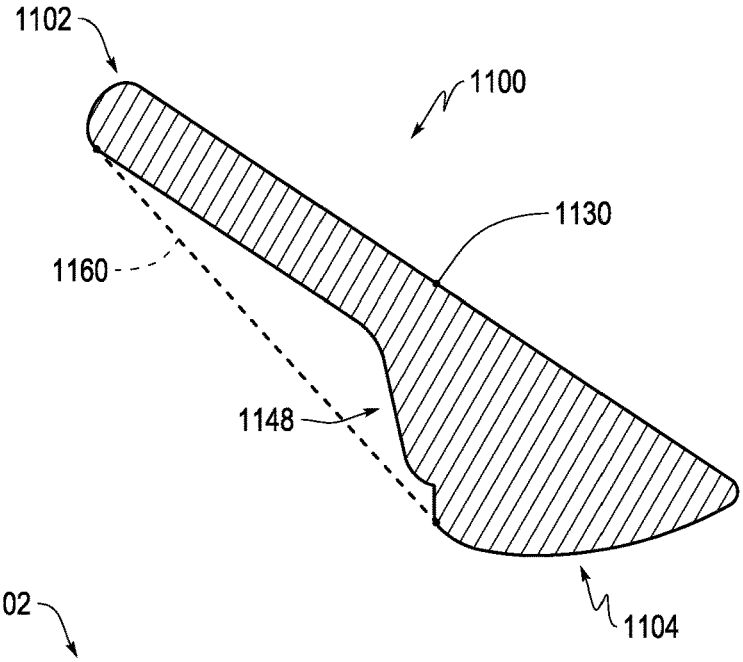
FIGS. 26E-26G are cross-sectional views of the exemplary golf club head of FIG. 26A.
Figure 26F:
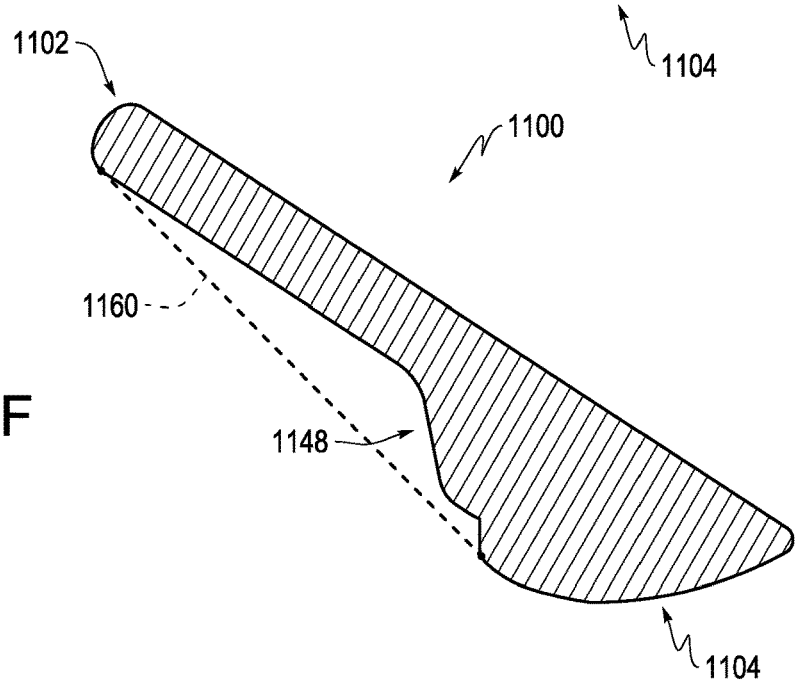
Figure 26G:
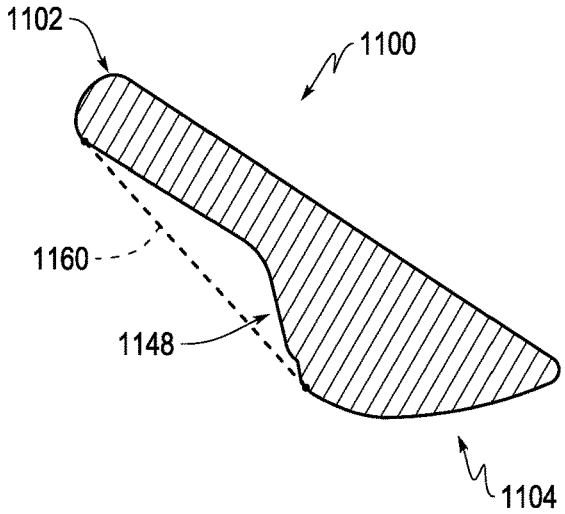

Preferably, however, the stepped portion 1148 is configured such that it is unlikely to interfere with typical golf club head turf interaction. In some embodiments, this may be characterized by ensuring that that stepped portion does not protrude rearward of the sole surface. More particularly, preferably, in at least one vertical, front-to-rear cross-section, the stepped portion 1148 does not extend out of a spatial region delimited by the top line, and the sole surface. For example, as shown in FIG. 26E, the golf club head 1100 is shown in cross-section 26E, which passes through the face center 1130 of the club head 1100. In such embodiment, the stepped portion can be shown to not extend beyond such region, the boundary of which is shown by a virtual dashed boundary line 1160. Preferably, the same condition is met in a vertical front-to-rear cross-section passing through the heel-ward-most extent 1124 of the scorelines 1118, (see FIG. 26G) and, more preferably, also in a vertical front-to-rear cross-section passing through a toe-ward-most extent 1126 of the scorelines 1118. Most preferably, such condition is met in all front-to-rear vertical cross-sections in which such stepped portion may be found.

To further ensure that the club head maintains a traditional appearance and thus communicates to a golfer durability and conventional response, the step surface preferably bears a visually-distinct appearance from other exterior surfaces of the club head, in particular preferably adjacent regions of the club head, more particularly, the sole surface. Preferably, the stepped surface is configured to appear more subdued, e.g. by virtue of application of media blast. However, in alternative embodiments, the step surface may be chemically etched, laser etched, and/or darkened. Alternatively, the step surface may exhibit a color or hue distinct from that of such other club head regions, in particularly a color or hue that is darker, black, less lustrous, less smooth, less bright, and/or less reflective. Such visual contrast also provides indication to a user that such feature is not intended to be a turf interaction modifier, but primarily for achieving mass distribution goals.

Figure 26H:
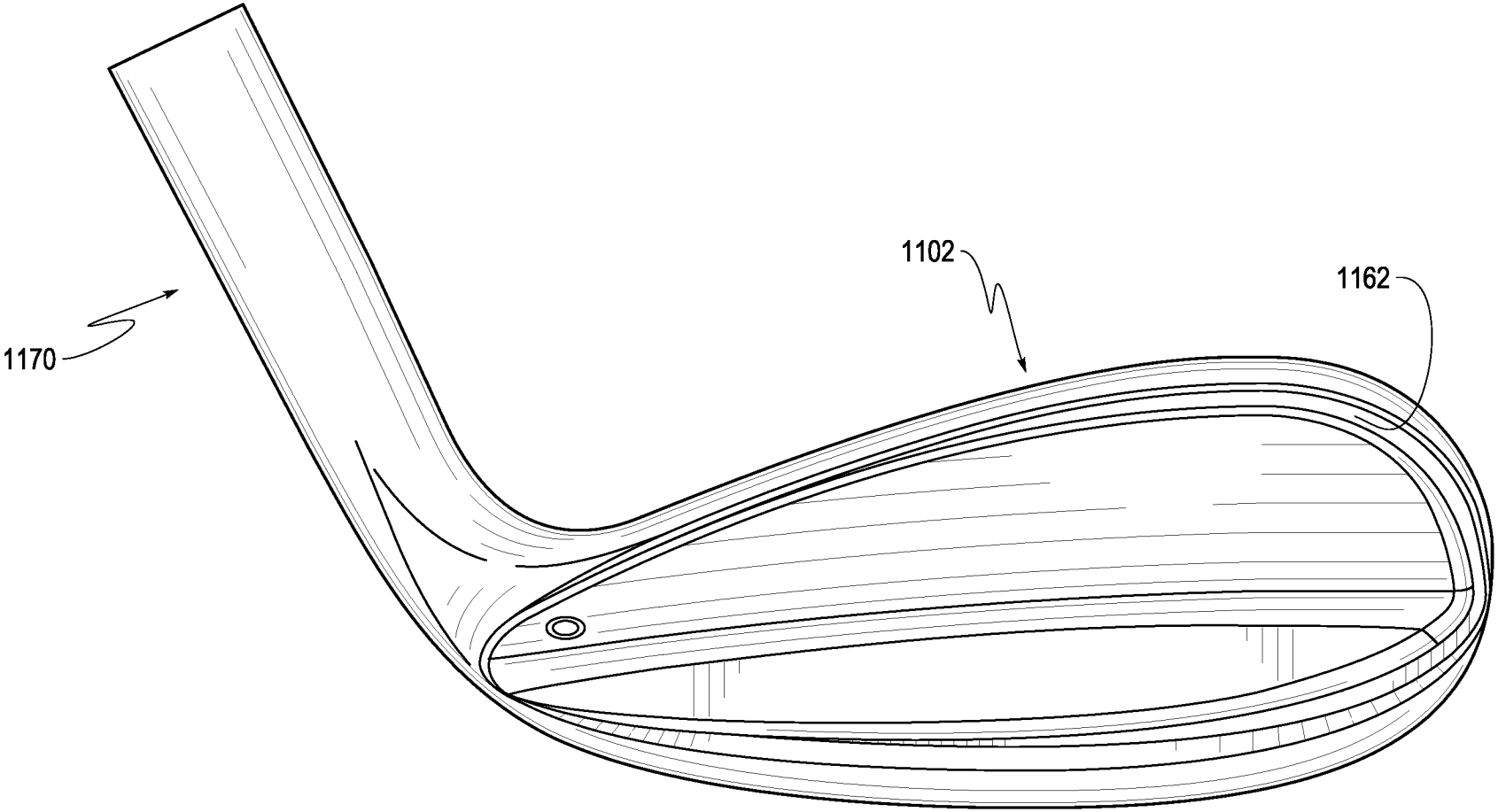
FIG. 26H is a rear elevation view of the exemplary golf club head of FIG. 26A.

As shown particularly in FIGS. 26A and 26H, the blade portion 1144 of the golf club head 1100 varies in thickness. Preferably the thickness of the blade portion generally increases in the heel to toe direction, but also, more preferably, in a sole to top direction, e.g. tapering downward from locations adjacent the top portion 1102 to locations adjacent a junction between the blade portion 1144 and the muscle portion 1146. Such configuration improves mass distribution and thus performance, for example by reducing shot dispersion in similar manner as described above in prior embodiments. E.g., such variable thickness-related mass distribution results in increased moment of inertia about a vertical axis passing through the center of gravity. However, such preferential mass redistribution may result in a club head with a non-tradition appearance and/or a club head with features that may distract the golfer's focus at address or reduce effective alignment.

Preferably, the blade thickness varies. More particularly, in some embodiments the blade thickness varies both in the heel to toe direction and the top to sole direction. Particularly, the thickness preferably varies from a first thickness no greater than 5 mm to a second maximum thickness no less than 6 mm. More preferably, the first thickness is no greater than 4.5 mm and the second maximum thickness is no less than 6.25 mm. Most preferably, the first thickness is equal to about 4.25 mm and the second thickness is equal to about 6.5 mm.

Accordingly, the blade portion 1144 further includes a bevel 1162 as shown particularly in FIG. 26H. A bevel 1162 is located between the top portion 1102 and the rear surface of the club head 1100 constituting the blade portion 1144. As described above, the bevel 1162 preferably varies in width in the heel to toe direction, in part to accommodate the distribution of mass constituting the blade portion 1144. Preferably, the width of the bevel 1162 increases from the heel toward the toe, such that a heel-ward vertical front-to-rear cross-section includes a bevel width that is less than a bevel width at a toe-ward vertical front-to-rear cross-section.

Preferably, the bevel 1162 is structured so that, as measured in cross-section 26F, it has a width between 1.5 mm and 3 mm, and as measured in cross-section 26G, it has a width between 1.75 mm and 4 mm. Additionally, or alternatively, for a particular club head, the difference in bevel width between that in cross-section 26F and cross-section 26G is no less than 1 mm, more preferably no less than 1.5 mm. However, such values may differ for example as a function of bounce angle as will be discussed below with regard to FIG. 29.

Preferably, by virtue of the bevel 1162 varying in width from heel-to-toe, the width of the top portion 1102 may remain substantially constant. Preferably the top portion width is no greater than 5 mm, more preferably no greater than 4.5 mm, and even more preferably no greater than 4.25 mm. Preferably, such thickness remains substantially constant at all heel to toe locations between the vertical cross-section 26F and vertical cross-section 26G. However, due to manufacturing tolerances, preferably such width remains within 90% to 110%, more preferably within 95% to 105% and most preferably within a range of 99% to 101% of an average width value between such vertical cross-sections.

Additionally, or alternatively, the bevel 1162 is preferably structured to be minimally visible at address. Accordingly, as shown particularly in FIG. 26I, the bevel is preferably angled relative to the top portion such that the bevel is not visible from a top down eye position. Quantitatively, preferably, the bevel is angled such that it lies forward of a virtual vertical line passing through the rear edge of the top portion. Such configuration preferably occurs in central vertical cross-section 19E, more preferably in each of cross-sections 19E, 19F, and 19G, and most preferably at all vertical front-to-rear cross-section in which the bevel exists.

In this manner, preferably, the angle of the bevel 1162 is selected based on a predetermined intended loft of the golf club head. E.g., the angle of the bevel 1162 relative to the striking face plane 1138 is preferably no greater than the loft of the club head, and more preferably less than the loft minus 2°. By provision of the mass shifting features of the golf club head 1100 as augmented by virtue of the bevel structure, the golf club head may exhibit a relatively high moment of inertia (MOT), thereby increasing forgiveness of the club head. For example, in some embodiments, MOI about an axis extending through the center of gravity in the heel to toe direction (Iyy) is preferably between 800 and 900 g*cm2. However, in cases in which the face thickness and bevel width is particularly accentuated, Iyy may be greater than about 900 g*cm2, preferably between 1000 g*cm2 and 1100 g*cm2.

Figure 26I:
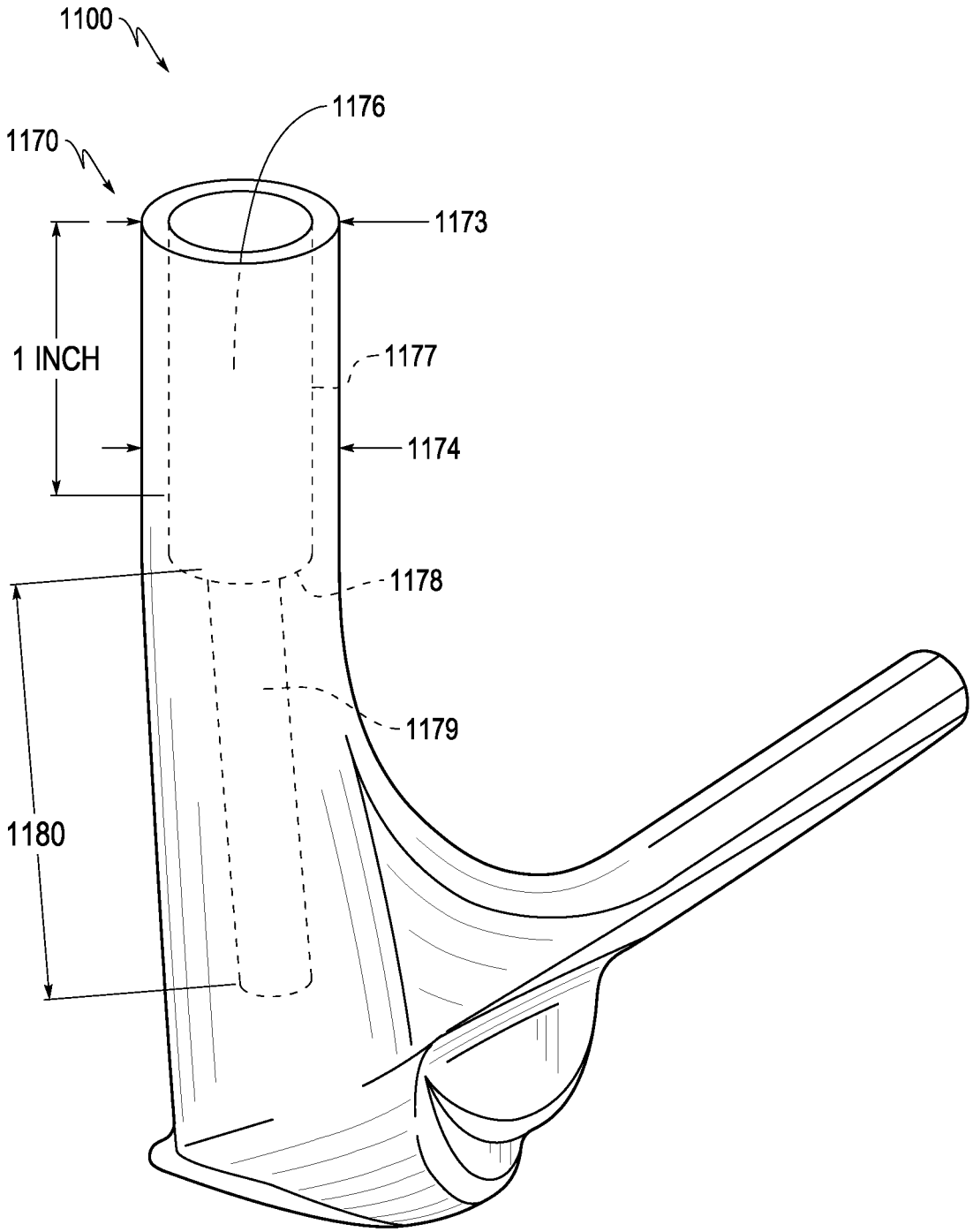
FIG. 26I is another heel side elevation view of the exemplary golf club head of FIG. 26A.

As shown in FIG. 26I, to further distribute mass in a manner that improves performance, mass is selectively distributed about the hosel in a manner in which structurally integratity thereof is maintained.

The hosel 1170 includes an outer diameter, and internal bore 1176 structure to secure a golf shaft thereto, and a recess 1179 extending soleward from the bore 1176. The bore 1176 includes a circumferential side wall 1177 and a bottom surface 1178. Preferably, the hosel 1170 is structured such that the outer diameter tapers toward the sole. For example, in some embodiments, the hosel outer diameter tapers from a first diameter 1173 (e.g. about 13.1 mm), measured proximate the upper edge of the hosel, to a second diameter 1174 (e.g. 12.5 mm), measured at a location 1 in soleward of the first hosel diameter location, whereby the difference therebetween is no less than 0.5 mm, more preferably, no less than 0.6 mm.

The recess 1179 extending from the bore 1176 preferably comprises a depth of no less than 6 mm and more preferably about 7 mm. However, in some embodiments, preferably in cases in which loft is no less than 50°, the recess 1179 is no less than 10 mm, more preferably, no less than 14 mm and most preferably equal to about 18 mm. To enable such feature and to ensure structural integrity, hosel offset is preferably minimized to accommodate such a large recess depth 1180. In particular, hosel offset is preferably no greater than 2 mm, more preferably, no greater than 1.75 mm and even more preferably, no greater than 1.55 mm. However, in some embodiments, offset varies with loft within a correlated set of golf club heads. In such cases, some particularly-lofted club heads may exhibit a hosel offset of no greater than 0.6 mm.

Because, in the above embodiments, the center of gravity is generally shifted laterally toward the center, e.g. generally toe-ward relative to conventional club heads, the effect of center of gravity location on club swing weight becomes an increased concern.

Figure 27:
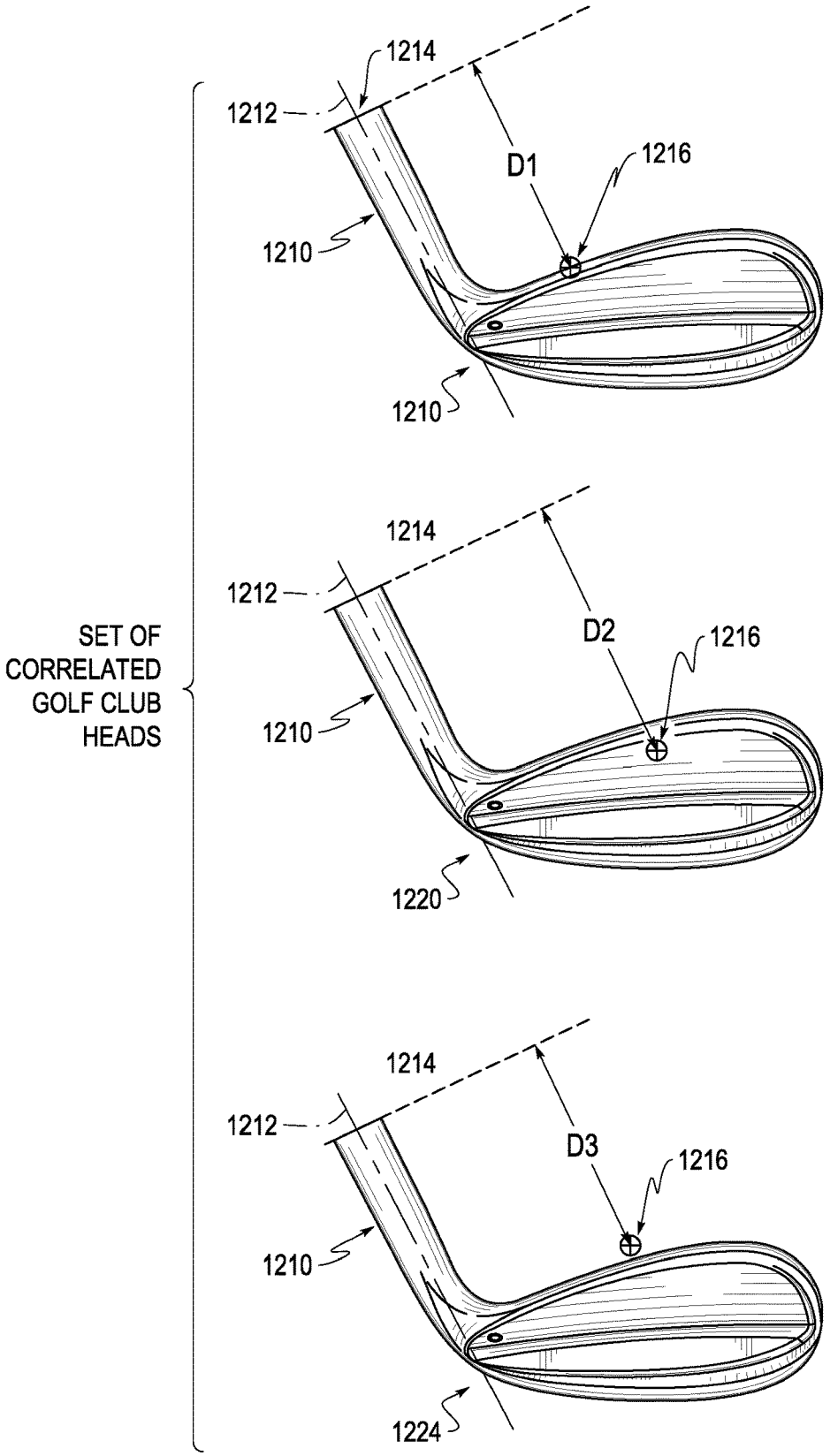
FIG. 27 shows a correlated set of golf club heads in accordance with one or more embodiments.
Figure 28:
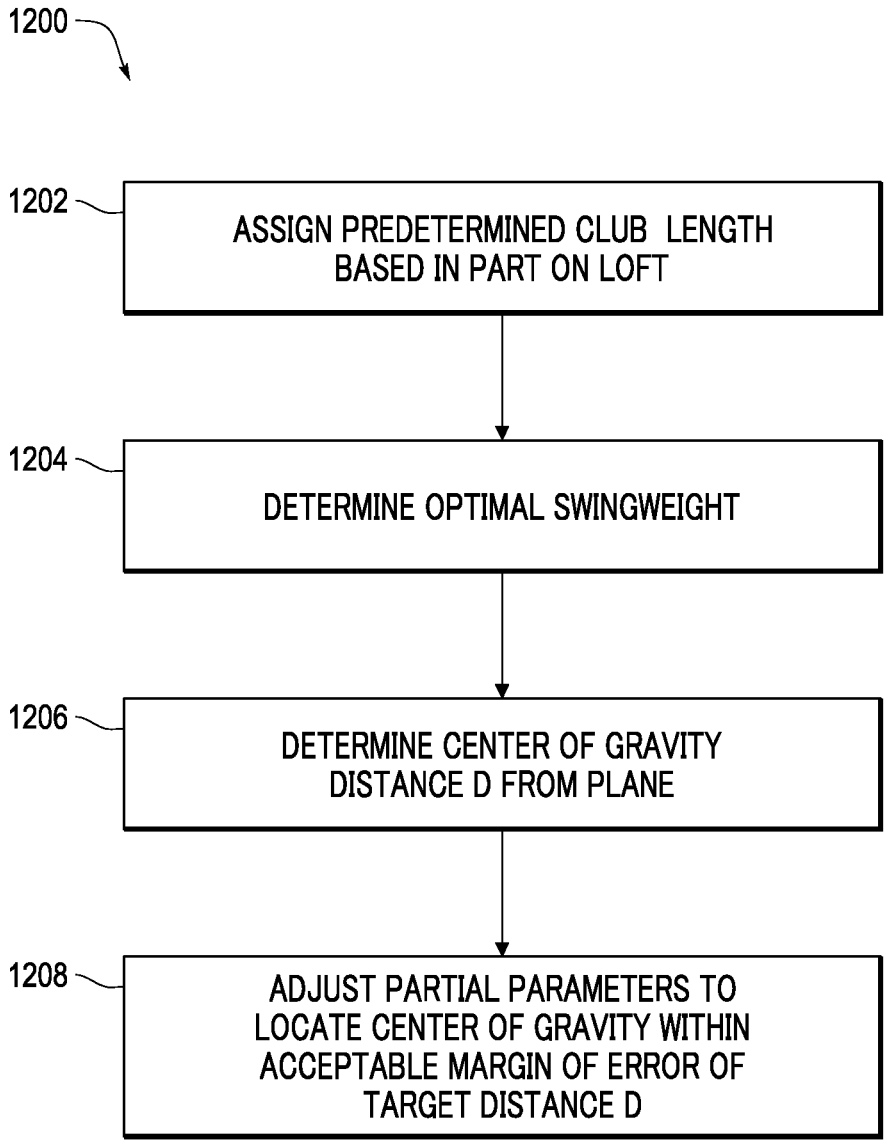
FIG. 28 shows steps of a process in accordance with one or more embodiments.

Thus, preferably, as shown in FIG. 28, a method 1200 is carried out to provide greater control over swingweight outcome to ensure consistent use by golfers. First, in step 1202, a club length is assigned to the golf club under formation, preferably based at least on the intended club loft. Next, in step 1204, an ideal golf club swingweight is assigned to the golf club. Next, in step 1206, using lookup tables, equations, databases, etc., an optimal distance of a golf club head center of gravity 1216 location D1, D2, or D3 from a virtual plane perpendicular to the virtual hosel axis 1212 and passing through the upper surface 1214 of the hosel 1210 is determined (see e.g. FIG. 27). Preferably an algorithm is developed and used for such purposes. Finally, in step 1208, the golf club head is formed, and spatial attributes selected such that the club head, in final form, exhibits a center of gravity location D1, D2, or D3, from the virtual plane that is within a predetermined acceptable margin of error of the predetermined target distance D. In some embodiments, an acceptable margin of error constitutes being within 85-115% of the target D value, but more preferably the margin of error constitutes the range of 90% to 110% of the target D value, and most preferably the range of 95% to 105% of the target D value.

By adopting the method described above with regard to FIG. 28, a correlated set of golf club heads may be formed (see e.g. FIG. 27). Not only would following such a process provide greater accuracy in swingweight assignment, such a process also provides for greater control over club shaft selection. For example, the first club 1220 is intended to exhibit a loft of 44° and the second club 1222 is intended to exhibit a loft of 46°. It may be preferable that both clubs, when finally assembled include a same shaft length. Accordingly, using the above example, such club heads may be formed whereby spatial attributes are selected to result in a same center of gravity distance D1 and D2 and/or varied such that D1 is substantially equal to D2 within an acceptable margin of error (optionally being the same range as described above). Such methods are particularly beneficial provided the desired shift in lateral center of gravity location toward the toe, but also due to an implementation of a shorter hosel. For example, preferably, the hosel length (measured relative to the ground plane, along the virtual hosel axis) is no greater than 80 mm, more preferably no greater than 76 mm, and even more preferably between 70 mm and 76 mm.

Figure 29:
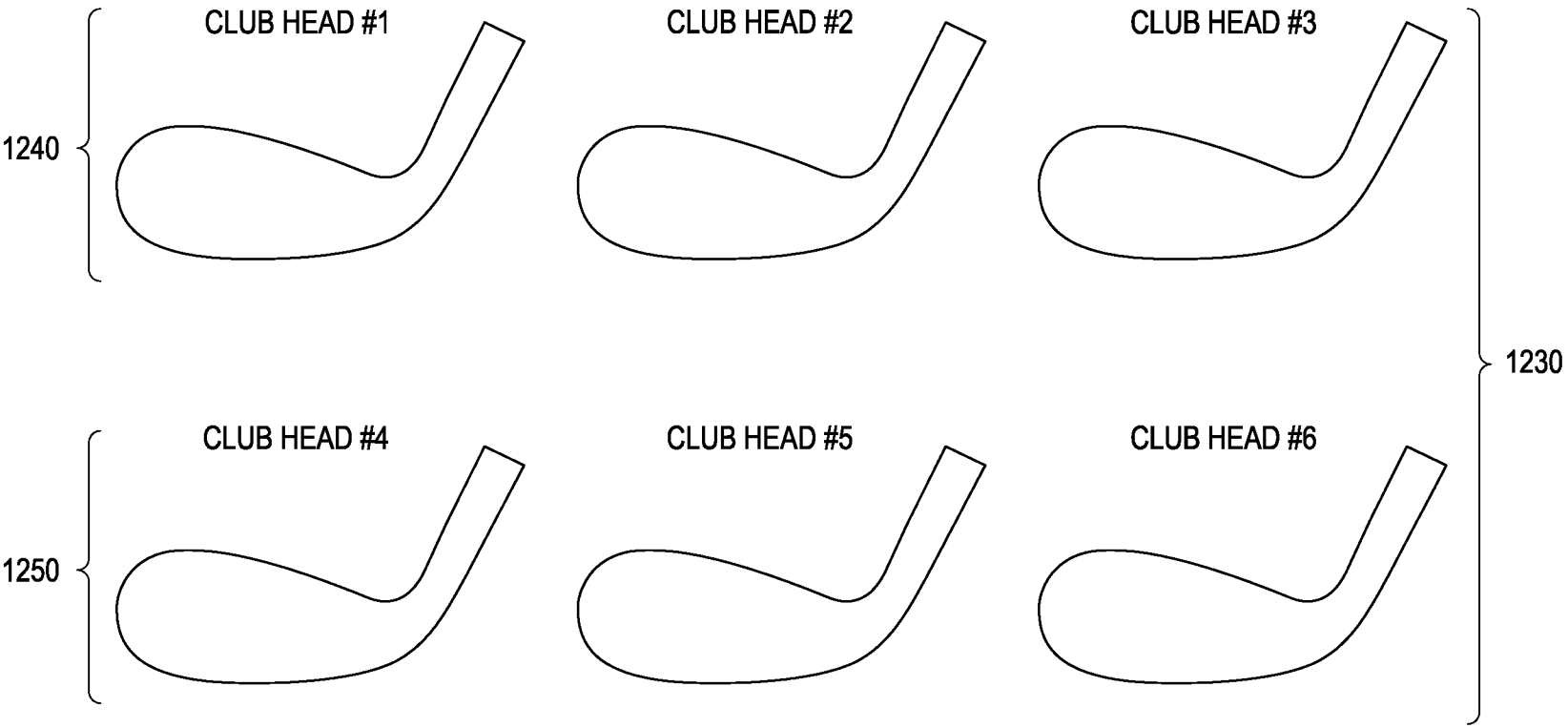
FIG. 29 shows a portfolio of golf club heads in accordance with one or more embodiments.

Referring to FIG. 29, a portfolio 1230 of golf club heads is shown in accordance with the present disclosure. Each of the club heads preferably exhibits structural, mass, and performance features as described with regard to the embodiments shown in FIG. 26A. The portfolio 1230 constitutes an offering of plural correlated sets of golf clubs, e.g. a first set 1240 and a second set 1250. The first set 1240 and the second set 1250 bear structural similarities, preferably structural and external similarities sufficient to indicate similarity of product offering and correlation. The sets however preferably differ by bounce angle. The first set 1240 comprises a set of at least two, preferably at least three club heads of a first bounce angle (e.g. a total bounce angle of about 3° measured in a central location aligned with a face center). The second set 1250 preferably comprises a set of at least two, preferably three club heads of a second bounce angle that is greater than the first bounce angle (e.g. a total bounce angle of about 11° measured in a central location aligned with a face center). Across each set however are included at least one pair of club heads that share a common loft, e.g. a 46° loft angle.

Preferably, for at least one pair of golf club heads of different sets, e.g. sets 1240 and 1250, but sharing a common loft angle, the club head of the first set (i.e. having a lower bounce angle) includes a planar striking face area SA1 that is greater than a planar striking area SA2 of the club head of the second set. An exemplary striking face area, delimited by the top line, the leading edge, and heel-ward-most and toe-ward-most extents of the scorelines is preferably between 22 $cm^2$ and 28 $cm^2$, more preferably between 24 $cm^2$ and 27 $cm^2$, most preferably equal to about 25 $cm^2$. Preferably SA2 is at least 1%, more preferably at least 2% of the striking face area of the corresponding golf club heads of the second set 1250. Accordingly, a difference between the striking face surface area, as defined above, of corresponding club heads (having a same loft) of sets with different bounces may be preferably at least 0.2 $cm^2$, more preferable at least 0.25 $cm^2$, and even more preferably at least 0.4 $cm^2$.

In a similar manner, the first club head of the first set 1240 preferably includes a striking face defining a heel-side blade height that is greater than a corresponding heel-side blade height of the corresponding second club head of the second set 1250. For example, the first heel-side blade height (of the first club head) is preferably no greater than 37 mm, more preferably equal to about 36.5 mm. The second heel-side blade height (of the second club head having greater bounce angle) is preferably no less than 60 mm, more preferably no less than 61 mm. Accordingly a difference in heel-side blade length between corresponding same-lofted club heads of sets 1240 and 1250 of the portfolio 1230 having difference bounces, is no less than 1 mm, more preferably no less than 1.25 mm, and even more preferably no less than 1.5 mm.

Additionally, or alternatively, a pair of corresponding similar-lofted club heads of different sets preferably has top line bevel xx widths that vary in a correlated manner. Preferably, for the first club head of the first set 1240, bevel width, measured centrally, is less than a centrally-measured top line bevel width xx of the corresponding club head of the second set 1250. Furthermore, a difference between heel-side bevel width and toe-side bevel width as described above with regard to the embodiment of FIG. 26A, varies between a pair of corresponding club heads of different sets. Preferably, with increasing bounce angle, the variation in bevel width from heel-side location to toe-side location increases as well. As an example, a bevel width difference in the lower bounce angled club head set is preferably about 1.2, while the bevel width difference in the higher bounce angled club head is about 1.7. Alternatively, or in addition, a difference of differences of bevel widths is preferably no less than 0.4 mm, more preferably no less than 0.5 mm.

Additionally, or alternatively, a pair of corresponding similar-lofted club heads of different sets preferably has a step surface xx which diverges in the heel to toe direction. In such embodiments, such divergence preferably varies in a correlated manner with loft angle among club head sets 1240 and 1250 of the portfolio 1230. Preferably, for the first club head of the first set 1240, step surface width, measured centrally, is greater than a centrally-measured step surface width xx of the corresponding club head of the second set 1250 (having higher bounce angle).

Furthermore, a difference between heel-side step surface width and toe-side step surface width (each width measured in the sole to top direction and touching point on the step surface) varies between a pair of corresponding club heads of different sets. Preferably, with increasing bounce angle, the variation in step surface width from heel-side location to toe-side location decreases. As an example, a bevel width difference in the lower bounce angled club head set is preferably greater than 4 mm, more preferably greater than 4.5 mm, while the bevel width difference in the higher bounce angled club head is preferably less than 3.5 mm, more preferably less than 3 mm. In some embodiments, a portfolio 1230 may include sets in which club heads include step surface and sets in which club heads do not include any step surfaces. Alternatively, or in addition, a difference of differences of bevel widths is preferably no less than 1 mm, more preferably no less than 1.5 mm, and even more preferably, no less than 1.75 mm.

Also within the broad spirit and scope of the present disclosure is a process for providing a varied finish on golf club heads such as those shown and described above in connection with FIGS. 1-29. While the finish itself may primarily results in a visual characteristic, the steps of the disclosed process for creating that finish achieve manufacturing advantages over prior processes.

Figure 30:
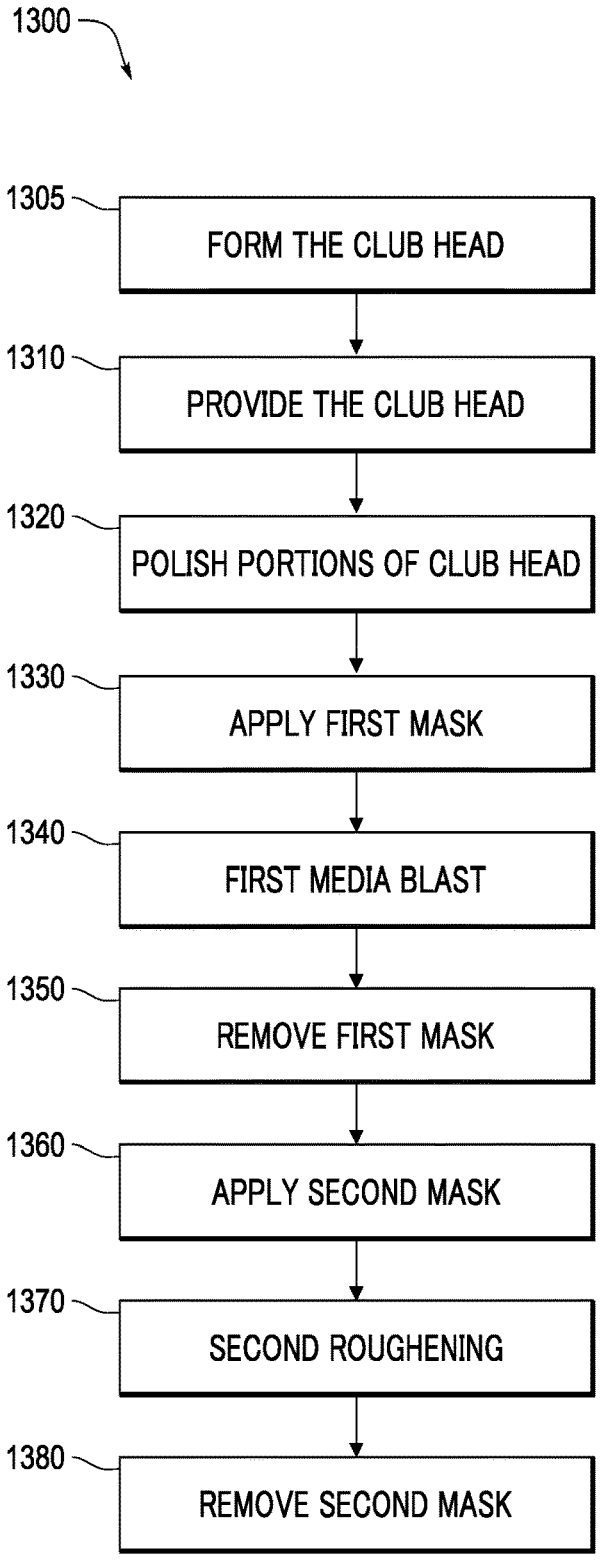
FIG. 30 shows a process of providing a varied finish to a club head exterior surface in accordance with one or more embodiments.

FIG. 30 shows steps constituting this process 1300. While this Figure and the following discussion present these steps in a certain order believed by the present inventors to be advantageous, the steps of this process may be performed in any suitable order. It is also to be understood that certain steps of this process may be entirely omitted as required.

In a step 1310 of the process 1300, a club head or other sports apparatus is preferably provided. This club head may preferably be cast, although it could be manufactured by any suitable method. For example, the club head may alternatively be manufactured by way of forging or machining from a billet. It is envisioned that the process 1300 may be performed on a previously-formed club head. In such a circumstance, the step 1310 may constitute the first step of the process. But it is also envisioned that the process 1300 may optionally include a first step 1305 for manufacturing the club head by way of one or more of the above-described methods.

Figure 31:
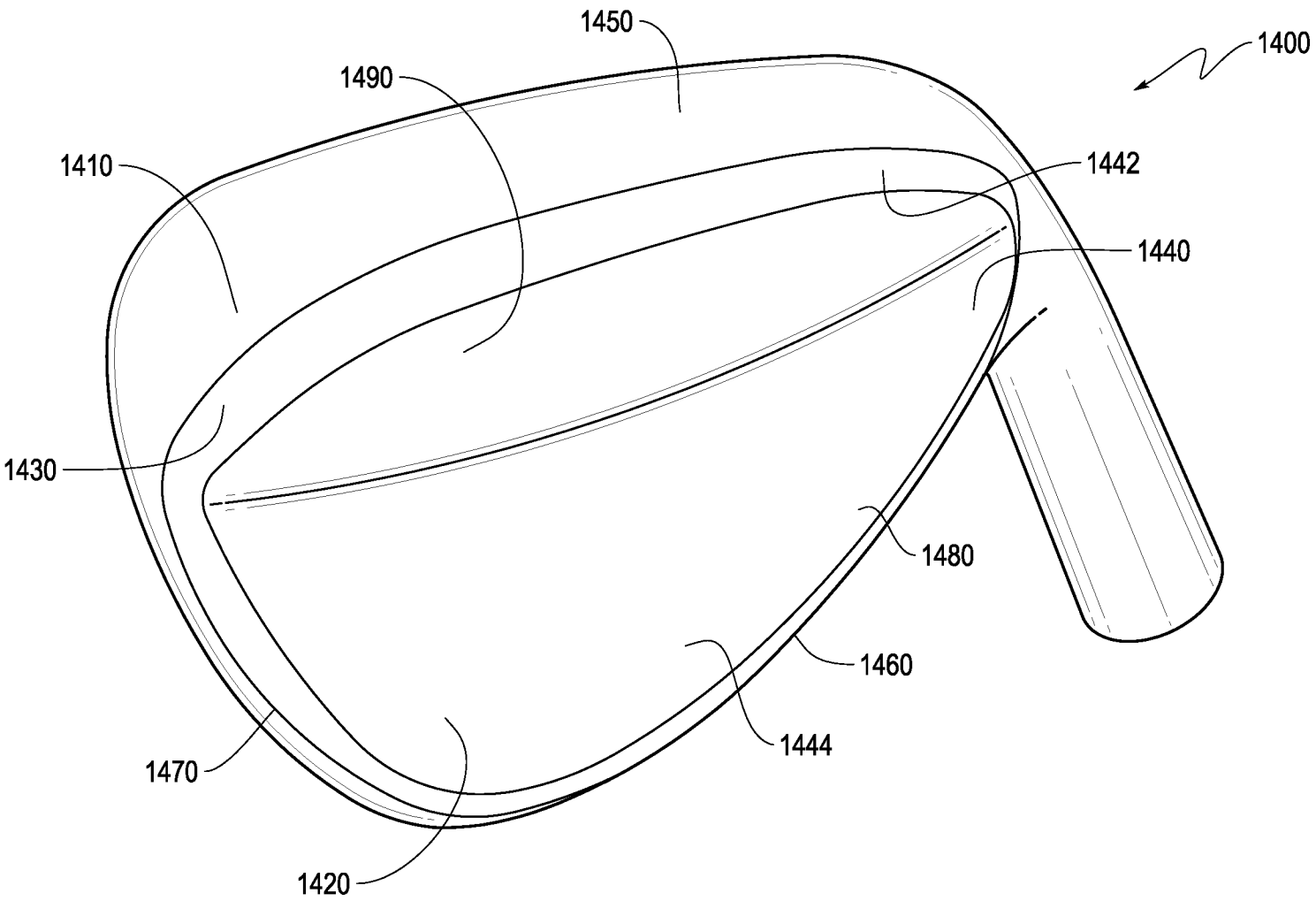
FIG. 31 shows an exemplary golf club head used in the process of FIG. 30.

As shown in FIG. 31, a club head 1400 provided for the step 1310 may be divided into three virtual exterior surface regions. The club head 1400 may be a wedge-type club head. Indeed, wedge-type club heads may be particularly suitable to the process 1300, as they tend to impact turf and other abrasive environments, e.g., sand bunkers, with greater frequency and impact than other types of club heads. Like the club heads shown in FIGS. 1-29, the club head 1400 may include a striking face, a rear surface 1440, a bottom surface 1450, and a top surface 1460. The rear surface 1440 may in turn include a lower portion 1442 and an upper portion 1444. Of the regions mentioned above, a first virtual region 1410 may include the sole or bottom surface 1450 and, possibly, the periphery 1470 of the blade of the club head 1400. A second virtual region 1420 may include the upper portion 1444 of the rear surface 1450 as well as the partial transition region from the blade portion 1480 of the club head to the muscle portion 1490. And a third virtual region 1430 may constitute a step or transition region between the regions 1410 and 1420 such that at least a portion of the third region corresponds with the lower portion 1442 of the rear surface 1440. This third region 1430 may comprise a concave surface portion, and it may entirely circumscribe the second region 1420. As shown in FIG. 31, these regions 1410, 1420, and 1430 may be mutually exclusive of each other and, in combination, form a contiguous portion of the exterior surface of the club head 1400.

In a second step 1320, portions of the club head provided in step 1310 are polished, preferably to a highly-reflective mirror finish. These polished portions may include all three of the regions 1410, 1420, and 1430. Alternatively, the entire club head 1400, or just the entire rear surface 1440 of that club head 1400, may be polished. As yet another alternative, only the region 1430 may be polished, possibly with some unintended cross-over into the regions 1410 and 1420. This polishing may preferably be carried out with one or more belt sanders. For example, first polishing may be performed by way of a belt sander with certain grit, with subsequent polishing being performed with belt sanders of increasing-grade grit until the mirror finish is achieved. Of course, other methods of polishing are possible.

A first mask is then applied in step 1330 to the polished club head 1400. Preferably, this first mask is applied to the first and third regions 1310 and 1330 of that club head. The first mask may preferably be applied by manually applying to the club head a tape of substantially uniform width and having two substantially straight and parallel side edges. This tape may be wrapped about the club head such that an edge of the tape aligns with arcuate contours forming the boundaries of the region 1430, especially those boundaries adjacent to the second region 1420. Alternatively, the first mask may be formed by use of a preformed mask developed by, e.g., CAD software, and having dimensions corresponding to regions 1410 and 1430 of the club head 1400. However, a preformed mask may vary in fit from club head to club head due, e.g., to manufacturing differences. For masking about regions having well-defined contour edges, these minor mis-alignments may be visible and detract from the overall quality of the application. As another alternative, a suitable mask may be cut from a larger masking element so as to coincide with the regions 1410 and 1430. However, this cutting process may result in a jagged, imprecise boundary for the mask. And it may also be more time-consuming than either of the other above mask forming methods.

The club head 1400, and particularly the second region 1420, may then be subjected to media blasting at step 1340. The surface roughening caused by this blasting preferably results in the region 1420 having a semi-gloss finish and appearance. But because the mask applied over the regions 1410 and 1430 shields those regions from the blasting, they are not impacted and retain their finish from the polishing step 1320. A ceramic blast is preferable for the blasting step 1340. However, this step may be performed with any suitable medium. For example, this blasting may be performed with glass beads, sand, and/or plastic.

The first mask may then be removed at step 1350 and a second mask may then be applied at step 1360. This mask may cover the second and third regions 1420 and 1430, and it may be applied in any of the ways discussed above in connection with the first mask at step 1330.

The club head 1400, and particularly the first region 1410, may then be subjected to second roughening at step 1370. This second roughening may preferably result in the region 1410 having a matte surface finish. But because the mask applied over the regions 1420 and 1430 shields those regions from further roughening, they may not be impacted and thus retain their prior finishes. An Aluminum Oxide ("AlOX") blast may preferably be used to perform step 1370, but grit as well as media may vary. Indeed, any suitable means, and/or combination of means, to roughen the region 1410 may be employed. For example, a brush wheel, in addition to media blast, may be used to abrade that region and give it a matte finish.

And in step 1380 the second mask may be removed. The process 1300 may thus yield a club head 1400 with three distinct finishes in the regions 1410, 1420, and 1430. In particular, the first region 1410 may have a matte finish, the second region 1420 may have a semi-gloss finish, and the third region 1430 may retain its original mirror finish.

The process 1300 and its particular order of steps thus allow a manufacturer to avoid having to mask small and/or minor regions, e.g., "islands," of the club head to obtain varied finishes. These small regions are not amenable to uniform thickness masking tape, and they may instead require preformed masks or ad-hoc cut masks, which have the various detriments discussed previously. The process 1300 may also allow the mirror polishing at step 1320 to be limited to the region 1430 and thus exclude from that polishing the region 1420. And as is further known to those of ordinary skill, polishing in a cavity such as that located in the region 1430 presents particular difficulties for a polishing belt, as polishing in such an area may abrade adjacent masked regions and thus leave messy edges. The particular order of steps shown by way of the process 1300 avoids this difficulty.

Moreover, although varied finishes may be primarily considered to impart visual characteristics upon the club head or other apparatus, they do impart some certain benefits to the functionality of the club head. For example, and particularly in the case of a wedge-type club head, various exterior surface regions of that club head interact with different environments. The sole bottom portion 1450 may be most likely to experience heavy turf or sand interaction, whereas the periphery 1470 of the club head 1400 is most likely to experience impacts with other club heads in the golf bag. These regions may thus benefit from having localized media blast and/or matte finishes such that any wear blends in with, or is less pronounced, than say a polished finish. Further, contrasting finishes may also advantageously accentuate various characteristics of the club head for communicating to a golfer latent properties of that club head. For example, mirror-finish as above may be used to highlight a toe-shifting mass feature or to highlight the mass-centered (or feel-balanced) nature of the club head, i.e., the club head center of gravity may be laterally centered.

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

What is claimed is:

1. A method of finishing an exterior surface of a golf club head, the method comprising the steps of:

(a) providing a golf club head having an exterior surface that includes a first surface region, a second surface region, and a third surface region, wherein the third surface region is at least partially located between the first and second surface regions, and the first, second, and third surface regions are mutually exclusive of each other and, in combination, form a contiguous portion of the exterior surface;

subsequent to step (a), (b) applying a first surface finish to at least the third surface region of the exterior surface of the golf club head;

subsequent to step (b), (c) applying a first masking to at least the first and third surface regions of the exterior surface of the golf club head;

subsequent to step (c), (d) applying a second surface finish to the second surface region of the exterior surface of the golf club head;

subsequent to step (d), (e) removing the first masking;

subsequent to step (e), (f) applying a second masking to at least the second and third surface regions of the exterior surface of the golf club head;

subsequent to step (f), (g) applying a third surface finish to the first surface region of the exterior surface of the golf club head; and subsequent to step (g), (h) removing the second masking, wherein the first, second, and third surface finishes are each different from each other.

2. The method of claim 1, wherein the step (b) of applying a first surface finish further comprises surface polishing, resulting in a highly reflective appearance.

3. The method of claim 1, wherein the step (d) of applying a second surface finish further comprises surface roughening resulting in a semi-gloss appearance.

4. The method of claim 3, wherein the step (d) of applying a second surface finish further comprises media blasting.

5. The method of claim 1, wherein the step (g) of applying a third surface finish further comprises surface roughening resulting in a matte appearance.

6. The method of claim 5, wherein the step (g) of applying a third surface finish further comprises abrading using a brush wheel.

7. The method of claim 1, wherein the step (c) of applying a first masking further comprises, using a flexible tape having a first side edge, a second side edge, and a substantially constant width measured between the first and second side edges, aligning at least one of the first and second side edges of the flexible tape with a boundary formed between the third surface region and the second surface region.

8. The method of claim 7, wherein the boundary follows an arcuate path.

9. The method of claim 7, wherein the third surface region comprises a concave surface portion.

10. The method of claim 1, wherein the second region is circumscribed, in its entirety, by the third region.

11. A method of finishing an exterior surface of a sports apparatus, the method comprising the steps of:

(a) providing a sports apparatus having an exterior surface that includes a first surface region, a second surface region, and a third surface region, wherein the third surface region is at least partially located between the first and second regions, and the first, second, and third surface regions are mutually exclusive of each other and, in combination, form a contiguous portion of the exterior surface;

subsequent to step (a), (b) polishing a portion of the exterior surface including the third surface region, resulting in a reflective appearance;

subsequent to step (b), (c) applying a first masking to at least the first and third surface regions of the exterior surface;

subsequent to step (c), (d) media blasting the second surface region of the exterior surface, resulting in a semi-gloss appearance;

subsequent to step (d), (e) removing the first masking;

subsequent to step (e), (f) applying a second masking to at least the second and third surface regions of the exterior surface;

subsequent to step (f), (g) roughening the first surface region of the exterior surface of the sports apparatus, resulting in a matte appearance; and subsequent to step (g), (h) removing the second masking, wherein the first, second, and third surface finishes are each different from each other.

12. The method of claim 11, wherein the sports apparatus comprises a golf club head.

13. The method of claim 12, wherein:

the golf club head comprises a striking face, a rear surface having an upper portion and a lower portion, a top surface, and a bottom surface;

the first surface region corresponds with the bottom surface;

the second surface portion corresponds with the upper portion of the rear surface; and the third surface portion corresponds with the lower portion of the rear surface.

14. The method of claim 12, wherein the golf club head is a wedge-type golf club head.

15. The method of claim 11, wherein the step (g) of roughening the first surface region further comprises media blasting the first surface region using an aluminum oxide media.

16. The method of claim 11, wherein the step (g) of roughening the first surface region further comprises abrading the first surface region using a brush wheel.

17. The method of claim 11, wherein the step (c) of applying a first masking further comprises, using a flexible tape having a first side edge, a second side edge, and a substantially constant width measured between the first and second side edges, aligning at least one of the first and second side edges of the flexible tape with a boundary formed between the third surface region and the second surface region.

18. The method of claim 17, wherein the boundary follows an arcuate path.

19. The method of claim 17, wherein the third surface region comprises a concave surface portion.

20. The method of claim 11, wherein the second region is circumscribed, in its entirety, by the third region.

* * * * *